US011421369B2

(12) United States Patent
Kim et al.

(10) Patent No.: US 11,421,369 B2
(45) Date of Patent: Aug. 23, 2022

(54) CLOTHES TREATMENT APPARATUS AND CONTROL METHOD THEREFOR

(71) Applicant: LG Electronics Inc., Seoul (KR)

(72) Inventors: Beomjun Kim, Seoul (KR); Woore Kim, Seoul (KR); Bio Park, Seoul (KR); Seulgi Park, Seoul (KR); Jaehyuk Jang, Seoul (KR); Sangwook Hong, Seoul (KR); Changoh Kim, Seoul (KR); Hyunwoo Noh, Seoul (KR)

(73) Assignee: LG Electronics Inc., Seoul (KR)

( * ) Notice: Subject to any disclaimer, the term of this patent is extended or adjusted under 35 U.S.C. 154(b) by 6 days.

(21) Appl. No.: 17/170,134

(22) Filed: Feb. 8, 2021

(65) Prior Publication Data

US 2021/0164151 A1 Jun. 3, 2021

Related U.S. Application Data

(63) Continuation of application No. 16/328,100, filed as application No. PCT/KR2017/009341 on Aug. 25, 2017, now Pat. No. 10,941,511.

(30) Foreign Application Priority Data

Aug. 25, 2016 (KR) ..... 10-2016-0108328
Aug. 9, 2017 (KR) ..... 10-2017-0101332
(Continued)

(51) Int. Cl.
*D06F 39/04* (2006.01)
*D06F 58/26* (2006.01)
(Continued)

(52) U.S. Cl.
CPC ..... *D06F 39/04* (2013.01); *D06F 21/04* (2013.01); *D06F 34/24* (2020.02); *D06F 37/04* (2013.01);
(Continued)

(58) Field of Classification Search
CPC ..... D06F 39/04
See application file for complete search history.

(56) References Cited

U.S. PATENT DOCUMENTS 5,935,471 A 8/1999 St. Louis

FOREIGN PATENT DOCUMENTS

DE 102008043281 5/2010
DE 102009026646 12/2010
(Continued)

OTHER PUBLICATIONS

Office Action in U.S. Appl. No. 16/111,492, dated Nov. 2, 2021, 8 pages.
(Continued)

*Primary Examiner* — Jason Y Ko
(74) *Attorney, Agent, or Firm* — Fish & Richardson P.C.

(57) ABSTRACT

The present invention relates to a clothes treatment apparatus and, more particularly, to a clothes treatment apparatus for directly heating a drum accommodating clothes. According to an embodiment of the present disclosure, provided is a clothes treatment apparatus comprising: a tub; a drum, made of a metal, which accommodates clothes and is rotatably provided inside the tub; and an induction module, provided in the tub so as to have a spacing from a circumferential surface of the drum, for generating an electromagnetic field to heat the circumferential surface of the drum, wherein the induction module comprises: a coil which is formed by winding a wire such that electric current is applied thereto to generate a magnetic field; and a base
(Continued)

housing mounted on an outer circumferential surface of the tub, wherein the base housing is provided with a coil slot for defining the shape of the coil in such a manner that the wire is mounted therein so as to have a predetermined distance between wire and wire.

26 Claims, 37 Drawing Sheets

(30) Foreign Application Priority Data

| | | |
|---|---|---|
| Aug. 9, 2017 | (KR) | 10-2017-0101334 |
| Aug. 9, 2017 | (KR) | 10-2017-0101338 |
| Aug. 9, 2017 | (KR) | 10-2017-0101340 |
| Aug. 25, 2017 | (KR) | 10-2017-0108223 |

(51) Int. Cl.

| | |
|---|---|
| ***D06F 34/24*** | (2020.01) |
| ***D06F 21/04*** | (2006.01) |
| ***D06F 37/04*** | (2006.01) |
| *D06F 58/04* | (2006.01) |
| *D06F 25/00* | (2006.01) |
| *D06F 37/26* | (2006.01) |
| *D06F 103/32* | (2020.01) |
| *D06F 105/28* | (2020.01) |
| *D06F 34/20* | (2020.01) |
| *D06F 37/42* | (2006.01) |

(52) U.S. Cl.
CPC ..... *D06F 58/26* (2013.01); *D06F 25/00* (2013.01); *D06F 34/20* (2020.02); *D06F 37/26* (2013.01); *D06F 37/42* (2013.01); *D06F 58/04* (2013.01); *D06F 2103/32* (2020.02); *D06F 2105/28* (2020.02)

(56) References Cited

FOREIGN PATENT DOCUMENTS

| | | |
|---|---|---|
| DE | 102016110859 | 6/2017 |
| EP | 2100996 | 9/2009 |
| EP | 1914339 | 3/2010 |
| EP | 02400052 | 12/2011 |
| EP | 3287559 | 2/2018 |
| JP | 2003288976 | 10/2003 |
| JP | 3861731 | 12/2006 |
| KR | 100446763 | 9/2004 |
| KR | 1020100129160 | 12/2010 |
| KR | 101450238 | 10/2014 |

OTHER PUBLICATIONS

Office Action in Korean Appln. No. 10-2017-0108223, dated Oct. 15, 2021, 20 pages (with English translation).
Australian Office Action in Australian Application No. 2017316101, dated Jul. 26, 2019, 5 pages.
Extended European Search Report in European Application No. 17844000.4, dated Feb. 20, 2020, 8 pages.
PCT International Search Report and Written Opinion in International Appln. No. PCT/KR2017/009341, dated Nov. 23, 2017, 19 pages (with English translation).

(a)

(b)

(a)

(b)

(a)

(b)

(c)

(b)

(a)

(b)

CLOTHES TREATMENT APPARATUS AND CONTROL METHOD THEREFOR

CROSS-REFERENCE TO RELATED APPLICATIONS

This application is a continuation of U.S. application Ser. No. 16/328,100, filed on Feb. 25, 2019, now allowed, which is a National Stage application under 35 U.S.C. § 371 of International Application No. PCT/KR2017/009341, filed on Aug. 25, 2017, which claims the benefit of Korean Application No. 10-2017-0108223, filed on Aug. 25, 2017, Korean Application No. 10-2017-0101340, filed on Aug. 9, 2017, Korean Application No. 10-2017-0101338, filed on Aug. 9, 2017, Korean Application No. 10-2017-0101334, filed on Aug. 9, 2017, Korean Application No. 10-2017-0101332, filed on Aug. 9, 2017, and Korean Application No. 10-2016-0108328, filed on Aug. 25, 2016. The disclosures of the prior applications are incorporated by reference in their entirety.

TECHNICAL FIELD

The present disclosure relates to a laundry treatment apparatus, and more specifically to a laundry treatment apparatus in which a drum for receiving a laundry is directly heated.

BACKGROUND

Generally, laundry treatment apparatuses are apparatuses for treating laundry, specifically, for washing, drying or refreshing laundry.

There are various kinds of laundry treatment apparatuses, for example, a washing machine mainly adapted to wash laundry, a drying machine mainly adapted to dry laundry, and a refresher mainly adapted to refresh laundry.

There is also a laundry treatment apparatus that can perform at least two laundry-treating processes, among washing, drying and refreshing, in a single body. For example, a combined washing and drying machine is a kind of laundry treatment apparatus that can perform all of washing, drying and refreshing in a single body.

Further, there has recently been developed a laundry treatment apparatus that includes two laundry treating bodies, both of which perform washing at the same time, or one of which performs washing and the other of which performs drying simultaneously therewith.

A laundry treatment apparatus may be provided with a heating device for heating wash water or air. The reason for heating wash water to increase the temperature thereof is to promote activation of detergent and breakdown of dirt in order to improve washing performance. The reason for heating air is to evaporate moisture by applying heat to wet laundry in order to dry laundry.

In general, wash water is heated by an electric heater, which is mounted to a tub in which wash water is contained. The electric heater is immersed in wash water, which contains foreign substances or detergent. Thus, foreign substances such as scale may accumulate on the electric heater, which may lead to deterioration in the performance of the electric heater.

Further, in order to heat air, there must be additionally provided a fan for moving air by force and a duct for guiding the movement of air. An electric heater or a gas heater may be used to heat air. However, such an air-heating method has generally poor efficiency.

Recently, there has been developed a drying machine that heats air using a heat pump. A heat pump is a system that uses a cooling cycle of an air-conditioning system in the opposite way, and thus requires the same constituent components as the air-conditioning system, i.e. an evaporator, a condenser, an expansion valve, and a compressor. Different from an air-conditioning system in which a condenser is used as an indoor unit to decrease the indoor temperature, a drying machine having a heat pump dries laundry using air heated by an evaporator. However, a drying machine having such a heat pump has a complicated structure, and the manufacturing costs thereof are high.

An electric heater, a gas heater and a heat pump, which are used as heating devices in these various laundry treatment apparatuses, have their own advantages and disadvantages. Laundry treatment apparatuses having new heating devices using induction heating, which can enhance the advantages of the above conventional heating devices and compensate for the disadvantages thereof, are disclosed in Japanese Registered Patent No. 2001070689 and Korean Registered Patent No. 10-922986.

However, these related art documents disclose only a basic concept of induction heating for a washing machine, and do not disclose concrete constituent components of an induction heating module, connection and operational relationships with the constituent components of a laundry treatment apparatus, or a concrete method or configuration for improving efficiency and securing safety.

Various and concrete technologies for improving efficiency and securing safety need to be applied to a laundry treatment apparatus utilizing an induction heating principle.

SUMMARY

The present disclosure aims to provide a laundry treatment apparatus that improves efficiency and safety while using inductively-heating.

According to one embodiment of the present disclosure, the present disclosure is intended to provide a laundry treatment apparatus in which even when laundry is not completely immersed in washing-water, the laundry can be steeped with the water or sterilized.

According to one embodiment of the present disclosure, the present disclosure is intended to provide a laundry treatment apparatus in which heating a drum without heating the washing-water directly may raise the temperature of the laundry to improve the laundry washing efficiency and to dry the laundry.

According to one embodiment of the present disclosure, the present disclosure is intended to provide a laundry treatment apparatus in which even when laundry gets tangled or is massive, the laundry can be dried entirely and evenly and a drying efficiency can be improved.

According to one embodiment of the present disclosure, the present disclosure is intended to provide a laundry treatment apparatus in which an electrical current leakage or short circuit to a coil is suppressed even when the drum is heated by the coil, and the coil is prevented from being deformed.

According to one embodiment of the present disclosure, the present disclosure is intended to provide a laundry treatment apparatus in which the coil can be structurally cooled even when the coil is heated due to its own resistance.

According to one embodiment of the present disclosure, the present disclosure is intended to provide a laundry treatment apparatus in which ensuring stability in fastening of an induction module may prevent a departure of components constituting the induction module even in a vibration of a tub.

According to one embodiment of the present disclosure, the present disclosure is intended to provide a laundry treatment apparatus which improves a drying efficiency by uniformly heating front and rear faces of the drum.

According to one embodiment of the present disclosure, the present disclosure is intended to provide a laundry treatment apparatus in which a heating efficiency may be improved by reducing a spacing between the coil of the induction module and the drum, and the induction module may be mounted on an outer surface of the tub more stably.

According to one embodiment of the present disclosure, the present disclosure is intended to provide a laundry treatment apparatus which may effectively prevent overheat which may otherwise occur at a lifter provided on the drum, thereby improving a safety. According to one embodiment of the present disclosure, the present disclosure is intended to provide a laundry treatment apparatus and a method for controlling the laundry treatment apparatus in which a basic function of the lifter is faithfully maintained and a stability is improved.

According to one embodiment of the present disclosure, the present disclosure is intended to provide a laundry treatment apparatus and a method for controlling the laundry treatment apparatus in which overheating of a part of the drum on where the lifter is mounted is suppressed without changing shapes of the drum and the lifter.

According to one embodiment of the present disclosure, the present disclosure is intended to provide a laundry treatment apparatus and a method for controlling the laundry treatment apparatus in which detecting a position of the lifter, and reducing an amount of heat generated at a portion at an circumferential surface of the drum corresponding to the lifter position may lead to reducing an energy loss and preventing the lifter from being damaged.

According to one embodiment of the present disclosure, the present disclosure is intended to provide a laundry treatment apparatus and a method for controlling the laundry treatment apparatus in which overheating of the drum is suppressed in heating the drum when the heat is sufficiently transferable to the drum via the washing-water or laundry therein.

According to one embodiment of the present disclosure, the present disclosure is intended to provide a laundry treatment apparatus and a method for controlling the laundry treatment apparatus in which reliably detecting a temperature of a rotating drum may lead to preventing the drum from inadvertently overheating.

In order to achieve the above purposes, according to one aspect of the present disclosure, there is provided a laundry treatment apparatus comprising: a tub; a drum rotatably disposed inside the tub for receiving laundry therein, wherein the drum is made of a metal material; and an induction module disposed on the tub to be spaced from a circumferential surface of the drum for generating an electromagnetic field to heat the circumferential surface of the drum, wherein the induction module includes: a coil formed of windings of wires, wherein the coil generates a magnetic field when an electric current is applied thereto; and a base housing mounted on an outer circumferential face of the tub, wherein the base housing has coil slots defined therein for receiving the wires therein and thus defining a shape of the coil, wherein each coil slot defines a predetermined spacing between corresponding adjacent wires.

The coil may be stably formed in the coil slot defined in the base housing. The shape distortion or movement of the coil may be prevented by the coil slot.

The induction module may include a module cover coupled with the base housing for covering the coil. Therefore, the coil may be stably protected from the outside.

A permanent magnet may be disposed between the module cover and the coil to direct the magnetic field generated from the coil toward the drum.

The permanent magnet may include permanent magnets arranged in a longitudinal direction of the coil. Each of the permanent magnets may be oriented to be perpendicular to a length direction of the coil.

The permanent-magnet-mounted portions may be formed on a bottom of the module cover, wherein each permanent magnet is fixedly received in each permanent-magnet-mounted portion.

The module cover may include press-contacting ribs that protrude downwards from a bottom face of the module cover to press-contact the coil.

A module-mounted portion may be formed on an outer circumferential face of the tub, wherein the induction module is mounted on the module-mounted portion, wherein the base housing is coupled to the module-mounted portion in a conformed manner. In this way, the induction module can be more stably coupled to the tub outer circumferential face.

The module-mounted portion may include a flat portion positioned more radially inwardly than an outer circumferential face of the tub.

The flat portion may define an inner portion of the module-mounted portion.

The flat portion may define an outer portion of the module-mounted portion.

This flat portion can effectively reduce the spacing between the coil and the circumference of the drum.

The tub may include a front tub, a rear tub, and a tub connector connecting the front tub and the rear tub, wherein the tub connector extends radially outwardly, wherein the base housing is in close contact with a top of the tub connector.

The tub connector may include an extended tub connector that further protrudes radially outwardly from the tub, wherein an extended tub connector connects the front tub and the rear tub via a screw or bolt, wherein the extended tub connector is absent in a region of the tub corresponding to the module-mounted portion.

The reinforcing ribs may protrude downwards from a bottom of the base housing and maintain a spacing between the base housing and the outer circumferential face of the tub.

The base housing may have a through-hole defined therein through which air is discharged radially inwardly.

Each coil slot may define a coil receiving portion defined between adjacent fixing ribs.

A spacing between the adjacent fixing ribs may be set to be smaller than a diameter of each wire, wherein each wire is press-fitted into each coil slot.

A protrusion height of the fixing rib may be set to be larger than a diameter of each wire, wherein after each wire is inserted into each coil slot, a top of each fixing rib is melted to cover a top of each wire.

The coil may form a single layer.

The coil may have a track shape with a long axis extending in a front-rear direction of the drum.

The coil may have two front-rear directional straight portions and two left-right directional straight portions, and has four curved portions between the two front-rear directional straight portions and two left-right directional straight portions, wherein a radius of curvature of each of the curved portions in an radially innermost wire is equal to a radius of curvature of each of the curved portions in an radially outermost wire.

In order to achieve the above purposes, according to one aspect of the present disclosure, there is provided a laundry treatment apparatus comprising: a tub; a drum rotatably disposed inside the tub for receiving laundry therein, wherein the drum is made of a metal material; and an induction module disposed on the tub to be spaced from a circumferential surface of the drum for generating an electromagnetic field to heat the circumferential surface of the drum, wherein the induction module includes: a coil formed of windings of wires, wherein the coil generates a magnetic field when an electric current is applied thereto; and a base housing mounted on an outer circumferential face of the tub, wherein the base housing receives the coil, wherein the coil has a straight portion and a curved portion, wherein a radius of curvature of an outer wire in a curved portion is equal to a radius of curvature of an inner wire in a curved portion.

In order to achieve the above purposes, according to one aspect of the present disclosure, there is provided a laundry treatment apparatus comprising: a tub; a drum rotatably disposed inside the tub for receiving laundry therein, wherein the drum is made of a metal material; and an induction module disposed on the tub to be spaced from a circumferential surface of the drum for generating an electromagnetic field to heat the circumferential surface of the drum, wherein the induction module includes: a coil formed of windings of wires, wherein the coil generates a magnetic field when an electric current is applied thereto; a base housing mounted on an outer circumferential face of the tub, wherein the base housing receives the coil, and permanent magnets disposed on the coil to direct the magnetic field generated from the coil toward the drum, wherein each of the permanent magnets is oriented to be perpendicular to a length direction of the coil.

In order to achieve the above purposes, according to one aspect of the present disclosure, there is provided a laundry treatment apparatus including a cabinet defining an outer shape; a cylindrical tub installed inside the cabinet and having a receiving space defined therein; a metal drum which is rotatably installed in the tub and accommodates laundry; and an induction module for inductively heating the drum via forming a magnetic field, wherein the induction module is mounted on a module-mounted portion formed on an outer circumferential face of the tub, wherein the module-mounted portion is positioned more radially inwardly than an outer circumferential face of the tub.

The module-mounted portion may be formed by flattening a portion of the curved outer circumferential face of the tub. That is, a module-mounted portion may be formed by converting at least a portion of the curved face of the tub to a flat face. Moreover, a distance between the flat portion and the center of the cross section of the tub is preferably smaller than a distance between the curved face of the tub and the center of the tub.

In order to achieve the above purposes, according to one aspect of the present disclosure, there is provided a laundry treatment apparatus comprising: a tub; a drum rotatably disposed inside the tub for receiving laundry therein, wherein the drum is made of a metal material; and an induction module disposed on the tub to be spaced from a circumferential surface of the drum for generating an electromagnetic field to heat the circumferential surface of the drum, wherein the induction module includes: a coil formed of windings of wires, wherein the coil generates a magnetic field when an electric current is applied thereto; a base housing mounted on an outer circumferential face of the tub, wherein the base housing has coil slots defined therein for receiving the wires, wherein a width of each coil slot may be set to be smaller than a diameter of each wire, wherein each wire is press-fitted into each coil slot; and a module cover coupled with the base housing for covering the coil.

The coil fixation and movement prevention by the press-fitting the wire and the covering of the top of the wire with the module cover may allow the prevention of the front-rear directional and left-right directional movements of the wire by the coil slot and the prevention of vertical movement of the wire by the module cover at the same time.

In order to achieve the above purposes, according to one aspect of the present disclosure, there is provided a laundry treatment apparatus comprising: a drum made of a metal material and adapted to receive laundry therein; an induction module spaced apart from the circumferential surface of the drum, wherein the induction module heats the circumferential surface of the drum through a magnetic field generated by applying a current to a coil of the induction module; a lifter installed inside the drum to move the laundry when the lifter rotates inside the drum; and a module controller for controlling an output of the induction module to control an amount of a heat generated from the circumference face of the drum, wherein the module controller controls an amount of a heat differently based on a change in a position of the lifter as the drum rotates.

The module controller may preferably control the output of the induction module so that the amount of heat generated by the drum when the lifter is not shortest to the induction module is greater than the amount of heat generated by the drum when the lifter is shortest to the induction module.

Specifically, the module controller reduces the output of the induction module to zero or a value below a normal state output when the lifter is shortest to the induction module, and control the output of the induction module to the normal state output when the lifter is not shortest to the induction module.

The lifter may be mounted on the inner circumference of the drum. Specifically, the lifter may be made of a plastic material.

For sensing the position of the lifter, the apparatus may include a magnet provided on the drum such that a position thereof relative to the lifter is fixed; and a sensor disposed in a fixed position outside the drum, wherein the sensor senses a change of the position of the magnet as the drum rotates and senses the position of the lifter.

When a rotation angle of the cylindrical drum is changed from 0 to 360 degrees, such a configuration may estimate the position of the lifter in a predetermined angle relationship with the magnet position by sensing the position of the magnet.

The sensor may include a reed switch or hall sensor that outputs different signals or flags depending on whether the magnet is detected.

The magnet may be disposed in the drum, and the sensor may be provided in the tub. The sensor may be mounted at the tub portion opposite the tub portion where the induction module is mounted, to minimize the effect of the magnetic field generated by the induction module.

The apparatus may include a main controller for controlling driving of a motor for rotating the drum. The main controller may be configured to communicate with the module controller.

The plurality of the lifters may be arranged along the circumferential direction of the drum. The magnet may include the same number magnets as the number of the lifters. The sensor senses a position of each magnet, and senses a position of each lifter, and delivers the sensed result to the module controller.

In an example, three magnets may be provided when three lifters are provided. The lifters and the magnets may be arranged in the same angular spacing. Therefore, when one magnet is detected, the position of the nearby lifter may be estimated. This may allow estimating each lifter position relatively accurately even when the drum RPM varies.

The magnet may be singular regardless of the number of the lifters. The sensor senses the position of the magnet, senses the position of a specific lifter, and transmits the sensed output to the module controller. The main controller may be configured to estimate the positions of the remaining lifters based on the output from the sensor and the rotation angle of the motor.

In this case, this approach may be economical to reduce the number of magnets. Estimating the position of one of the lifters via the magnet may lead to estimating the position of the remaining lifters relatively accurately by considering the current RPM and the angular spacing between the adjacent lifters. However, it may be difficult to estimate the relative positions of the lifters under the variable RPM of the drum.

On the circumference of the drum, a repeated embossing pattern may be formed along the circumference. The formation of the embossing pattern may be excluded on a portion of the circumference of the drum on which the lifter is mounted.

The embossing pattern may be formed by protrusions or depressions from or into the circumference face portion of the drum. Therefore, an area facing the induction module in a region where the embossing pattern is formed is smaller than an area facing the induction module in a region where the embossing pattern is not formed, and a spacing between the former region and the induction module may be larger than a spacing between the latter region and the induction module. Therefore, the current flowing in the induction module or the output (power) of the induction module may become relatively large at the time when the embossing pattern faces the induction module at a shortest distance.

On the other hand, an area facing the induction module in a region where the embossing pattern is not formed, that is, a region on which the lifter is mounted may be relatively larger. The spacing between the lifter region and the induction module may be smaller. Thus, the value of the current flowing in the induction module or the output of the induction module may be relatively smaller when the lifter region faces the induction module at a shortest distance.

The embossing pattern and the lifter mounted portion may be arranged alternately and repeatedly and regularly along the circumference of the drum. Therefore, the controller may estimate the position of the lifter based on the change in the current or output of the induction module according to the rotation angle of the drum. That is, the position of the lifter can be estimated relatively accurately even when a separate sensor for sensing the rotation angle of the drum is not provided.

In other words, the module controller may be configured to estimate the position of the lifter based on the change of the power or current of the induction module due to the presence or absence of a shortest-distance facing between the embossing pattern and the induction module. In other words, the module controller itself, which controls the output of the induction module, can estimate the position of the lifter by receiving the change of the output of the induction module as feed-back information.

To achieve the above purpose, according to one aspect of the present disclosure, there is provided a method for controlling a laundry treatment apparatus, wherein the apparatus may include a drum made of a metal material and adapted to receive laundry therein; an induction module spaced apart from the circumferential surface of the drum, wherein an induction module heats the circumferential surface of the drum using a magnetic field generated by applying a current to a coil of the induction module; a lifter installed inside the drum to move laundry when the lifter rotates inside the drum; and a module controller that controls the output of the induction module to control the amount of heat generated from the circumference of the drum, wherein the method may include operating the induction module; controlling, by the module controller, an output of the induction module to a normal state output; sensing a position of the lifter; and when the position of the lifter is detected, reducing, by the module controller, the output of the induction module.

The method may include determining a condition about whether to perform the reduction phase of the output of the induction module, regardless of whether the lifter position is detected or not.

In the condition determination phase, a factor for the condition may include a rotational speed of the drum, or a current cycle type.

When the rotational speed of the drum is higher than or equal to a spin speed, which is higher than a tumbling speed, the laundry will rotate while contacting closely the inner circumference of the drum. The tumbling speed is a speed at which the laundry may fall down after the laundry has been lifted up by the lifter as the drum is rotated. When the rotational speed of the drum is higher than the tumbling speed to reach the spin speed, the centrifugal force becomes larger than the gravitational acceleration, so that laundry does not fall down but closely adheres to the inner surface of the drum and rotates integrally with the drum.

When the laundry is brought into close contact with the inner circumference of the drum, the heat transfer between the drum and laundry may be carried out continuously. Therefore, in this case, it is not necessary to variably control the output of the induction module.

The condition determination phase may be configured such that, when the rotational speed of the drum is lower than or equal to a predetermined speed, the reduction phase of the output of the induction module may performed. When the rotation speed of the drum exceeds the predetermined speed, the decreasing phase of the output of the induction module may not be performed. The predetermined speed may be 200 RPM in one example.

The laundry treatment apparatus includes a tub that houses the drum and stores washing-water therein, wherein the output reducing phase is not performed when in the condition determining phase, a washing cycle when the laundry is stored in the tub is determined.

For the washing cycle, a portion of the circumferential surface of the drum is immersed in the washing-water inside the tub. Therefore, when the drum rotates, the heat generated from the drum may be transferred to the washing-water very effectively. Therefore, for the washing cycle, the output reduction of the induction module may not be necessary.

When the position of the lifter is sensed at a position facing the induction module at the shortest distance during the sensing phase, the output reduction phase is preferably performed.

It is preferable that in the output reduction phase, the output is adjusted to be lower than the normal state output or the output is turned off.

The method may further include sensing the current value flowing in the induction module or the power or output of the induction module. The position sensing of the lifter may include estimating the position of the lifter based on a change in the current value or power as sensed. In this case, a separate sensor is not required, which is very economical.

The apparatus may include a magnet provided on the drum such that a position thereof relative to the lifter is fixed; and a sensor disposed in a fixed position outside the drum, wherein the sensor senses a change of the position of the magnet as the drum rotates and senses the position of the lifter. The position sensing of the lifter may include sensing the position of the lifter based on the output value from the sensor.

The plurality of the lifters may be arranged along the circumferential direction of the drum. The laundry treatment apparatus includes a single magnet such that a position thereof relative to the lifter is fixed; and a sensor disposed in a fixed position outside the drum, wherein the sensor senses a change of the position of the magnet as the drum rotates and senses the position of a specific lifter. In this connection, the position sensing of the lifter may include sensing the position of the specific lifter according to the output value of the sensor, and estimating positions of the remaining lifters based on the rotation angle of the drum or the rotation angle of the motor driving the drum.

When the position of the lifter as sensed is shortest to the induction module, the output reduction phase may be performed.

In the above-described embodiments, the output of the induction module may be controlled to be variable after the induction module is operated. That is, the output may be variable after the induction module operates in the normal state output mode.

Due to the positional relationship between the induction module and the drum, and the shape of the induction module and drum, the induction module heats only a specific portion of the drum. Thus, when the induction module heats the stopped drum, only the specific portion of the drum may be heated to very high temperatures. Therefore, the drum needs to be rotated to prevent overheating of the drum. That is, it is preferable to rotate the drum to vary a portion of the drum being heated.

Therefore, it is desirable that the drum be rotated before the induction module operates. In a washing machine or a dryer, the rotational speed of the drum is generally set to a rotational speed allowing the tumbling driving. The drum accelerates to a speed allowing the tumbling driving immediately after the drum stops. Moreover, the tumbling drive may be achieved by forward and reverse rotations. That is, after the tumbling driving of the drum is continued in the clockwise direction, the drum may be stopped and then may be tumbled driven in the counterclockwise direction again.

When the rotational speed of the drum is very low, the certain part of the drum may also overheat. For example, when the tumbling driving speed is 40 RPM, it takes a certain time until the drum accelerates from the stopped state to 40 RPM. Therefore, a timing at which the drum starts the tumbling driving differs from a timing at which the drum performs the normal tumbling driving. That is, when the drum starts the tumbling driving, the drum gradually accelerates from the stopped state to reach the tumbling RPM and then may be driven at the tumbling RPM. The tumbling drive of the drum may be performed in a predetermined direction, and then the drum may be stopped again and then the tumbling drive of the drum may be performed in an opposite direction.

In this connection, there is a need to achieve the drum overheating prevention and to increase the heating energy efficiency and the time efficiency.

In a very low RPM region of the drum, avoiding the heating is preferable for avoiding the drum overheating. Conversely, heating the drum only after the RPM of the drum reaches the normal RPM will cause a loss of time.

Therefore, it is preferable that the induction module is operated after the drum starts to rotate and before the drum RPM reaches the normal tumbling RPM. In one example, since the purpose of suppressing the drum overheating is more important, the induction module can be activated after the drum RPM reaches the tumbling RPM.

In an example, the induction module may be activated when the drum RPM is greater than 30 RPM. Moreover, when the drum RPM is lower than 30 RPM, the induction module may be disabled.

That is, it is desirable to enable the induction module to work only when the drum RPM is higher than a specific RPM, and to disable the induction module when the drum RPM is lower than the specific RPM.

Therefore, in the normal tumbling drive period, the induction module may be driven after the drum rotation starts and may be stopped before the drum rotation is stopped. That is, the induction module may be turned on/off based on a preset RPM lower than a normal tumbling RPM.

In one example, the variable control of the induction module may be said to be performed when the induction module is in an on state.

To achieve the above purpose, according to one aspect of the present disclosure, there is provided a laundry treatment apparatus comprising: a drum made of a metal material and adapted to receive laundry therein; an induction module spaced apart from the circumferential surface of the drum, wherein the induction module heats the circumferential surface of the drum using a magnetic field generated by applying a current to a coil of the induction module; a lifter installed inside the drum to move the laundry when the lifter rotates inside the drum, wherein the lifter is recessed in a direction configured such that a spacing of the induction module and the lifter is increased.

It is possible to structurally prevent the overheating in the lifter portion by defining a face of the lifter facing the induction module more radially inwardly than the circumferential face of the drum. In this case, the variable control of the output of the induction module depending on the position of the lifter may be unnecessary. Moreover, the face of the lifter facing the induction module at the shortest distance may be heated, thereby to relatively decrease the heating time.

The prevention of the overheating in the lifter portion via the structural modification of the lifter and drum may be applied together with output variable control of the induction module. In this case, the prevention of overheating in the lifter portion may be achieved more effectively.

To achieve the above purpose, according to one aspect of the present disclosure, there is provided a laundry treatment apparatus, wherein the apparatus may include a drum made of a metal material and adapted to receive laundry therein; an induction module spaced apart from the circumferential surface of the drum, wherein an induction module heats the circumferential surface of the drum using a magnetic field generated by applying a current to a coil of the induction module; a lifter installed inside the drum to move laundry when the lifter rotates inside the drum; and a module controller that controls the output of the induction module to control the amount of heat generated from the circumference of the drum, wherein the method may include operating the induction module; stopping the operating of the induction module; and determining whether the induction module is to be activated or deactivated according to a rotational speed of the drum.

The drum may accelerate from a stationary state to a rotational speed for the normal tumbling drive. After the drum starts to rotate and accelerates, the rotation of the drum may continue at the tumbling drive speed. Accordingly, after the drum is rotated, whether the driving and stopping of the induction module may be performed may be determined based on a predetermined drum rotational speed lower than the normal tumbling rotational speed.

Once the induction module is started, the module controller may perform a phase of controlling an output of the induction module to be a normal state output. Moreover, a phase of detecting the position of the lifter may be performed. When the position of the lifter is sensed, the method may include reducing the output of the induction module by the module controller.

Thus, when the tumbling drive operation continues, the induction module may repeatedly and alternately perform the normal state output section and the reduced output section.

Moreover, the induction module is turned off before the tumbling drive operation is terminated. This is because the drum is driven at a speed lower than the preset drum rotation speed and then stopped.

Again, when the drum rotates in the opposite direction, the method include sensing the rotational speed of the drum. When the induction module starts the driving thereof, the normal state output control, the lifter position detection and the output reduction control may be repeatedly performed until the induction module is stopped.

Thus, it is possible to prevent overheating of the drum, to prevent overheating of the specific portion (the lifter portion) of the drum, and to increase the time efficiency.

To achieve the above purpose, according to one aspect of the present disclosure, there is provided a method for controlling a laundry treatment apparatus, wherein the apparatus may include a tub; a drum rotatably disposed inside the tub for receiving laundry therein, wherein the drum is made of a metal material; and an induction module disposed on the tub to be spaced from a circumferential surface of the drum for generating an electromagnetic field to heat the circumferential surface of the drum; a lifter installed inside the drum to move laundry when the lifter rotates inside the drum; a temperature sensor adapted to sense the temperature of the drum; and a module controller configured for controlling an output of the induction module to control the amount of heat generated on the circumference of the drum, wherein the module controller is configured to control the amount of the heat based on the temperature sensed by the temperature sensor.

The temperature sensor may be provided on the inner circumferential surface of the tub to detect an air temperature between the inner circumferential surface of the tub and the outer circumferential face of the drum. This temperature sensor may be not in direct contact with the outer circumferential face of the tub. The temperature of the outer circumferential face of the drum may be estimated indirectly by the sensor.

The induction module may be mounted in either the first or second quadrant of the cross-section of the tub or in the first and second quadrants thereof.

The second quadrant of the tub may have a vent for air communication inside the tub and outside the tub.

Preferably, the temperature sensor may be spaced at a predetermined angular spacing in a clockwise direction from the induction module. Therefore, the temperature sensor may be positioned to deviate from the influence of the magnetic field of the induction module.

In the fourth quadrant of the tub, a duct hole may be formed to discharge or circulate the air inside the tub to the outside of the tub.

In the third quadrant of the tub, a condensation port may be formed to supply cooling water into the tub.

Therefore, the temperature sensor may be disposed between the tub and the drum to exclude the external influence as much as possible to detect the temperature of the outer circumferential face of the drum more precisely.

The module controller preferably turns off the driving of the induction module when the temperature of the drum is greater than a predetermined temperature based on the temperature sensed by the temperature sensor.

The module controller may preferably control the induction module to be driven when the drum starts rotating and is operating at a greater speed than a predetermined RPM.

The predetermined RPM may be preferably lower than the tumbling RPM.

The module controller may preferably adjust the generated heat amount differently based on the positional change of the lifter as the drum rotates.

The module controller may preferably control the output of the induction module so that the amount of heat generated by the drum when the lifter is not shortest to the induction module is greater than the amount of heat generated by the drum when the lifter is shortest to the induction module.

For sensing the position of the lifter, the apparatus may include a magnet provided on the drum such that a position thereof relative to the lifter is fixed; and a sensor disposed in a fixed position outside the drum, wherein the sensor senses a change of the position of the magnet as the drum rotates and senses the position of the lifter.

To achieve the above purpose, according to one aspect of the present disclosure, there is provided a method for controlling a laundry treatment apparatus, wherein the apparatus may include a tub; a drum rotatably disposed inside the tub for receiving laundry therein, wherein the drum is made of a metal material; and an induction module disposed on the tub to be spaced from a circumferential surface of the drum for generating an electromagnetic field to heat the circumferential surface of the drum; a lifter installed inside the drum to move laundry when the lifter rotates inside the drum; a temperature sensor adapted to sense the temperature of the drum; and a module controller configured for controlling an output of the induction module to control the amount of heat generated on the circumference of the drum, wherein the module controller is configured to control the amount of the heat based on the temperature sensed by the temperature sensor, wherein the method may include operating the induction module; controlling an output of the induction module to the normal state output by the module controller; sensing the temperature of the drum by the temperature sensor; and reducing the output of the induction module by the module controller when the temperature of the drum is greater than a predetermined temperature.

It is preferable that in the output reduction phase, the output may be adjusted to be lower than the normal state output or the output may be turned off.

The method may include detecting the RPM of the drum. When the RPM of the drum is greater than the predetermined RPM, a phase of controlling the output of the induction coil to be the normal state output may be performed. When the RPM of the drum is lower than the predetermined RPM, a phase of reducing the output may be performed.

The predetermined RPM may be preferably greater than 0 RPM and lower than the tumbling RPM.

The method may include sensing the position of the lifter. The laundry treatment apparatus may include a sensor provided on the tub to sense the position of the lifter or a main controller for estimating the position of the lifter based on a change in the power or output of the induction module.

When the position of the lifter as sensed is shortest to the induction module, a phase of reducing the output may be performed.

To achieve the above purpose, according to one aspect of the present disclosure, there is provided a method for controlling a laundry treatment apparatus, wherein the apparatus may include a tub; a drum rotatably disposed inside the tub for receiving laundry therein, wherein the drum is made of a metal material; and an induction module disposed on the tub to be spaced from a circumferential surface of the drum for generating an electromagnetic field to heat the circumferential surface of the drum; a lifter installed inside the drum to move laundry when the lifter rotates inside the drum; a temperature sensor adapted to sense the temperature of the drum; and a module controller configured for controlling an output of the induction module to control the amount of heat generated on the circumference of the drum, wherein the method may include operating the induction module; stopping the induction module; determining whether the induction module is to be activated or deactivated according to the rotational speed of the drum; and determining whether the induction module is to be activated or deactivated based on the temperature of the drum.

The features in the above-described embodiments may be combined with each other to achieve other embodiments as long as the features as combined are not mutually exclusive.

The present disclosure may provide a laundry treatment apparatus that improves efficiency and safety while using inductively-heating.

According to one embodiment of the present disclosure, the present disclosure may provide a laundry treatment apparatus in which even when laundry is not completely immersed in washing-water, the laundry can be steeped with the water or sterilized.

According to one embodiment of the present disclosure, the present disclosure may provide a laundry treatment apparatus in which heating a drum without heating the washing-water directly may raise the temperature of the laundry to improve the laundry washing efficiency and to dry the laundry.

According to one embodiment of the present disclosure, the present disclosure may provide a laundry treatment apparatus in which even when laundry gets tangled or is massive, the laundry can be dried entirely and evenly and a drying efficiency can be improved.

According to one embodiment of the present disclosure, the present disclosure may provide a laundry treatment apparatus in which an electrical current leakage or short circuit to a coil is suppressed even when the drum is heated by the coil, and the coil is prevented from being deformed.

According to one embodiment of the present disclosure, the present disclosure may provide a laundry treatment apparatus in which the coil can be structurally cooled even when the coil is heated due to its own resistance.

According to one embodiment of the present disclosure, the present disclosure may provide a laundry treatment apparatus in which ensuring stability in fastening of an induction module may prevent a departure of components constituting the induction module even in a vibration of a tub.

According to one embodiment of the present disclosure, the present disclosure may provide a laundry treatment apparatus which improves a drying efficiency by uniformly heating front and rear faces of the drum.

According to one embodiment of the present disclosure, the present disclosure may provide a laundry treatment apparatus in which a heating efficiency may be improved by reducing a spacing between the coil of the induction module and the drum, and the induction module may be mounted on an outer surface of the tub more stably.

According to one embodiment of the present disclosure, the present disclosure may provide a laundry treatment apparatus which may effectively prevent overheat which may otherwise occur at a lifter provided on the drum, thereby improving a safety. According to one embodiment of the present disclosure, the present disclosure may provide a laundry treatment apparatus and a method for controlling the laundry treatment apparatus in which a basic function of the lifter is faithfully maintained and a stability is improved.

According to one embodiment of the present disclosure, the present disclosure may provide a laundry treatment apparatus and a method for controlling the laundry treatment apparatus in which overheating of a part of the drum on where the lifter is mounted is suppressed without changing shapes of the drum and the lifter.

According to one embodiment of the present disclosure, the present disclosure may provide a laundry treatment apparatus and a method for controlling the laundry treatment apparatus in which detecting a position of the lifter, and reducing an amount of heat generated at a portion at an circumferential surface of the drum corresponding to the lifter position may lead to reducing an energy loss and preventing the lifter from being damaged.

According to one embodiment of the present disclosure, the present disclosure may provide a laundry treatment apparatus and a method for controlling the laundry treatment apparatus in which detecting an output control condition of the induction module may allow preventing overheating of the lifter and, at the same time, an output of the induction module may be used irrespective of a drum rotation angle, thus making it possible to achieve a safety, an efficiency and to effectively utilize the output from the induction module.

According to one embodiment of the present disclosure, the present disclosure may provide a laundry treatment apparatus in which the drum and the lifter are heated so that a space where the laundry is received can be heated evenly. Particularly, according to one embodiment of the present disclosure, the present disclosure may provide a laundry treatment apparatus and a method for controlling the laundry treatment apparatus in which the overheating of the lifter may be suppressed by allowing a heating temperature of a portion of the drum on which the lifter is mounted to be lower than that of a portion of the drum where the lifter is not mounted, and the heat transfer through the lifter is allowed to improve the heating efficiency.

According to one embodiment of the present disclosure, the present disclosure may provide a laundry treatment apparatus and a method for controlling the laundry treatment apparatus in which stability and efficiency are improved while minimizing a change in a shape and a structure of each of a conventional drum and a conventional lifter.

DETAILED DESCRIPTION

Reference will now be made in detail to the preferred embodiments of the present disclosure, examples of which are illustrated in the accompanying drawings. In one example, elements or control methods of apparatuses which will be described below are only intended to describe the embodiments of the present disclosure and are not intended to restrict the scope of the present disclosure. Wherever possible, the same reference numbers will be used throughout the drawings to refer to the same or like parts.

Figure 1A:
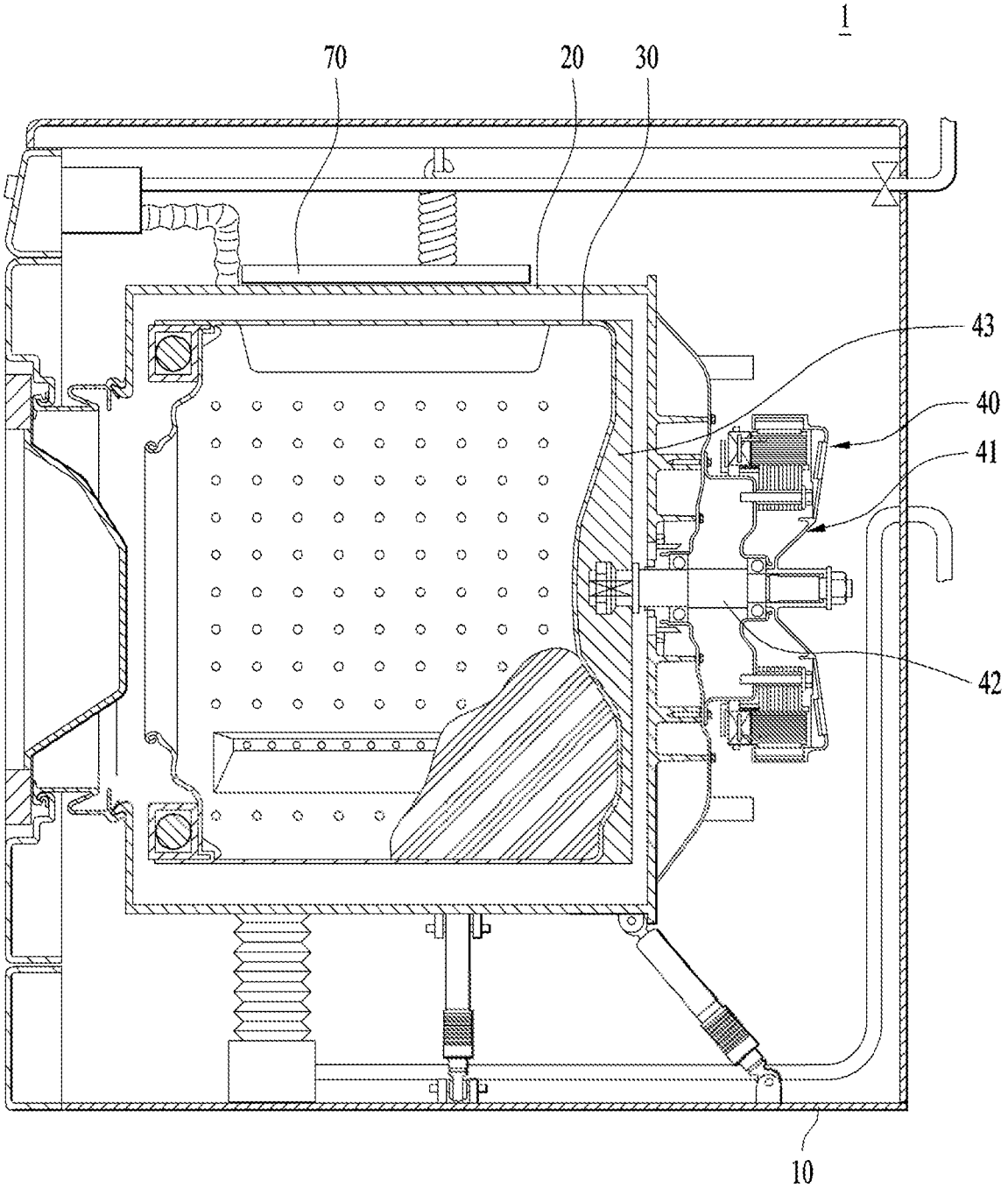
FIG. 1A is a cross-sectional view of a laundry treatment apparatus according to one embodiment.

As shown in FIG. 1A, a laundry treatment apparatus according to an embodiment of the present disclosure may include a cabinet 10 forming the external appearance of the laundry treatment apparatus, a tub 20, a drum 30, and an induction module 70 for heating the drum 30.

The tub 20 may be provided in the cabinet 10 to accommodate the drum therein. The tub may be provided in the front side thereof with an opening. The drum 30 is rotatably provided in the tub to contain laundry therein. Similarly, the drum may be provided in the front side thereof with an opening. Laundry can be introduced into the drum through the openings in the tub and the drum.

The induction module 70 may be configured to generate an electromagnetic field to heat the drum. The induction module 70 may be provided on the outer surface of the tub 20. For example, the induction module 70 may be provided on the outer circumferential of the tub 20. The tub 20 provides a certain accommodation space and has an opening formed in the front side thereof. The drum 30 is rotatably installed in the accommodation space in the tub 20 in order to contain laundry therein, and is formed of a conductive material. The induction module is disposed on the outer circumferential surface of the tub 20 to heat the drum 30 using an electromagnetic field.

The tub 20 and the drum 30 may be formed in a cylindrical shape. Accordingly, the inner and outer circumferential surfaces of the tub 20 and the drum 30 may be formed in a substantially cylindrical shape. FIG. 1 shows a laundry treatment apparatus in which the drum 30 is rotated about a rotation axis that is parallel to the ground.

The laundry treatment apparatus may further include a driving unit 40 configured to drive the drum 30 so that the drum 30 rotates inside the tub 20. The driving unit 40 includes a motor 41, and the motor includes a stator and a rotor. The rotor is connected to a rotary shaft 42, and the rotary shaft 42 is connected to the drum 30, whereby the drum 30 can rotate inside the tub 20. The driving unit 40 may include a spider 43. The spider 43 connects the drum 30 and the rotary shaft 42 to each other, and functions to uniformly and stably transmit the rotational force of the rotary shaft 42 to the drum 30.

The spider 43 is coupled to the drum 30 in a manner such that at least a portion thereof is inserted into the rear wall of the drum 30. To this end, the rear wall of the drum 30 is formed in a shape that is recessed toward the interior of the drum. The spider 43 may be inserted into the rear wall of the drum 30 further toward the rotational center portion of the drum 30. Thus, laundry cannot accumulate near the rear end of the drum 30 due to the spider 43.

The drum 30 may be provided therein with a lifter 50. The lifter 50 may be provided in a plural number so as to be arranged in the circumferential direction of the drum. The lifter 50 functions to agitate laundry. For example, as the drum rotates, the lifter 50 lifts laundry up. The laundry lifted up is separated from the lifter and falls due to gravity. The laundry may be washed by the impact caused by the falling thereof. In one example, the agitation of the laundry may also improve drying efficiency.

Laundry may be evenly distributed in the drum in the forward-and-backward direction. Thus, the lifter may be formed so as to extend from the rear end of the drum to the front end thereof.

The induction module is a device for heating the drum 30.

Figure 1B:
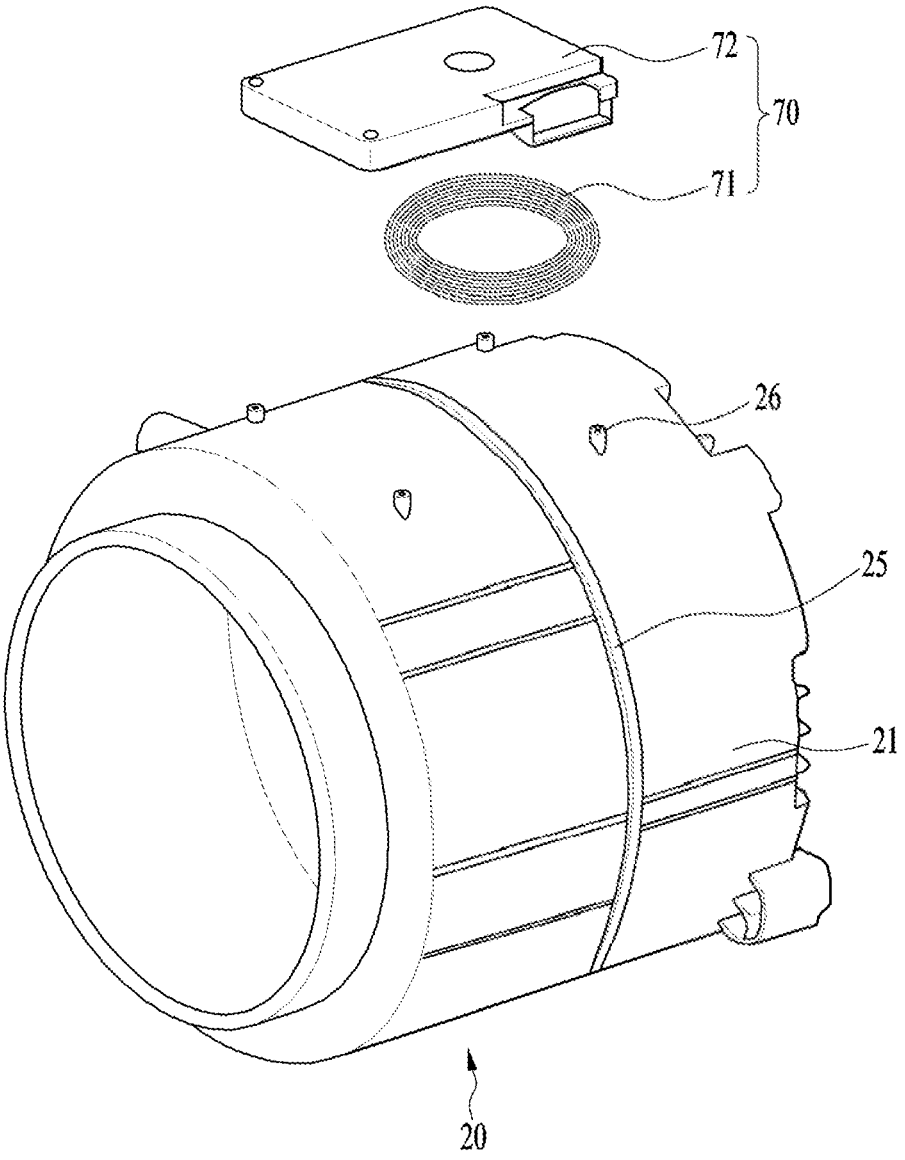
FIG. 1B is an exploded perspective view of a tub and an induction module in the laundry treatment apparatus shown in FIG. 1A.

As shown in FIG. 1B, the induction module 70 includes a coil 71 which receives electric current and generates a magnetic field so that eddy current is generated at the drum, and a module cover 72 for accommodating the coil 71 therein. The coil comprises a wire through which an electric current is configured to pass so as to generate a magnetic field.

The module cover 72 may include a ferromagnetic body. The ferromagnetic body may be a permanent magnet, and may include a ferrite magnet. The module cover 72 may be formed so as to cover the upper portion of the coil 71. Therefore, the ferromagnetic body made of, for example, ferrite, is located above the coil 71.

The coil 71 generates a magnetic field toward the drum 30 that is located thereunder. The magnetic field generated at the upper portion of the coil 71 is not used for heating the drum 30. Thus, it is desirable to focus the magnetic field in the downward direction of the coil 71, rather than in the upward direction of the coil 71. To this end, the ferromagnetic body, such as ferrite, is provided to focus the magnetic field in the downward direction of the coil 71, i.e. toward the drum. In one example, in the case in which the coil 71 is located below the tub 20, the ferromagnetic body, such as ferrite, is located below the coil 71. Therefore, in any case, the coil 71 is located between the ferromagnetic body and the drum 30.

In detail, the module cover 72 may be formed in the shape of a box that has one open surface. Specifically, the module cover 72 may have a box shape in which the surface thereof facing the drum is open and the opposite surface thereof is closed. Therefore, the coil 71 is located inside the module cover 72, or the module cover 72 covers the upper portion of the coil 71. The module cover 72 functions to protect the coil 71 from the outside. Further, as will be described later, the module cover 72 functions to cool the coil 71 by forming an air flow path between the module cover 72 and the coil 71.

In the laundry treatment apparatus, the coil 71 can raise the internal temperature in the drum 30 as well as the temperature of the body of the drum 30 by heating the same. The heating of the drum 30 can heat wash water contacting the drum 30 and laundry contacting the inner circumferential surface of the drum 30. In one example, laundry that does not contact the inner circumferential surface of the drum 30 can also be heated by increasing the temperature in the drum. Therefore, the temperature of the wash water, the temperature of the laundry and the atmospheric temperature in the drum can be increased to improve the washing effect, and the temperature of the laundry, the temperature of the drum and the atmospheric temperature in the drum can also be increased to dry the laundry.

Hereinafter, the principle of heating the drum 30 using the induction module 70 including the coil 71 will be described.

A wire is wound to form the coil 71, and accordingly the coil 71 has a center.

When current is supplied to the wire, the current flows around the center of the coil 71 due to the shape of the coil 71. Therefore, a magnetic field is generated in the vertical direction so as to pass through the center of the coil 71.

In this connection, when alternating current, the phase of which varies, passes through the coil 71, an alternating current magnetic field, the direction of which varies over time, is formed. The alternating current magnetic field generates an induced magnetic field in a nearby conductor in a direction opposite the alternating current magnetic field, and a change in the induced magnetic field generates induced current in the conductor.

The induced current and the induced magnetic field can be understood as a form of inertia with respect to changes in electric field and magnetic field.

That is, in the case in which the drum 30 is configured as a conductor, eddy current, which is a type of induced current, is generated in the drum 30 due to the induced magnetic field generated in the coil 71.

In this connection, the eddy current is dissipated by the resistance of the drum 30, which is a conductor, and is converted into heat. As a result, the drum 30 is heated by the heat generated by the resistance, and the temperature in the drum 30 rises as the drum 30 is heated.

In other words, in the case in which the drum 30 is configured as a conductor that is formed of a magnetic material such as iron (Fe), it can be heated by the alternating current of the coil 71 provided at the tub 20. Recently, in many cases, a drum formed of stainless steel has been used in order to improve strength and hygiene. A stainless steel material has relatively good electric conductivity, and thus may be easily heated by a change in an electromagnetic field. This means that there is no need to specially manufacture a drum having a new configuration or a drum formed of a new material to heat the drum using the induction module 70. Therefore, a drum of the type used in a laundry treatment apparatus of the related art, i.e. a drum that is used in a laundry treatment apparatus employing a heat pump or an electric heater (a sheath heater), can also be used in a laundry treatment apparatus employing an induction module.

The induction module, which includes the coil 71 and the module cover 72, may be provided on the inner circumferential surface of the tub 20. Since the intensity of the magnetic field decreases with distance, it may be effective to provide the induction module on the inner circumferential surface of the tub 20 so as to narrow the gap between the induction module and the drum 30.

However, it is desirable for the induction module to be provided on the outer circumferential surface of the tub 20 for safety because the tub 20 contains wash water therein and vibrates as the drum 30 rotates. Because the interior of the tub is very humid, it may be undesirable for the induction module to be provided on the inner circumferential surface of the tub in view of the insulation and stability of the coil. Therefore, as shown in FIGS. 1A and 1B, it is desirable for the induction module 70 to be provided on the outer circumferential surface of the tub 20. Also in this case, however, it is desirable that the gap between the induction module 70 and the outer circumferential surface of the drum be made as small as possible. A preferred embodiment for this will be described later.

Generally, in the laundry treatment apparatus, the tub 20 has a cylindrical shape because the drum 30 rotates to wash or dry clothes (hereinafter, referred to as 'laundry').

In this connection, the coil 71 may be provided so as to be wound around the entire outer circumferential surface of the tub 20 at least once.

However, if the coil 71 is wound around the entire circumference of the tub 20, it requires too much wire. In addition, a short circuit or other problems may occur due to contact between the coil and the wash water leaking from the tub 20.

Further, if the coil 71 is wound around the entire circumference of the tub 20, an induced magnetic field may be generated in the opening 22 in the tub 20 and the driving unit 40, and thus may fail to directly heat the outer circumferential surface of the drum 30.

Therefore, it is desirable for the coil 71 to be provided only on a portion of the outer circumferential surface of the tub 20. That is, the coil 71 may be provided so as to be wound around a certain region from the front side of the tub 20 to the rear side thereof at least once, rather than being wound around the entire outer circumferential surface of the tub 20.

This configuration is determined not only in consideration of the heat generation efficiency in the drum 30, which can be achieved by the output of the induction module 70, but also in consideration of the overall manufacturing efficiency of the laundry treatment apparatus on the basis of the size of a space between the tub 20 and the cabinet 10.

The coil 71 may be formed to have a single-layer structure. That is, the wire may be wound in a single layer, rather than in multiple layers. In the case in which the wire is wound in multiple layers, a gap is inevitably formed between adjacent portions of the wire. That is, a gap is inevitably formed between a portion of the wire that is located in the bottom layer and a portion of the wire that is located in the top layer. Therefore, the distance between the portion of the coil that is located in the top layer and the drum is increased. In one example, even if such a gap can be physically eliminated, the greater the number of layers of the coil, the longer the distance between the portion of the coil that is located in the top layer and the drum, which leads to deterioration in efficiency.

Therefore, it is highly desirable for the coil 71 to be formed in a single layer. This also means that it is possible to increase the contact area between the coil and the drum as much as possible while using the wire having the same length. In one example, it is desirable that the coil 71 be formed so as to occupy the maximum allowable area within a given area of the base housing 72. That is, it is desirable to increase the coil density. The coil is formed in a manner such that the wire is wound in a closed loop. In this connection, the wire must not be folded. However, it is not easy to wind the wire so that the area of the coil is maximized while preventing the wire from being folded. An embodiment capable of maximizing the area of the coil while preventing the wire from being folded sharply will be described later.

In FIG. 1, the induction module is illustrated as being provided on the upper portion of the tub 20. However, the present disclosure is not limited thereto. The induction module may be provided on at least one of the upper portion, the lower portion, and both side portions of the tub.

The induction module may be provided on a portion of the outer circumferential surface of the tub, and the coil 71 may be wound around the surface of the induction module that is adjacent to the tub 20 at least once within the induction module.

Thus, the induction module directly radiates an induced magnetic field to the outer circumferential surface of the drum 30, thereby generating eddy current in the drum 30 and consequently directly heating the outer circumferential surface of the drum 30.

Although not illustrated, the induction module may be connected to an external power source via an electric wire to receive power, or may be connected to a controller for controlling the operation of the laundry treatment apparatus to receive power. A module control unit for controlling the output of the induction module may be separately provided. The module control unit may be configured to control the ON/OFF operation of the induction module and the output of the induction module under the control of the controller.

That is, as long as power can be supplied to the coil 71, the induction module may receive power from any device.

When power is supplied to the induction module and thus alternating current flows through the coil 71 provided in the induction module, the drum 30 is heated.

In this connection, if the drum 30 is not rotated, only a portion of the drum 30 is heated, with the result that the portion of the drum 30 may be overheated and the remaining portion thereof may not be heated, or may be insufficiently heated. Further, heat may not be smoothly transferred to the laundry contained in the drum 30.

For this reason, when the induction module is operated, the driving unit 40 operates to rotate the drum 30.

As long as the entire outer circumferential surface of the drum 30 can face the induction module, the drum 30 may be rotated at any speed by the driving unit 40.

As the drum 30 rotates, the entire surface of the drum 30 can be heated, and the laundry in the drum 30 can be evenly exposed to heat.

Therefore, in the laundry treatment apparatus according to an embodiment of the present disclosure, even though the induction module is not mounted on a plurality of portions (e.g. the upper portion, the lower portion, both side portions, etc.) of the outer circumferential surface of the tub 20 but is mounted only on one portion, the outer circumferential surface of the drum 30 can be evenly heated.

In the laundry treatment apparatus according to an embodiment of the present disclosure, the drum may be heated to 120 degrees Celsius or higher within a very short time by the operation of the induction module 70. If the induction module 70 is driven while the drum is in a stationary state or is rotated at a very low speed, a specific portion of the drum may be overheated very quickly. This is because heat is not sufficiently transferred from the heated drum to laundry.

Therefore, the relationships between the rotational speed of the drum and the operation of the induction module 70 are very important. It is more desirable to drive the induction module after the drum starts to rotate than to rotate the drum after the induction module starts to be driven.

A concrete embodiment of a rotation speed of the drum and a drive control of the induction module of the laundry treatment apparatus of the present disclosure will be described later.

In the laundry treatment apparatus of an embodiment of the present disclosure, it is not necessary for the laundry to be completely soaked in the wash water, and thus wash water can be saved. The reason for this is that the portion of the drum that contacts the wash water continuously changes as the drum rotates. That is, the heated portion of the drum comes into contact with the wash water to heat the wash water, and is then separated from the wash water and heated again.

In the laundry treatment apparatus according to an embodiment of the present disclosure, it is possible to increase the temperature of the laundry and the temperature in the space containing the laundry therein. This can be realized by heating the drum that contacts the laundry. Therefore, it is possible to effectively heat the laundry without immersing the laundry in wash water. For example, wash water can be saved because the laundry does not need to be immersed in the wash water for sterilization treatment. This is because the laundry can receive heat through the drum, rather than through the wash water. In addition, steam or water vapor generated as the wet laundry is heated changes the interior of the drum into a high-temperature and high-humidity environment, whereby the sterilization treatment can be more effectively performed. Therefore, the sterilizing-washing process, in which laundry is washed while being immersed in the heated wash water, can be realized by a method using a much smaller amount of wash water. In other words, since it is not necessary to heat wash water, which has a high specific heat, energy can be saved.

It will be understood that the laundry treatment apparatus according to an embodiment of the present disclosure is capable of reducing the amount of wash water to be supplied in order to increase the temperature of laundry, thus shortening the wash water supply time. This is because it is possible to reduce the amount and supply time of wash water that is additionally supplied after laundry wetting. Therefore, the washing time can be further shortened. In this connection, the water level of the wash water containing detergent may be lower than the minimum water level of the drum. In this case, a smaller amount of wash water can be more effectively used by supplying the wash water in the tub to the interior of the drum through a circulation pump.

It will be understood that the laundry treatment apparatus according to an embodiment of the present disclosure is capable of eliminating a heater provided on the lower side of the tub to heat wash water, thus simplifying construction and increasing the volume of the tub.

Particularly, a general heater provided inside the tub is limited in the extent to which the same is capable of increasing the heating surface area. That is, the surface area of the heater, which contacts air or laundry, is relatively small. On the other hand, the surface area of the drum or the surface area of the circumferential surface of the drum is very large. Accordingly, the heating area is increased, and thus an immediate heating effect can be obtained.

In the heating mechanism using a tub heater during the washing process, the tub heater heats wash water, and the heated wash water increases the temperature of the drum, the temperature of the laundry, and the atmospheric temperature in the drum. Therefore, it takes a lot of time for the above components to be heated to a high temperature.

However, as described above, the circumferential surface of the drum itself has a relatively large area in contact with the washing water, laundry, and air inside the drum. Thus, the heated drum directly heats the water, laundry, and air inside the drum. Therefore, during washing, the induction module may be more effective as a heating source than the tub heater. In addition, when the wash water is heated during the washing process, the operation of the drum is generally stopped. The reason for this is to drive the tub heater submerged in the wash water in the state in which the water level is stable. Thus, the washing time may be increased by the time required for heating the wash water.

On the other hand, the heating of the washing-water using the induction module may be performed while the drum is being driven. That is, the drum driving for the washing and the heating of the washing water may be performed at the same time. Accordingly, since no extra time is required for the washing-water heating, the increase in the washing time can be minimized.

Hereinafter, a concrete configuration and an embodiment of the induction module of the laundry treatment apparatus of the present disclosure will be described.

In FIG. 2, in the laundry treatment apparatus according to one embodiment of the present disclosure, the cabinet 10 is omitted, and the tub 20, the drum 30, and the induction module 70 are schematically shown.

In FIG. 2, the induction module 70 is disposed on an upper face of the drum 30 in the outer circumferential face of the tub 20. This is only an example to aid understanding. The present disclosure is not limited thereto. The present disclosure does not exclude a configuration that the induction module 70 is disposed at a side face or a lower face of the drum 30.

Figure 2A:
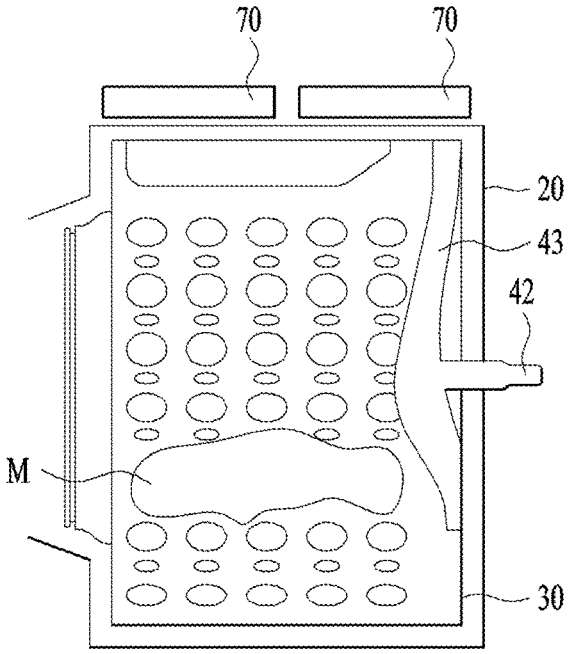
FIG. 2A shows a concept of a separate induction module being mounted on a tub.

As shown in FIG. 2A, at least two induction modules may be disposed along a front-rear direction of the tub 20. That is, arranging a plurality of induction modules on the outer circumferential face of the tub 20 in a front-rear directional manner may allow the outer circumferential face of the drum 30 to be uniformly heated.

Further, the energy efficiency may be increased by selectively driving the front induction module and the rear induction module depending on the position of the laundry.

For example, when the amount of the laundry M is small, the laundry may be biased behind the drum. This is because a tilting drum is often used. Conversely, when there is a large amount of laundry, the laundry may be evenly distributed in a front-rear direction of the drum.

When the amount of laundry is small, only the rear induction module may be driven. When there is a large amount of laundry, all induction modules may be driven. In this way, the induction modules may be driven according to the situation. Only one induction module may be driven as needed.

Figure 2B:
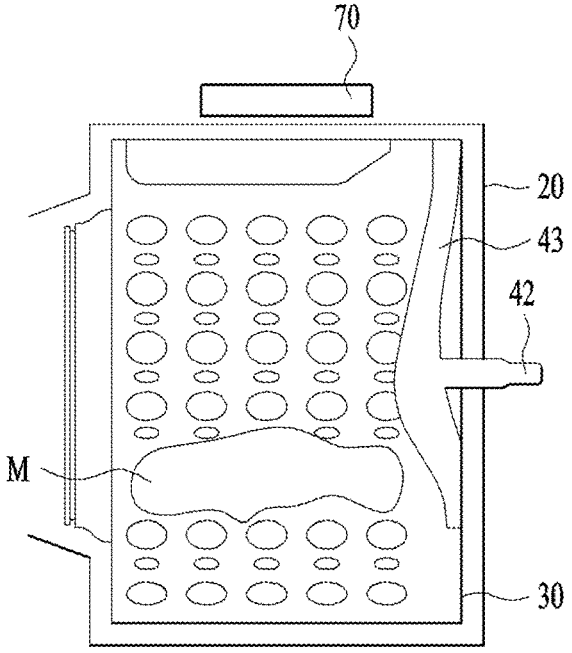
FIG. 2B shows a concept of an integrated induction module being mounted on a tub.

As shown in FIG. 2B, the induction module may be provided at the middle region of the drum 30. That is, when only one induction module is provided, the induction module may be disposed at a portion corresponding to the center of the drum 30 on the outer circumferential face of the tub 20. In other words, one induction module may be provided to extend forward and rearward around the front-rear directional center of the tub 20.

In this connection, when the induction module is biased forward, a gasket provided between the tub 20 and the drum 30 may be heated or the door to open or close the drum opening in front of the drum may be heated. To the contrary, a driving unit 40 and a rotation shaft 42 may be heated when the induction module is biased behind. This unnecessarily heats other components of the laundry treatment apparatus, thus wasting energy and possibly overheating the other components and causing abnormal operation thereof. Therefore, this phenomenon should be prevented. Particularly, a drive unit such as a motor or a shaft 42 is provided behind the drum 30. Further, a rear portion of the drum is recessed forward for connection with the spider 43. In other words, the back portion of the drum is connected to the spider. An area of contact between this connection portion and the laundry is relatively small. That is, the contact area between the connecting portion and the laundry is smaller than a contact area between the circumferential surface of the drum and the laundry. Therefore, heating the rear portion of the drum is very disadvantageous in terms of heating efficiency. Therefore, in order to prevent this situation, the induction module may be provided exactly at the center of the drum.

For the same reason, the induction module may be embodied as a plurality of induction modules. When only one induction module is provided, the induction module may be provided at a certain distance from the foremost part of the drum 30 and the rearmost part of the drum 30.

When the induction module is provided in a range from the foremost part to the rearmost part of the drum 30 and is provided at or about a vertical portion of the drum, a door, a circulation duct, a spray nozzle, and the like provided between the drum 30 and the tub 20 may be heated. When the induction module is provided in a range from the rearmost part of the drum 30 to the vertical portion of the drum, the drive unit 40 for the drum 30 may be heated. This situation should be avoided.

That is, when the induction module is provided only in a region spaced a certain distance from the foremost and rearmost portions of the drum 30, this may prevent the eddy current from being generated and heated in other parts of the laundry treatment apparatus.

FIG. 3 shows examples of a top view of the coil. That is, FIG. 3 shows the coil as viewed from above.

Figure 3A:
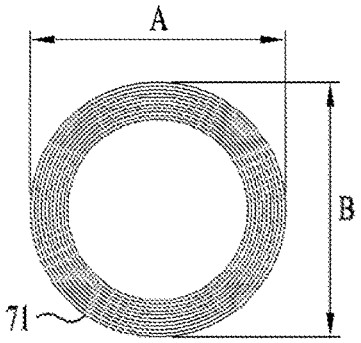
FIG. 3A is a top view showing one example of a circular shape coil.

Referring to FIG. 3A, the coil 71 may be wound at least once while maintaining the circular shape. That is, it is assumed that B be a length of the coil in the front-rear direction of the tub 20, and a length of the coil in the width direction or the left-right directional direction of the tub 20 is defined as A. The lengths A and B may be the same. The coil 71 may be arranged to form a flat structure. The coil 71 may be formed in a shape having a curved portion at each of left and right portions with considering the cylindrical outer circumferential face of the tub 20. In the latter case, the spacing between the coil 71 and drum 30 may be reduced along the outer face of the drum 30.

Figure 3B:
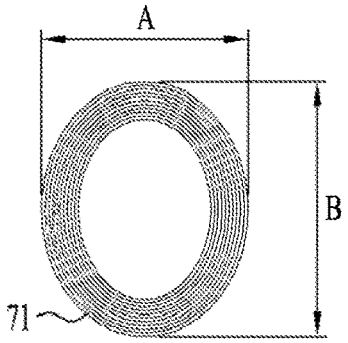
FIG. 3B is a top view of one example of an elliptical coil.

Referring to FIG. 3B, the coil 71 may be provided in an elliptical shape. That is, the coil may be provided in an elliptical shape in which a long axis extends in the front-rear direction of the tub. In this connection, since the length B is larger than the length A and the coil 71 extends longer in the front-rear direction of the tub 20 than in the width direction of the tub 20. Thus, the front and rear portions of the drum 30 can be heated evenly.

Figure 3C:
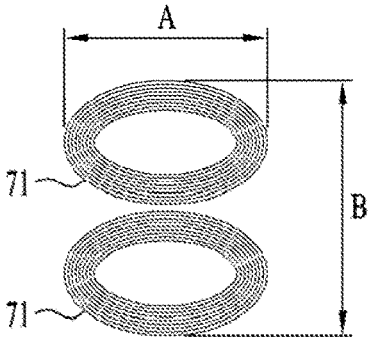
FIG. 3C is a plan view of one example of a separate elliptical coil.

Referring to FIG. 3C, the coil 71 may be wound at least once. Upper and lower coils may be spaced apart from each other. That is, a plurality of coils may be arranged in the front-rear direction of the tub 20.

In other words, the long axis of each coil may extend in the left-right direction of the tub 20. At least two coils 71 may be arranged in the short axis direction of each coil, that is, in the front-rear direction of the tub to heat the drum 30 in the front-rear and left-right directions.

The shape of coil 71 and the number of coils 71 may vary. In one example, the shape of coil 71 and the number of coils 71 may vary, depending on the capacity of the laundry treatment apparatus, that is, depending on the outer diameter or front-rear directional length of the tub or drum.

According to the work from the present inventors, when the areas between candidate coils are the same, a configuration in which one induction module whose a center of the coil corresponds roughly to the front-rear directional center of the drum is mounted is the most effective.

In an example, a 100 percent efficiency is assumed when the same coil is located at the position corresponding to the center of the drum. In this connection, it could be seen that a forwardly position-biased coil has an efficiency of about 96 percent while a rewards position-biased coil has an efficiency of about 90 percent. In other words, when the coil has a constant area, it may be seen that a configuration in which the coil is installed in a shape extending in the front-rear direction around the center of the drum. Therefore, instead of separating the coil by a plurality of sub-coils, a configuration in which the center of the coil position-corresponds to the center of the drum is the most effective. When the coil is divided into a plurality of sub-coils, the areas of the coils position-corresponding to the center of the drum are inevitably reduced. In the case of the two coils arrangement as shown in FIG. 3C, adjacent parts of the two coils may position-correspond to the center of the drum. Therefore, on the assumption that one coil in the former case has the same coil area as a total coil area of the two coils in the latter case, it may be seen that the coil arrangement shown in FIG. 3A is more efficient in terms of heating performance than the coil arrangement shown in FIG. 3C.

In one example, assuming the same coil area, it is preferable that the coil is formed such that a proportion of the coil is concentrated on the central portion of the coil. That is, I may be the most efficient that the central portion of the coil defines a single vertical line. In case of FIG. 3A, the coil has a single center axis. The coil of FIG. 3B has a center axis as a single vertical face. The central axis in FIG. 3C may be defined as two vertical lines or two vertical faces.

When the average temperature of the drum heated by these coils is measured, the coils in FIG. 3B and FIG. 3C exhibit the average temperature of the drum lower than that for the coil FIG. 3A. These results show that the performance of the single coil is better than a total performance of a plurality of coils. It may also be seen that the closer the center axis of the coil looks like to a single vertical line than to a single vertical face, the better the performance thereof.

However, with considering that laundry does not come into contact with an entire region of the drum throughout the drum and that all laundry, not just some laundry, must be heated evenly, the coil in FIG. 3B may be more desirable than the coil in FIG. 3A. For example, when the laundry is dried, all of 10 laundries may be well dried, but remaining two laundries, each being biased toward the front and back of the drum, may not be dried sufficiently. This problem may be more significant than a problem of a reduction in drying efficiency. This is because a consumer may be very uncomfortable with this drying result in which the remaining two laundries have not yet dried. Thus, it may be most desirable that the laundries may be evenly heated in the front-rear direction of the drum and the entire laundry may be heated evenly, although the heating efficiency is reduced by some extent.

In other words, the heating efficiency and drying efficiency may vary depending on the shape of the coil. The heating efficiency may be referred to as an output energy (heated amount of the drum) relative to an input energy. The heating efficiency may refer to a ratio at which the electrical energy applied to the induction module is converted to the thermal energy that heats the drum. However, the drying efficiency may be referred to as the input versus output until the entire laundry has been fully dried. In the latter case, a time factor may be further considered.

Therefore, it is more desirable that though the heating efficiency is lowered to some extent, the drying time may be shortened, and the superheating problem may be avoided, assuming that the drying could be completed and the drying could be terminated. To this end, the coil in FIG. 3B is more preferable than the coil in FIG. 3A. That is, in FIG. 3A, the center axis of the coil looks like close to a single vertical line, so that the heating efficiency is relatively high but the drying efficiency is relatively small.

In one example, for the same coil, as mentioned above, the coil is preferably positioned to face the front-rear directional center of the drum. Similarly, the change of the position of the coil and the change of the heating efficiency are independent of each other. However, with considering the drying efficiency, the position of the coil may be considered.

For this reason, it is preferable that the coil 71 is a single coil and is formed in an elliptical shape or a track shape having a long axis in the front-rear direction of the drum. Further, a center of the coil 71 preferably faces the front-rear directional center of the drum.

FIG. 4 shows one example of a fixing structure for the coil 71 of the induction module.

As described above, the module cover 72 may be provided to cover the coil 71. The module cover 72 is provided in the shape of a box whose bottom face is opened to prevent the coil 71 from being detached from the tub 20 due to external vibration.

Further, the module cover 72 may has a lateral space defined therein through which the coil 71 is received in the cover 72.

Figure 4A:
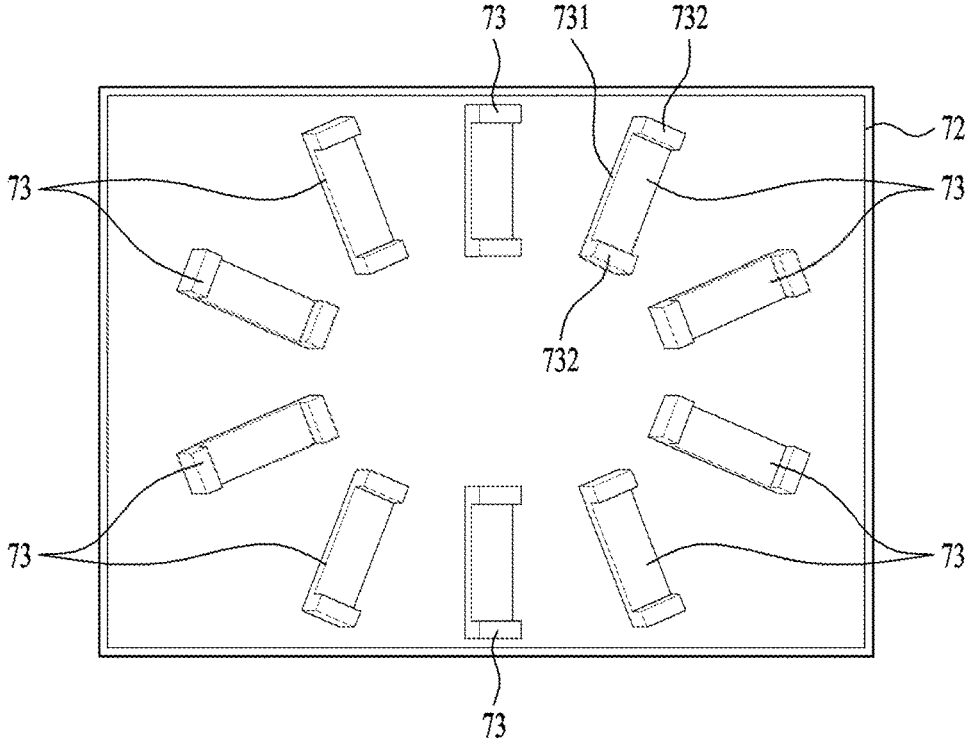
FIG. 4A is a bottom view of a module cover.

FIG. 4A shows the module cover 72 as viewed from the bottom. The module cover 72 may have a plurality of coil fixing portions 73 radially arranged to be spaced apart from each other so that while a form of the coil 71 is smoothly maintained, the coil 71 is wound. The coil fixing portions 73 may be integrally formed with the module cover 72. The module cover 72 may be formed via a plastic injection.

Each of the coil fixing portions 73 may include a bar shaped support 731. The support 731 may be provided to press the coil 71 downwardly. Therefore, since the coil 71 is pushed downwardly by the support 731, the overall shape of the coil 71 may be held without being deformed.

Each of the coil fixing portions 73 may include a protrusion 732 protruding downward from each of both ends of the support 731. Outer protrusions 732 and inner protrusions 732 may be defined to surround the coil 71 radially outwardly and radially inwardly of the coil 71 respectively. Therefore, the coil 71 may be prevented from being pushed radially inwards or outwards to be deformed.

Figure 4B:
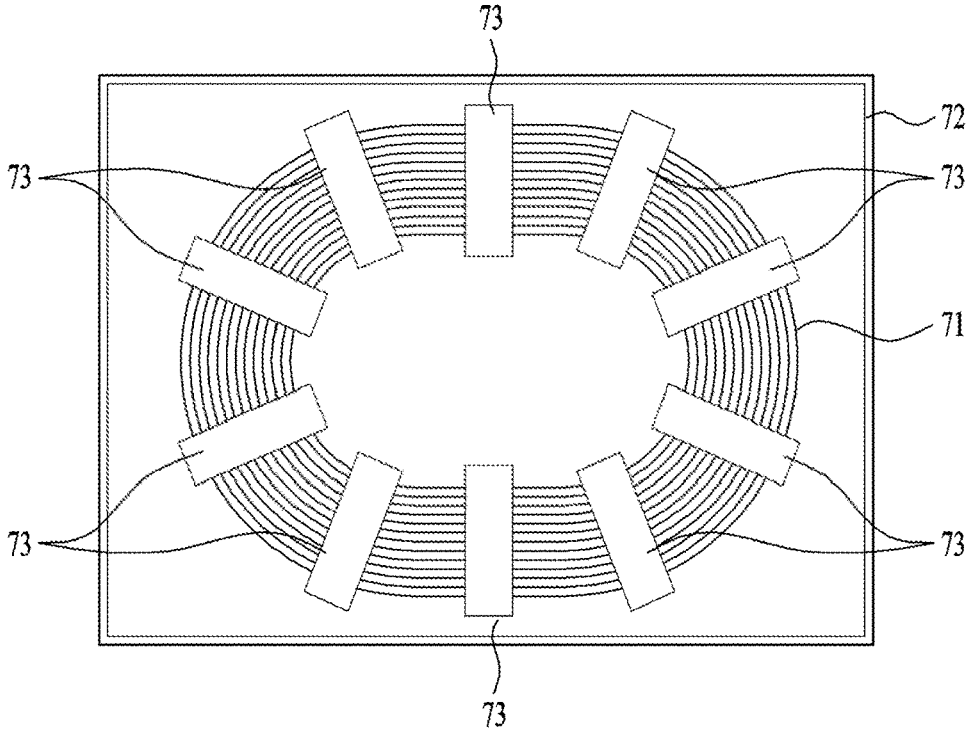
FIG. 4B is a top perspective view of the module cover of FIG. 4A.

FIG. 4B shows an internal view of the module cover 72 as viewed from a top.

The coil 71 begins to wind along the radially inner protrusions 732 of the coil fixing portions 73 and reaches the radially outer protrusions 732 of the coil fixing portions. Thus, the winding of the coil 71 may be completed.

As such, the coil 71 may be secured in the module cover 72 while maintaining its shape.

In one example, the coil fixing portions 73 may act as a mold for forming the coil while performing a function for fixing the coil. That is, a contour and size of the coil are determined in accordance with the coil fixing portions 73. Accordingly, the coil may be conformed to the coil fixing portions 73. In other words, the coil 71 may be formed using the coil fixing portions 73. Moreover, the coil fixing portions 73 may allow the coil to be be kept from being distorted or deformed.

Thus, the support 731 of the coil fixing portions 73 may be configured to seat the coil thereon and the protrusion 732 may be configured to prevent the coil from moving. These coil fixing portions may be formed along the longitudinal direction of the coil. Therefore, the entire coil can be stably formed and its shape can be maintained by the coil fixing portions 73.

In one example, the coil 71 has been described as being circularly and elliptically wound in the induction module. The coil 71 may be effective to heat the outer circumferential face of the drum 30 when the coil is wound in a as close manner as possible to the rectangular shape.

This is because the drum 30 is cylindrical and thus a cross-section of the outer circumferential face of the drum 30 perpendicular to the ground has a rectangular cross-sectional shape.

Thus, when the coil 71 is wound in a rectangular shape corresponding to the cross-sectional shape of the outer circumferential face of the drum 30 perpendicular to the ground at a maximum extent, this may reduce an amount of a portion of the drum 30 which the magnetic field generated by the coil 71 does not reach. Thus, the drum 30 may also effectively heat the drum 30.

However, winding the coil 71 in a perfectly rectangular shape may be difficult realistically with considering a material of the coil 71 and a coil winding process. Therefore, it may be more desirable to wind the coil 71 into the track shape as close to a rectangular shape as possible. Moreover, the track shape may allow the coil area to be further increased as compared with the elliptical shape.

In one example, when an elliptical coil and a track-shaped coil are formed in a rectangle shape, an area by which the inside of the rectangle is filled is larger in the track shaped coil than in the elliptical shaped coil. This is because, for the track shaped coil, the area occupied by the coil at four corner portions may be further increased compared to the elliptical shaped coil. Specifically, a portion of the coil 71 wound on each of the front and the rear portions of the tub 20 is curved. Each of both side portions of the coil 71 connecting the front and the rear portions of the tub 20 may has a straight line shape. Only each edge portion of the coil 71 may be formed in a round shape.

FIG. 5 shows an embodiment in which the coil 71 may be wound in the form of a track.

Figure 5A:
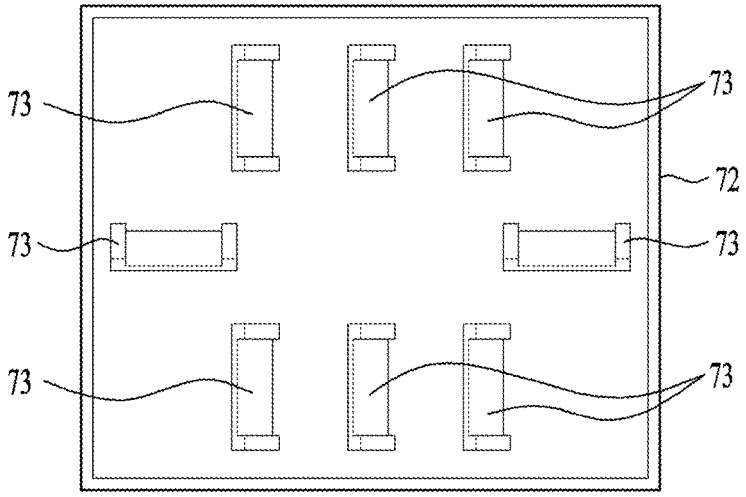
FIG. 5A is a bottom view showing a module cover according to another embodiment.

Referring to FIG. 5A, the coil fixing portions 73 are not arranged in a radial shape, but are arranged in a row at each of upper and lower portions with reference to the drawing. Each of coil fixing portions 73 provided on middle sides may be oriented to perpendicular to an orientation of each of the upper and lower coil fixing portions 73 arranged in a line.

In other words, when we define a left side of FIG. 5A as the forward direction of the tub 20 and a right side of FIG. 5A as the rear direction of the tub 20, a plurality of coil fixing portions 73 provided on each of both lateral portions of the tub 20 are provided in a row, while each of the coil fixing portions 73 provided on the front and rear of the tub 20 may be oriented perpendicularly to an orientation of each of the coil fixing portions 73 on the both lateral portions of the tub 20.

Figure 5B:
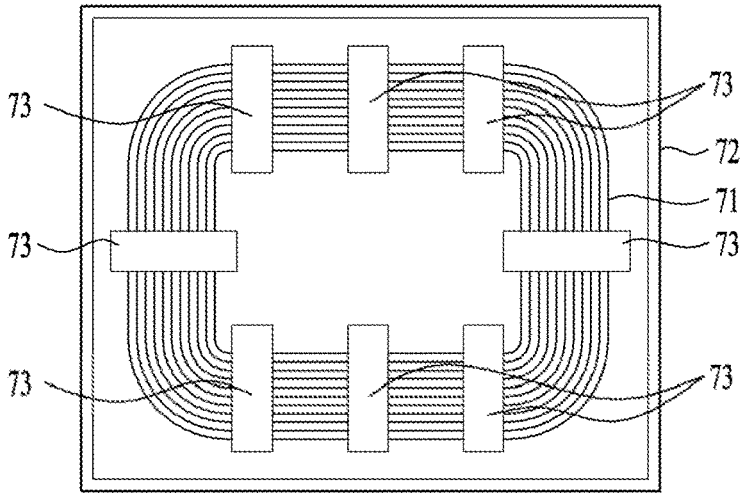
FIG. 5B is a top perspective view of the module cover of FIG. 5A.

Referring to FIG. 5B, the coil 71 extends linearly along the coil fixing portions 73 provided along both lateral portions of the tub 20. The coil 71 has a curvature to wind around the coil fixing portions 73 provided along the front and rear portions of the tub 20.

As a result, the coil 71 may be wound into a track shape when the coil 71 is wound along the arrangement of the coil fixing portions 73.

As a result, the coil 71 may generate an eddy current in a wider area of the outer circumferential face of the drum 30.

In this connection, the coil fixing portion provided on the outer circumferential face of the tub and having an orientation perpendicular to the rotation axis of the drum is referred to as a first coil fixing portion, whereas the coil fixing portion provided on the outer circumferential face of the tub and having an orientation parallel to the rotation axis of the drum is referred to as a second coil fixing portion. In either case, it is preferable that an orientation of each of the first and second coil fixing portions 73 is perpendicular to the winding direction of the coil or the longitudinal direction of the coil (more specifically, the longitudinal direction of the wire).

FIG. 4 and FIG. 5 show that the coil 71 is wound into a planar form parallel to the ground. The present disclosure is not limited thereto. One face of the module cover 72 where the coil fixing portions 73 are provided may have a curvature according to the radius of curvature of the drum 30 or the radius of curvature of the tub 20. The coil 71 may be provided to correspond to the radius of curvature of the drum 30 because the coil 71 is wound according to the curvature of the module cover 72.

Figure 5C:
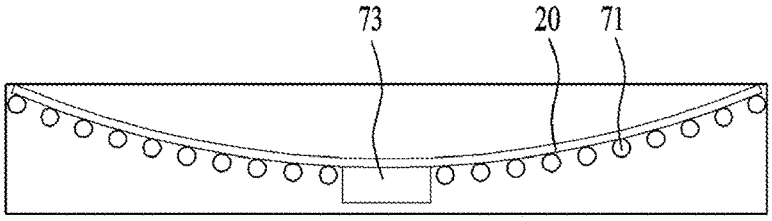
FIG. 5C is a cross-sectional view of one example of a curved coil along an outer surface of the tub.

Specifically, the radius of curvature of the tub is larger than the radius of curvature of the drum. When the coil 71 has the radius of curvature equal to the radius of curvature of the drum 30, the spacing between the coil and the drum may be minimized along the entire region of the coil. However, since the coil 71 is located on the outer circumferential face of the tub, it is preferable that the coil 71 conforms to the outer circumferential face of the tub. In an example, the coil 71 may be formed into the curved shape having the same radius of curvature as the radius of curvature of the outer circumferential face of the tub. FIG. 5C shows one example where the coil 71 is formed into the curved shape having the same radius of curvature as the radius of curvature of the outer circumferential face of the tub 20.

Thus, the spacing between the coil 71 and the drum 30 may remain constant as it goes outwardly from the center of the coil 71. This may generate an eddy current of the uniform intensity on the outer circumferential face of the drum 30. That is, the outer circumferential face of the drum 30 may be evenly heated.

In one example, when the coil is formed by winding a wire around the coil fixing portions 73, there may be a possibility of short-circuiting between adjacent wires in close contact with each other.

To prevent this situation, the wire 71 may be coated with a coating film such as an insulating film separately. However, the coil 71 is overheated by its own resistance. The cooling of the coil 71 may be difficult such that the insulating film may still have the risk of melting.

Further, an additional cost may be incurred when the insulating coating is applied to form a thick insulating film on the wire forming the coil 71. In order to prevent this situation, it is preferable that the coils are arranged to be spaced apart from each other when the coils 71 are wound around the induction module. This may reduce the thickness of the insulation coating.

That is, it is preferable that when the coils 71 are wound at least once along a direction from a front to a rear of the tube 20 on the induction module, the coils are wound to have a predetermined spacing between the coils so as not to contact each other. Thus, the coils 71 does not contact each other and there is no possibility of the short circuit therebetween. The heat of the coil 71 can also be easily cooled. Furthermore, the area of the wound coil 71 itself may be wider, thereby heating a larger area of the outer circumferential face of the drum 30.

Hereinafter, referring to FIG. 6, an embodiment in which an induction module 70 having a base housing 74 for fixing the coil 71 will be described in detail.

FIG. 6 shows the base housing 74 by which the coil is shaped and to which the coil is fixed. The base housing 74 may be integrally formed with the tub 20 via a plastic injection. A wire may be inserted into the base housing 74 to form the coil 71. Thus, the spacing between adjacent wires may be maintained, and the wire may be fixed. Therefore, the entire coil may be fixed without being deformed.

As shown in FIG. 6, the induction module 70 may further include the base housing 74 that allows the wires to be spaced apart from one another when the wires of the coil 71 are wound at least one time forwardly and backwardly of the tub 20 on the induction module. The base housing 74 may also be coupled to the module cover 72. Accordingly, the base housing and the module cover may be coupled to each other to form an internal space receiving the coil therein. Therefore, the base housing and the module cover may be referred to as a module housing. The base housing 74 may be coupled to the module cover 72 to be received in the module cover 72.

The base housing 74 may be provided separately from the tub 20 and may be coupled with the outer circumferential face of the tub. In one example, the base housing 74 may be integral with the tub 20. However, from the perspective of a manufacturer providing various models, there is no need to form the base housing 74 integrally with the tub 20 for a specific model and thus to manage a remaining inventory for the specific model. Thus, the base housing 74 is preferably formed separately from the tub.

FIG. 6 illustrates a structure in which the base housing 74 may be coupled to the outer circumferential face of the tub 20. The present disclosure is not limited thereto. The present disclosure does not exclude a configuration that the base housing 74 is integrally formed with the tub 20 as described above.

The base housing 74 may include a base 741 disposed on the outer circumferential face of the tub 20. The base 741 may have a curvature or a shape corresponding to a curvature or a shape of the outer circumferential face of the tub 20. The base 741 may be formed in a curved plate shape to conform to the outer circumferential face of the tub 20.

In this connection, the coil 71 may be wound on the base 741. In other words, the coil may be wound on the base at least once forwardly and rearwardly of the tube. Moreover, the base 741 may have a structure on which a bottom of the wire is seated.

The base 741 may include connectors 743 that may be attached to and joined to the outer surface of the tub. The connectors 743 may correspond to module connectors 26 formed on the outer circumferential face of the tub 20 as shown in FIG. 1B. A screw may allow corresponding connectors 743 and 26 to be coupled together. In this connection, the base 741 may be supported by the connectors 743 but may be spaced apart from the tub 20 by a certain spacing. This may prevent the base 741 from being exposed directly to the vibration of the tub.

In this case, the base housing 74 may also include a reinforcing rib (not shown) that defines the spacing between the base and the outer circumferential face of the tub 20 and supports the strength of the base.

In this connection, since the tub 20 is provided in a cylindrical shape, the base 741 may conform to the outer circumferential face of the tub. That is, the base 741 may be formed to have the same curvature as that of the tub 20.

In one example, the base 741 may be in face-contact with the outer circumferential face of the tub 20. In this case, the spacing between the coil 71 and the drum 30 may be minimized to prevent dispersion of the magnetic field.

The base 741 may have a coil slot 742 defined in one face thereof that may guide the coil 71 to be wound at least once on the base 741.

In this connection, each coil slot 742 may guide each wire of the coil 71 to be wound while the wires are spaced apart from each other.

Each coil slot 742 may be defined by a combination of adjacent fixing ribs 7421 protruding from the base 741. That is, each wire may be inserted and fixed between corresponding adjacent fixing ribs. The coil slot 742 may extend in a track shape. That is, the overall shape of each coil slot may be a track shape. Moreover, adjacent fixing ribs may define each lane having the track shape. That is, adjacent fixing ribs may form one lane and each wire may be inserted inside each lane. Depending on the number of lanes, the number of turns of the coil may be determined.

Accordingly, each wire may be press-fitted into each coil slot 742. Since both sides of the wire are in close contact with the fixing ribs defining the coil slot 742, the lateral movement of the wire may be prevented. Thus, the shape of the coil may be maintained.

That is, the fixing ribs 7421 may be formed of circle, ellipse, or track-shaped concentric extensions having different dimeters. In other words, the diameters of the fixing ribs 7421 may increase as they go outwardly.

Figure 6A:
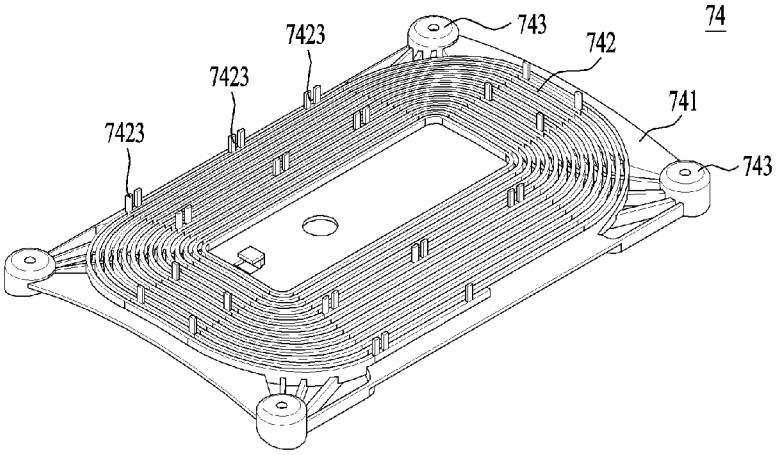
FIG. 6A is a top perspective view of one embodiment of a base housing.

FIG. 6A shows that the coil slot 742 is defined by a combination of adjacent fixing ribs 7421, and each fixing rib 7421 has a track shape having a straight portion and a curved portion. Thus, the coil 71 may be wound on the base 741 in an order from the outermost fixing rib 7421 to the innermost fixing rib 7421 or vice versa.

The fixing rib 7421 not only guides the coil 71 to be wound on the base, but also allows the coils 71 to have a spacing from one another when they are wound on the base.

Further, between a first fixing rib 7421 and a second fixing rib 7421 adjacent to the first fixing rib 7421, a receiving portion 7422 is defined. That is, each of the wires of the coil 71 may be accommodated in the receiving portion 7422, which is defined by the adjacent fixing ribs 7421 spaced apart from each other. That is, the fixing ribs 7421 may be spaced apart to define the receiving portion 7422.

The fixing rib 7421 may be formed to protrude upwards from the base 741. In this case, the bottom face of the receiving portion may be the top face of the base 741.

Further, the fixing rib 7421 may define the top face of the base 741. In this case, the receiving portion 7422 may be depressed downwards to allow the fixing rib 7421 to upwardly protrude relative to the receiving portion.

The base housing may further include protruding ribs 7423 that protrude further above the fixing rib 7421. The protruding rib 7423 may protrude from the top face of the fixing rib 7421 by a certain distance. The protruding ribs 7423 may also serve to maintain a spacing between the fixing ribs 7421 and the module cover 72.

Further, the protruding ribs 7423 may serve as a measure of a relative position of the fixing rib 7421. In other words, it may be determined based on the protruding rib 7423 that the fixing rib 7421 is located inside or outside the protruding rib 7423. This may allow for easy identification of the number of turns or area of the coil 71 when the coil 71 is wound around the fixing rib 7421.

Figure 6B:
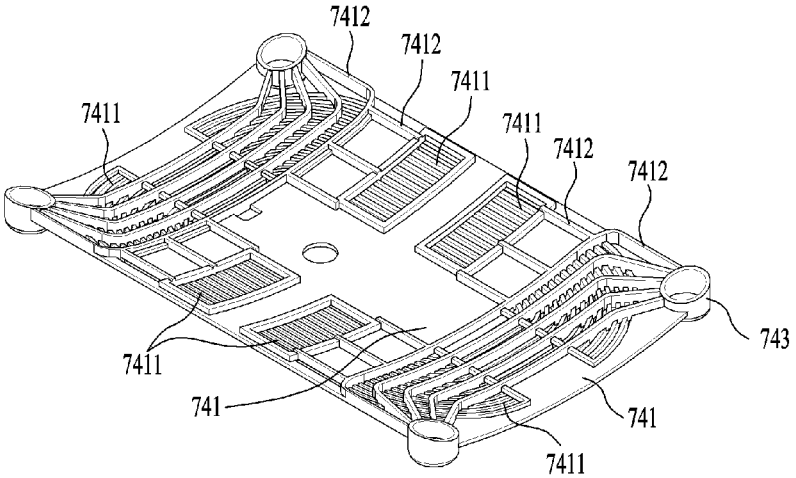
FIG. 6B is a bottom perspective view of the base housing shown in FIG. 6A.
Figure 6C:
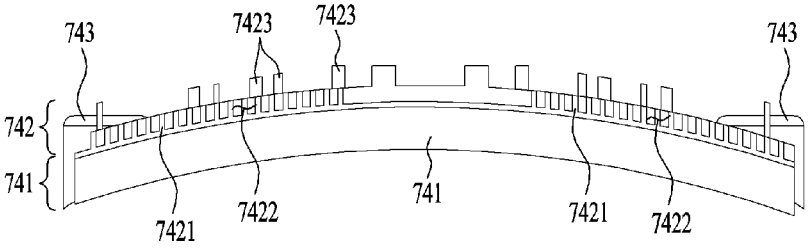
FIG. 6C is a cross-sectional view of the base housing shown in FIG. 6A.

FIG. 6B shows a back face of the base housing 74. FIG. 6C shows a cross-section of 74 of the base housing.

The base 741 may include a plurality of through-holes 7411.

At least one through-hole 7411 may be defined in the base 741.

The through-holes 7411 may be arranged symmetrically when the base 741 has a rectangular shape. The through-holes 7411 may be defined in one face and the other face of the base. The through-holes 7411 may define openings penetrating the base vertically. A portion of the base where the through-holes are not formed may form a closed portion.

In this connection, each through-hole 7411 may be defined in a quarter circular shape in each corner of the base 741. In a non-corner portion of the base 741, the through-hole 7411 may have a rectangular shape.

Further, the through-holes 7411 may be defined in a region of the base 741 correspond to the fixing ribs 7421.

Thus, when the coil 71 wound in the receiving portion 7422 heats via an electrical resistance, the through-holes 7411 may dissipate the heat of the coil 71 to prevent the damage to the base 741.

In one example, a plurality of through-holes 7411 may be formed along the longitudinal direction of the coil 71. Accordingly, a portion of the coil positioned above the through-holes 7411 may be exposed vertically. That is, an air gap may be formed between adjacent wires. This can prevent the coil from overheating.

Further, the base 741 may have a reinforcing rib 7412 for reinforcing a strength and rigidity on the back face in which the through-holes 7411 are defined.

The fixing ribs 7421 may not be fixed or supported in a region where the through-holes 7411 are defined. In this connection, the reinforcing rib 7412 may also serve to secure the fixing rib 7421 and reinforce the rigidity of the fixing rib 7421.

Further, unlike the embodiment shown in FIG. 6, the receiving portion 7422 may be embodied as a receiving groove recessed into the base 741 between the spaced fixing ribs 7421 of the base 741.

In this connection, the receiving groove may be considered to define the receiving portion 7422. In this connection, the fixing rib 7421 may be omitted. Only the receiving groove 7422 recessed in the base 741 may be provided. In this connection, the receiving groove 7422 may be formed on the base 741.

That is, the receiving groove 7422 may be engraved in the base 741. In other words, the receiving groove 7422 may be defined by engraving the base 741.

In this connection, the receiving grooves may have circle, ellipse, and track shapes that share the center but are different in diameter. The coils 71 may be spaced apart while the coils are wound in and along the receiving grooves at least once.

In one example, the coils 71 may be spaced from each other at a constant spacing on the base 741. The spacings between the coils 71 may be uniform. That is, the coils 71 may be provided on the base 741 to have equal spacings therebetween.

To this end, the receiving portions 7422 may be provided on the base 741 while being spaced apart from one another at the uniform spacing. The fixing ribs 7421 may protrude from the base 741 in circular, elliptical, or track shapes having the same center and being arranged to be spaced from each other by the uniform spacing.

FIG. 7 shows an installation method of the induction module when the tub 20 is formed by assembling the front tub and rear tub together.

The tub 20 may be provided in a cylindrical shape. In this connection, the tub 20 may be formed into a cylindrical shape in a monolithic manner having a receiving space defined therein. However, the present disclosure is not limited thereto. Each of two half portions of the cylindrical shape may be prepared. Then, the two half portions may be assembled together.

That is, the tub 20 may be formed in an assembling manner to facilitate the fabrication of the tub 20.

When the tub 20 is provided in the assembling manner, the tub 20 may include a front tub 21 surrounding a front of the drum 30 and a rear tub 22 surrounding a rear of the drum 30.

In this connection, the front tub 21 and the rear tub 22 may be joined via a connector 25.

The connector 25 may have any shape, provided that one end of the front tub 21 and one end of the rear tub 22 may be coupled to each other via the connector 25. In one example, the connector 25 may be provided to perform sealing as well as physically connecting the front tub 21 and the rear tub 22.

In this connection, due to the connector 25, the tub 20 may protrude convexly at a location of the connector 25.

Figure 7A:
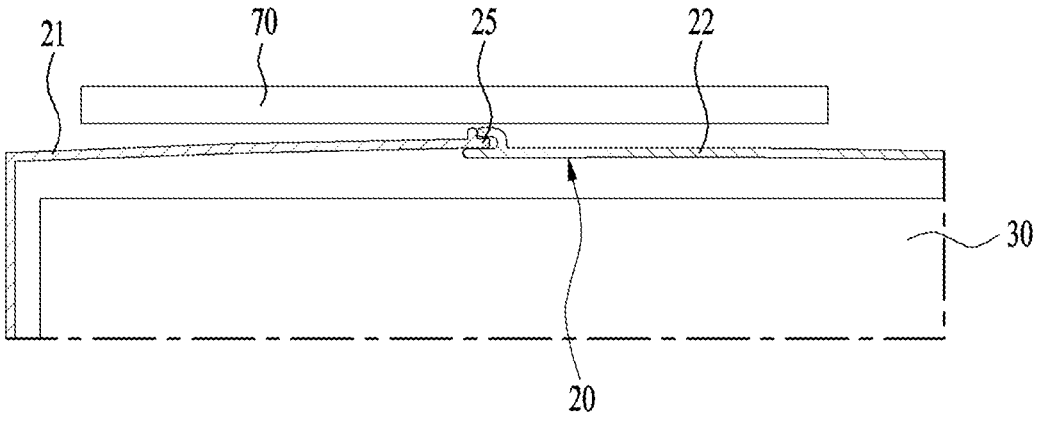
FIG. 7A is a cross-sectional view showing a positional relationship between the tub with a front tub and a rear tub and an integrated induction module.

As shown in FIG. 7A, the induction module 70 may be spaced apart from the tub 20 so as not to contact the connector 25.

Figure 7B:
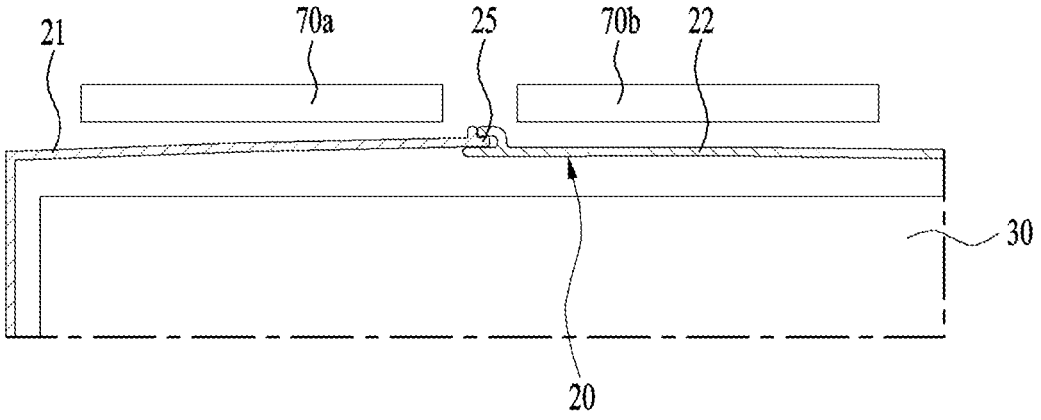
FIG. 7B is a cross-sectional view showing a positional relationship between the tub having the front tub and the rear tub and a separated induction module.

However, as shown in FIG. 7B, the induction module 70 may be provided on each of the front tub 21 and the rear tub 22.

That is, the induction module 70 may include a first induction module 70*a* provided on the outer circumferential face of the front tub 21 and a second induction module 70*b* provided on the outer circumferential face of the rear tub 22.

When the induction module is divided into the first and second induction modules as the tub 20 is divided into the front and rear tubs, the induction module may not be physically restricted by the connector 25.

In other words, when the induction module is singular, the induction module should be spaced from the tub 20 via the connector 25 of the tub 20 (See FIG. 7A). However, when the first and second induction modules are provided, the first and second induction modules may closely contact the tubs (See FIG. 7B). As a result, the induction modules may be closer to the drum 30, so that the magnetic field generated from the induction modules may be more effectively transmitted to the drum 30.

Further, the front tub 21 and the rear tub 22 may be arranged symmetrically with each other. Further, the first induction module 70*a* provided on the front tub 21 and the second induction module 70*b* provided on the rear tub 22 may be arranged symmetrically with respect to each other.

That is, the first induction module 70*a* and the second induction module 70*b* may be arranged symmetrically around a center of the drum 30 with respect to a direction perpendicular to the ground.

However, as described above, it has been described that the installation of a single induction module is more preferable in terms of heating efficiency than the installation of the two induction modules. Therefore, there is a need to further develop an approach to further reduce the spacing between the drum and the induction module. In addition, a method of minimizing an interference between the connector 25 and the induction module 70 needs to be further developed. Embodiments for those developments will be described later.

Figure 8:
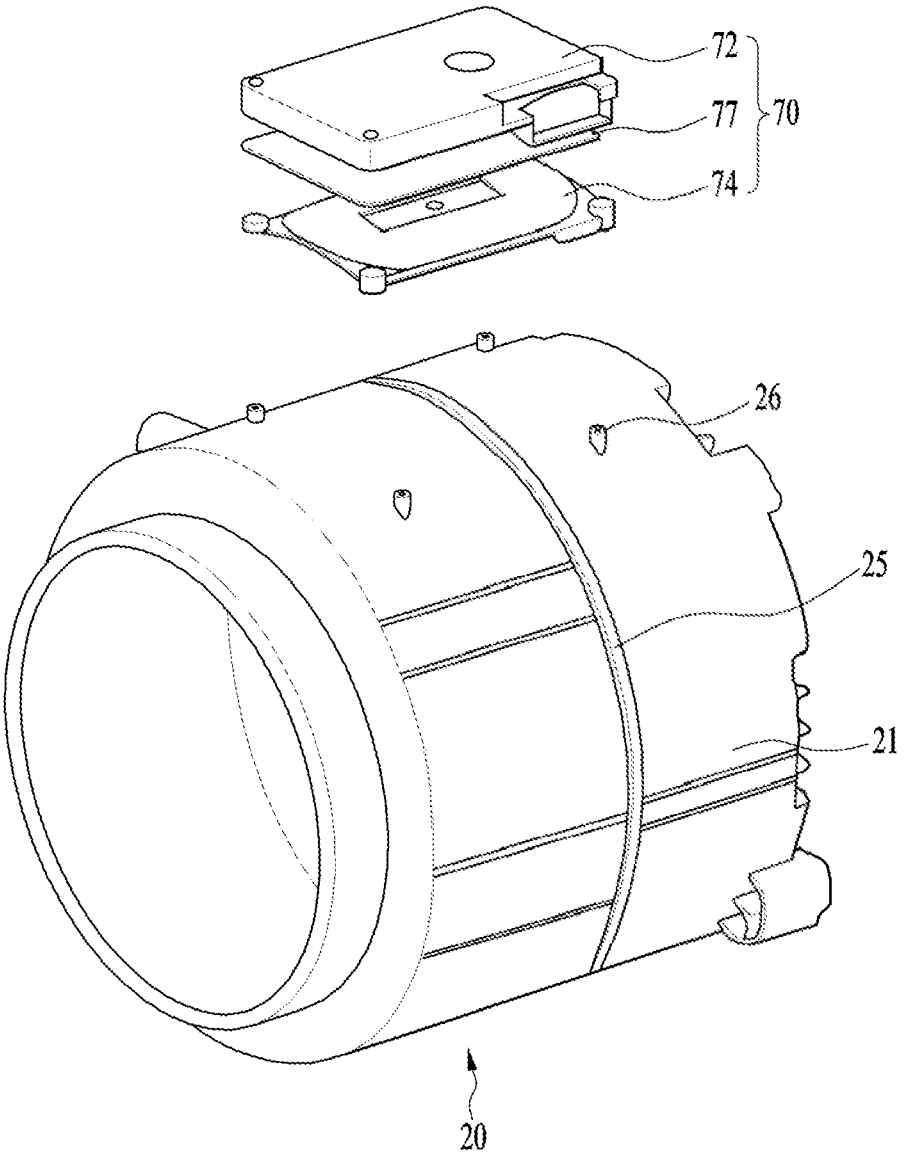
FIG. 8 shows a perspective view of a state in which an induction module with a module cover and a base housing is separated from the tub.

Hereinafter, a configuration for adjusting the direction of a magnetic field that is generated in the coil will be described with reference to FIG. 8.

Generally, the laundry treatment apparatus includes a controller (not shown) for rotating the driving unit 40, manipulating a control panel (not shown) provided in the cabinet 10 and controlling the processes of the laundry treatment apparatus, and further includes various electric wires (not shown).

The induction module 70 serves to heat the drum 30 using the magnetic field radiated from the coil 71. However, in the case in which the controller and the electric wires provided in the laundry treatment apparatus are exposed to the magnetic field radiated from the coil 71, abnormal signals may be generated in the controller and the electric wires.

Further, because the electronic devices, such as the controller, the electric wires, the control panel, etc., are susceptible to a magnetic field, it is desirable that only the drum 30 be exposed to the magnetic field generated by the induction module. Therefore, it is highly desirable that no conductor be provided between the coil 71 of the induction module 70 and the drum 30.

Further, since the generated magnetic field must be used only for heating the drum, it is highly desirable that the magnetic field be focused in the direction toward the drum (e.g. in the downward direction of the coil).

To this end, the induction module 70 may further include a blocking member 77 so that the magnetic field generated by the coil 71 is focused only on the drum 30. That is, the blocking member 77 may be provided on the coil 71 so that the magnetic field is focused in the direction toward the drum.

The blocking member 77 may be formed of a ferromagnetic material in order to focus the magnetic field generated by the coil 71 in the direction toward the drum.

The blocking member 77 may be coupled to the upper side of the base 74, and may be attached or mounted to the inner surface of the module cover 71. The blocking member 77 may be formed in a flat plate shape. In addition, a portion of the module cover 72 may be formed of a ferromagnetic material to serve as the blocking member.

That is, since the module cover 72 is formed in the shape of a box that has one open surface, in the case in which the module cover 72 accommodates the coil 71 or the base 74 therein, it can focus the magnetic field in the direction toward the drum 30. In this case, the additional blocking member 77 may be omitted.

In one example, the blocking member 77 may be a permanent magnet such as ferrite. The ferrite may not be formed so as to cover the entire upper portion of the coil 71. That is, the ferrite may be formed so as to cover only a portion of the coil, like the coil-fixing portion shown in FIGS. 3A to 4B. This means that the ferrite bar magnet can be fixed to the coil-fixing portion. That is, a permanent magnet made of, for example, ferrite, may be provided perpendicular to the longitudinal direction of the coil so as to focus the magnetic field in a desired direction. Therefore, it is possible to greatly improve efficiency using a small amount of ferrite. A concrete embodiment of the ferrite will be described later.

Although not illustrated, the controller may adjust the amount of current that flows through the coil 71, and may supply current to the coil 71.

The controller (not shown) may further include at least one of a thermostat (not shown) or a thermistor (not shown) in order to interrupt the supply of current to the coil when an excessive amount of current is supplied to the coil or when the temperature of the coil rises above a predetermined value. That is, a temperature sensor may be included. The thermostat and the thermistor may be provided in any shape, as long as they can interrupt the supply of current to the coil 71.

A detailed embodiment including such a controller and temperature sensor will be described later.

Hereinafter, the relationships between the coil 71 and the permanent magnet 75 will be described in detail with reference to FIG. 9.

The permanent magnet 75 may be provided to focus the magnetic field generated by the coil 71 in the direction toward the drum 30 in order to improve efficiency. The permanent magnet may be formed of a ferrite material. Specifically, the permanent magnet 75 may be provided in the form of a bar magnet that is perpendicular to the winding direction of the coil 71 or the longitudinal direction of the coil 71. The permanent magnet may be formed so as to form an intrinsic magnetic field in the upward-and-downward direction. Specifically, the permanent magnet may be formed so that the magnetic field is formed in the direction toward the drum.

FIG. 9 is a plan view of the coil 71 in which a wire 76 is wound around a certain region on the outer circumferential surface of the tub 20. The permanent magnet 75 is also illustrated as being provided on the top surface of the coil 71.

As illustrated in FIG. 9, the permanent magnet 75 may be configured as a bar magnet, and may be located on the coil 71 while being arranged perpendicular to the longitudinal direction of the coil 71. This is for covering both an inner coil portion located at a radially inward position and an outer coil portion located at a radially outward position at the same time.

The permanent magnet 75 may be provided in a plural number, and the plurality of permanent magnets 75 may be bar magnets that are the same size as each other. The permanent magnets 75 may be arranged so as to be spaced apart from each other in the longitudinal direction of the coil 71.

In the case in which the permanent magnets 75 are disposed at specific positions, the amount of the magnetic field radiated to the drum 30 is different for each portion of the circumferential surface of the drum 30, and thus it is difficult to evenly heat the drum. Therefore, in order to evenly induce the magnetic field generated by the coil 71 in the direction toward the drum 30, it is desirable that the permanent magnets 75 be arranged so as to be spaced apart from each other with a constant interval or a constant pattern along the circumference of the coil 71.

Further, in the case in which the number of permanent magnets 75 used for each portion of the coil 71 is the same, it is desirable that the permanent magnets 75 be densely disposed on the portions of the coil 71 that are adjacent to the front and rear sides of the tub 20.

Specifically, the coil 71 may be sectioned into both end portions B1 and B2, which include a front end portion B1 located adjacent to the front side of the tub 20 and a rear end portion B2 located adjacent to the rear side of the tub 20, and an intermediate portion A, which is located between the front end portion B1 and the rear end portion B2 and has a larger area than the front end portion B1 and the rear end portion B2. The permanent magnets 75 may be arranged such that the number thereof disposed on the front end portion B1 or the rear end portion B2 of the coil is equal to or greater than that disposed on the intermediate portion A of the coil.

The density of the coil 71 in the intermediate portion A is relatively large. On the other hand, the density of the coil 71 in the both end portions B1 and B2 is relatively small. The density of the coil is inevitably reduced in the both end portions B1 and B2 due to the rounded corners. The reason for this is that the coil cannot be theoretically bent at a right angle at the corners.

Therefore, relatively less concentration of the magnetic field is required for the intermediate portion A of the coil, and relatively greater concentration of the magnetic field is required for the both end portions B1 and B2 of the coil. Thus, in the case in which the number of permanent magnets used for each portion of the coil is the same, it is desirable that the permanent magnets be more densely disposed on the both end portions of the coil than on the intermediate portion of the coil. Accordingly, it is possible to evenly heat the front and rear sides of the drum. That is, the embodiment shown in FIG. 9B can further improve efficiency by more evenly heating the drum than the embodiment shown in FIG. 9A.

In other words, the magnetic flux density in the both end portions B1 and B2 of the coil is increased through the dense arrangement of the permanent magnets, with the result that the drum 30 is evenly heated in the longitudinal direction thereof.

Figure 9A:
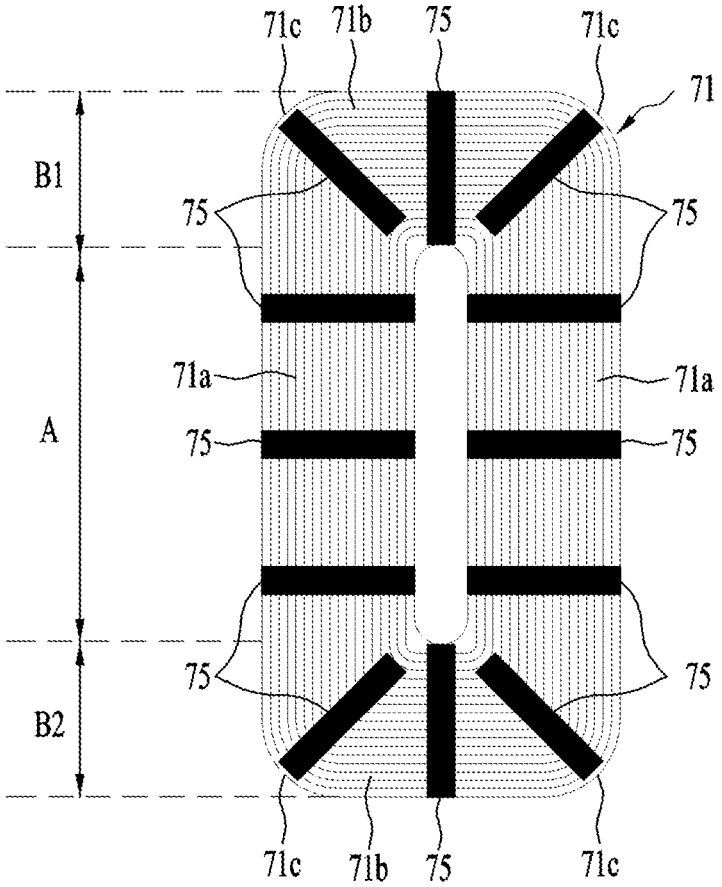
FIG. 9A is a plan view showing one example of a positional relationship between the coil and a permanent magnet.
Figure 9B:
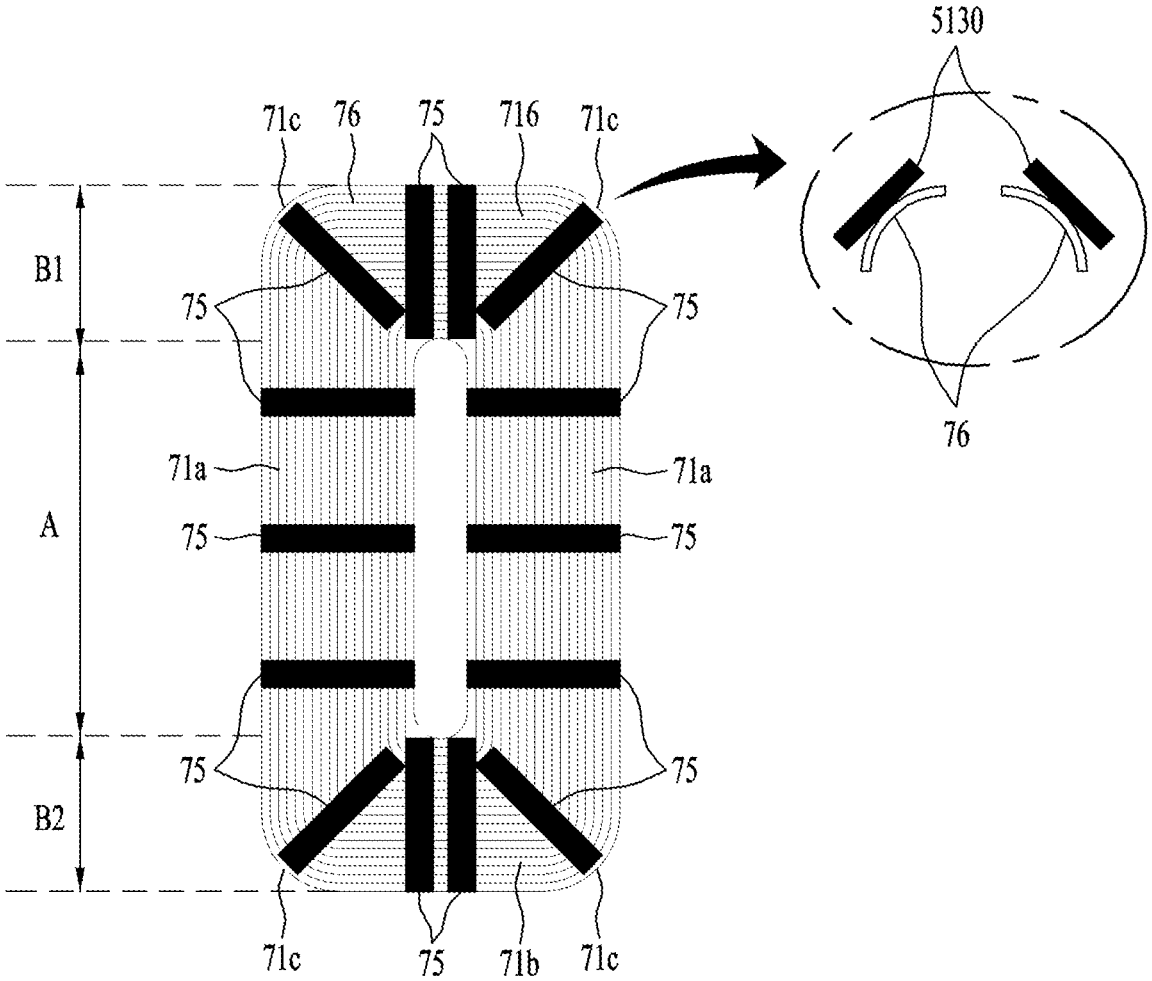
FIG. 9B is a plan view showing another example of the positional relationship between the coil and the permanent magnet.

Specifically, under the same conditions, the embodiment shown in FIG. 9B may be more efficient than the embodiment shown in FIG. 9A. Further, assuming that the number of permanent magnets used for each portion of the coil is the same, it may be desirable to move the permanent magnets located in the intermediate portion A of the coil to positions adjacent to the both end portions B1 and B2 of the coil in terms of efficiency. Therefore, in the case in which the total magnetic flux density is determined through the permanent magnets, it is desirable that the magnetic flux density in the both end portions of the coil be set to be larger than the magnetic flux density in the intermediate portion of the coil.

The above-described embodiment related to the winding form of the coil 71 and the above-described embodiment related to the arrangement of the permanent magnets 75 can be applied to a single laundry treatment apparatus without any contradiction. That is, it is possible to obtain the effect of more evenly heating the drum 30 when the above-described embodiment related to the winding form of the coil and the above-described embodiment related to the arrangement of the permanent magnets are combined, compared with when these embodiments are implemented individually.

The coil 71 may be formed in any shape, such as a concentric circle, an ellipse, a track, etc., as long as the coil 71 can be formed on the outer circumferential surface of the tub 20 by winding the wire 76. However, the extent to which the drum 30 is heated may vary depending on the wire-winding shape. This has been described above.

Figure 10A:
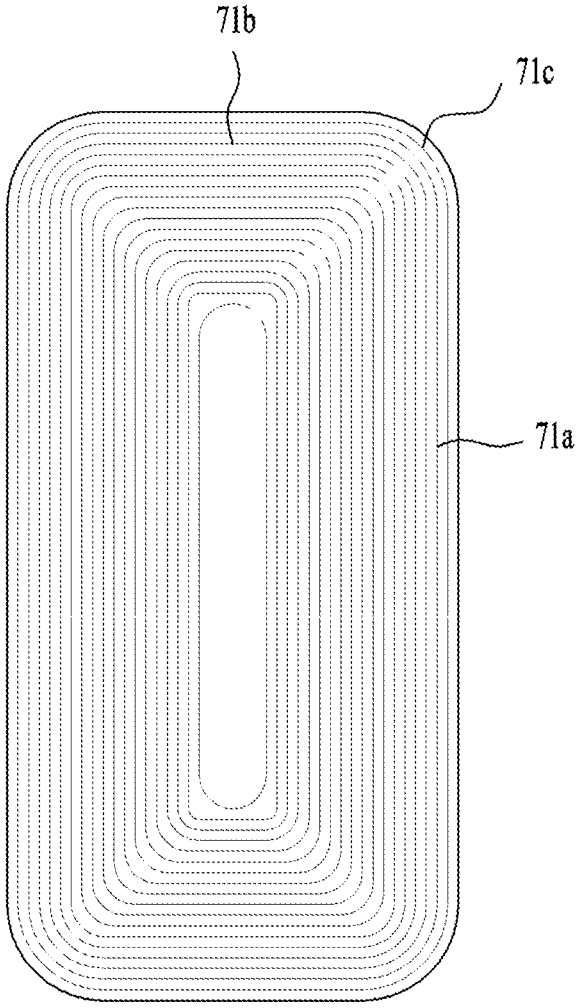
FIG. 10A is a plan view showing one example of a coil having a track shape in which a ratio of a front-rear directional width to a left-right directional width is relatively large.
Figure 10B:
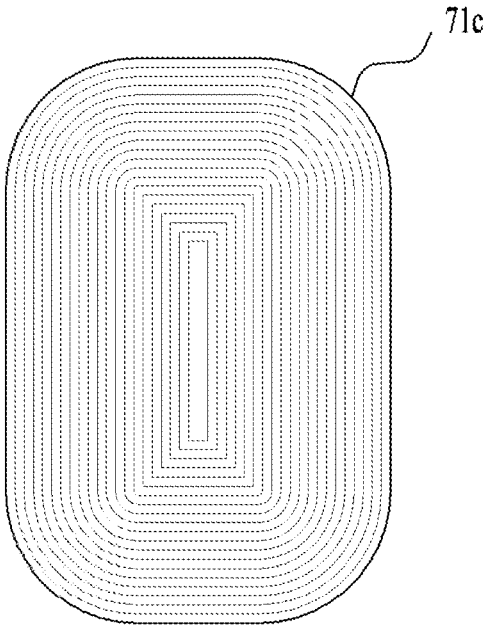
FIG. 10B is a plan view showing one example of a coil having a track shape in which a ratio of a front-rear directional width to a left-right directional width is relatively small.

For example, like the coil shown in FIG. 10B, in the case in which the radius of curvature of the curved portion of the coil is different between the inner coil portion located at the radially inward position and the outer coil portion located at the radially outward position, the amount of the magnetic field transferred to the center of the drum 30 and the amount of the magnetic field transferred to the front and rear sides of the drum 30 may be significantly different from each other.

In other words, because the area of the coil that is located near the front and rear sides of the drum 30 is relatively small, the amount of the magnetic field that is transferred to the front side of the circumferential surface of the drum 30 is relatively small. On the other hand, because the area of the coil that is located near the center of the drum 30 is relatively large, the amount of the magnetic field that is transferred to the center of the circumferential surface of the drum 30 is relatively large. Therefore, it is difficult to evenly heat the drum 30.

Therefore, it is desirable for the coil to be formed in a rectangular shape, rather than a square shape. That is, it is desirable that the width in the forward-and-backward direction of the coil be greater than the width in the lateral direction thereof. Accordingly, it is possible to expand the center portion of the coil, which has a relatively large area, in the direction from the center of the drum to the front and rear ends of the drum.

As shown in FIGS. 9A to 10B, the wire 76 may be wound such that the coil 71 includes straight portions 71*a* and 71*b* and a curved portion 71*c*. In the curved portion 71*c*, the inner coil portion and the outer coil portion may have the same radius of curvature as each other. That is, it is desirable that the radius of curvature of the wire at a position close to the center of the coil and the radius of curvature of the wire at a position distant from the center of the coil be the same. The radius of curvature in the straight portions 71*a* and 71*b* is meaningless, and thus the same radius of curvature is meaningful in the curved portion 71*c*. In the case of FIG. 10B, the radius of curvature in the curved portion 71*c* is different for each portion of the coil located in the radial direction. Specifically, in the case of FIG. 10B, the radius of curvature in the curved portion 71*c* is gradually increased in the radially outward direction.

It may be seen that the area of the corner portion of the coil shown in FIG. 10A and the area of the corner portion of the coil shown in FIG. 10B are significantly different from each other.

The relationships between the straight portions 71*a* and 71*b* and the curved portion 71*c* will now be described in more detail with reference to FIG. 9. The straight portions 71*a* and 71*b* include a front straight portion 71*b* located on the front side of the outer circumferential surface of the tub 20 and a rear straight portion 71*b* located on the rear side of the outer circumferential surface of the tub 20, which are collectively referred to as horizontal (lateral) straight portions, and further includes a vertical (longitudinal) straight portion 71*a*, which is formed perpendicular to the horizontal straight portions 71*b*. It is desirable that the length of the vertical straight portion be greater than the length of the horizontal straight portion. That is, in the case in which the coil is formed in an elliptical shape or a track shape, it is desirable that the long axis of the coil be formed in the forward-and-backward direction of the tub.

The curved portion 71*c* is formed at the position at which the horizontal straight portion 71*b* and the vertical straight portion 71*a* meet. That is, the coil may be formed by four curved portions 71*c*, which have the same radius of curvature as each other, and four straight portions.

Through the above-described configuration, the both end portions B1 and B2 of the coil, which include the front end portion located adjacent to the front side of the tub 20 and the rear end portion located adjacent to the rear side of the tub 20, and the intermediate portion A of the coil, which is located between the front end portion B1 and the rear end portion B2, may have uniform lateral widths. In addition, the curved portion may be formed such that the inner coil portion and the outer coil portion have the same radius of curvature as each other, with the result that the curved portion may be formed so as to maximally approximate to the shape of the corner of a rectangle. In other words, a first radius of curvature of an inner coil portion of the curved portion of the coil being the same as a second radius of curvature of an outer coil portion of the curved portion of the coil.

As a result, the amount of the magnetic field radiated from the both end portions B1 and B2 of the coil to the front and rear portions of the circumferential surface of the drum 30 can be set as close as possible to the amount of the magnetic field radiated from the intermediate portion A of the coil to the center of the circumferential surface of the drum 30. That is, the amount of the magnetic field, which may be reduced at the both end portions of the coil due to the shape thereof, can be compensated for as much as possible through the uniform radius of curvature in the curved portion.

Therefore, it is possible to obtain the effect of evenly heating the center and the front and rear portions of the circumferential surface of the drum 30.

This uniform heating, which can be achieved through the above-described shape of the coil and the uniform radius of curvature in the curved portion, may be more effectively performed through magnetic field concentration using the above-described ferrite. That is, the magnetic field may be further focused on the front and rear sides of the drum than on the center of the drum by the ferrite. In other words, the magnetic field that is excessively focused on the center of the drum may be dispersed to the front and rear sides of the drum. This dispersion method is very economical and effective. In the case in which the amount of the magnetic field that can be focused by the ferrite is determined, the arrangement of the ferrite may be appropriately concentrated on the regions corresponding to the front and rear ends of the drum.

FIG. 11 show coils 71 having different vertical lengths from each other and the temperature rise distribution of the circumferential surface of the drum 30 depending on the longitudinal widths of the coils 71.

In the graph, the vertical axis represents portions of the outer circumferential surface of the drum 30. In this connection, '1' denotes the rear portion of the outer circumferential surface of the drum 30, '5' denotes the front portion of the outer circumferential surface of the drum 30, and '2' to '4' denote the portions between the rear portion of the outer circumferential surface of the drum 30 and the front portion thereof. The horizontal axis represents the temperature rise rate of the drum 30.

Figure 11A:
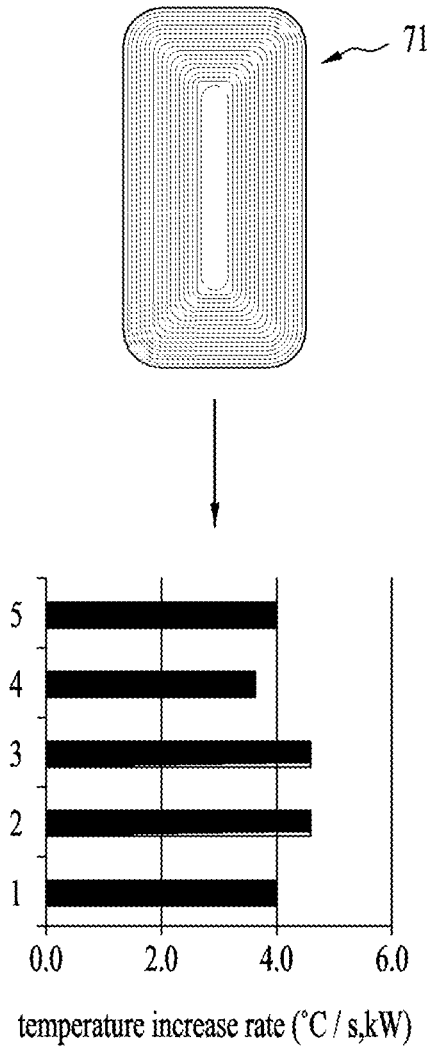
FIGS. 11A to 11C show a rate of increase in temperature along a front-rear directional length of the drum for three different coils.
Figure 11B:
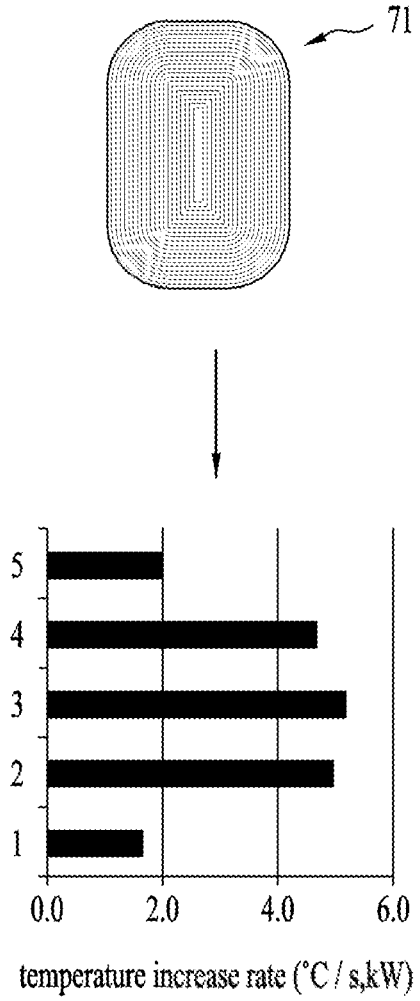
Figure 11C:
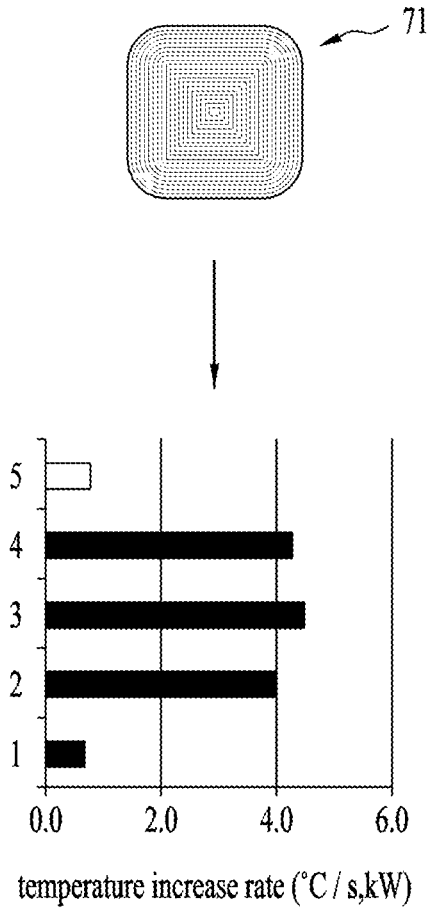

Hereinafter, the longitudinal width of the coil 71 and the temperature rise rate of the drum 30 will be described through comparison of the coils 71 shown in FIG. 11. FIG. 11A shows the case in which the drum is heated using the coil having the largest longitudinal width, FIG. 11B shows the case in which the drum is heated using the coil having a medium longitudinal width, and FIG. 11C shows the case in which the drum is heated using the coil having the smallest longitudinal width.

In the case of the coil of FIG. 11A, the temperature rise rate is substantially uniform over the front and rear portions and the center of the drum 30. In the case of the coil of FIG. 11C, the temperature rise rate is significantly different between the front and rear portions of the drum 30 and the center of the drum 30. In the case of the coil of FIG. 11B, the temperature rise rate is somewhat different between the front and rear portions of the drum 30 and the center of the drum 30.

That is, on the assumption that the area of the coil 71 is uniform, the front and rear portions and the center of the drum 30 can be more evenly heated as the longitudinal width of the coil 71 becomes longer. This can be realized by expanding a large portion of the coil from the region corresponding to the center of the drum to the regions corresponding to the front and rear portions of the drum.

An analysis of the relationships between the area or shape of the coil and the efficiency with which electric energy is converted into thermal energy will be described with reference to FIG. 711.

First, in the case in which the area of the coil is uniform, that is, the case in which the coil is formed using a piece of wire having a uniform length, the efficiency with which electric energy is converted into thermal energy increases as the shape of the coil more closely approximates a circle or a square. The reason for this is that the closer the center of the magnetic field is to a single axis (line), the smaller the amount of magnetic field that leaks.

However, it is not desirable to mount a circular- or square-shaped coil on the cylindrical-shaped tub in terms of convenience of mounting and mounting stability. This is because the lateral width of the coil is increased, which means that the angle between the left end and the right end of the coil is increased. The increase in the angle between the left end and the right end of the coil means that the coupling error between the cylindrical-shaped tub and the left and right ends of the coil is inevitably increased. Therefore, it is desirable that the angle between the left end and the right end of the coil be substantially less than 30 degrees about the center of the tub.

FIGS. 11B and 11C show coils having the same lateral width as each other. The lateral width of the coil is set to be uniform for mounting stability and convenience. FIG. 11C shows an example of maximizing the lateral width of the coil in order to maximize the energy conversion efficiency. However, since the extension of the lateral width of the coil is limited, the width in the forward-and-backward direction of coil is inevitably reduced. This means that the area expansion of the coil is limited and the front and rear portions of the drum cannot be sufficiently heated. Therefore, only some of the laundry in the drum is heated, but the rest of the laundry is not heated. Accordingly, drying efficiency is significantly lowered.

In view of this problem, there may be provided the coil of FIG. 11B, of which the width in the forward-and-backward direction thereof is increased while maintaining the lateral width thereof. In this case, the area of the coil is increased so that the front and rear portions of the drum can also be heated, and thus the overall temperature rise rate increases.

The coil of FIG. 11A is an example in which the width in the forward-and-backward direction thereof is increased instead of reducing the area of a center portion thereof and the lateral width thereof as compared with the coil of FIG. 11B. As illustrated, the temperature rise rate at the center of the drum is slightly reduced, but the temperature rise rate at the front and rear ends of the drum is increased. That is, it may be seen that the temperature rise rate is substantially uniform over the front and rear portions and the center of the drum.

It may be seen that although the energy conversion efficiency is the lowest due to the increase in the width in the forward-and-backward direction of the coil and the decrease in the area of the center portion of the coil, the coil of FIG. 11A is the most desirable one in terms of uniform heating of the drum.

As described above, although energy conversion efficiency is important, drying efficiency is more important when the energy conversion efficiency is not greatly different. That is, it is more important to evenly heat the drum so that the laundry is evenly dried irrespective of the location thereof in the drum. Generally, a drying process is performed until a desired degree of dryness for each piece of laundry is satisfied. In the case in which a drying process is performed by sensing the degree of dryness, when a specific piece of laundry is not dried, the drying process is performed until a desired degree of dryness for the specific piece of laundry is satisfied and consequently until a desired degree of dryness for all of the laundry is satisfied.

It may be said that the shorter the time required for satisfying the same degree of dryness, i.e. the drying time, the higher the drying efficiency. A reduction in the drying time means energy savings.

Therefore, even if the efficiency of the induction module is lowered, it is more desirable that the energy consumption of the laundry treatment apparatus be low. From this point of view, the present applicant has found that the coil of FIG. 7 is the most efficient when not only the efficiency of the induction module but also the overall efficiency of the laundry treatment apparatus is considered.

In the case in which a portion of the wire that is located at the outermost position of the horizontal straight portion 71*b* is expanded to the front and rear portions of the tub 20, the drum 30 may be more evenly heated. In this case, however, the magnetic field is excessively radiated in the forward-and-backward direction and heats the driving unit 40, the door, or other components of the laundry treatment apparatus, thus leading to damage to the laundry treatment apparatus. Further, since unnecessary components may also be heated, efficiency may be lowered. Therefore, the increase in the length or width in the forward-and-backward direction of the coil or the induction module needs to be limited.

In the case of a laundry treatment apparatus in which the rear portion of the tub 20 is inclined inside the cabinet 10, when the tub 20 vibrates upwards and downwards, the front upper edge of the induction module 70 interferes with the bottom surface of the top panel of the cabinet, which causes damage to the induction module 70 and the cabinet 10. In order to prevent this problem, the height of the cabinet 10 may be increased. In this case, however, a compact laundry treatment apparatus cannot be realized.

Thus, a portion of the wire that is located at the outermost position of the front straight portion 71*b* and a portion of the wire that is located at the outermost position of the rear straight portion 71*b* are spaced apart from the front side of the tub 20 and the rear side of the tub 20, respectively, by a predetermined distance. The predetermined distance may range from 10 mm to 20 mm.

The above-described configuration has effects of preventing unnecessary heating of components other than the drum 30 or interference between the induction module 70 and the bottom surface of the top panel of the cabinet 10 and of evenly heating the outer circumferential surface of the drum 30.

Further, the length of a portion of the wire that is located at the outermost position of the vertical straight portion 71*a* of the coil 71 may be greater than the length of a portion of the wire that is located at the outermost position of the horizontal straight portion 71*b*.

This prevents the magnetic field from being radiated in an excessively wide range in the circumferential direction of the drum 30 so as to avoid heating components other than the drum 30, and makes it possible to secure an arrangement space for a spring or other element, which may be provided on the outer circumferential surface of the tub 20.

In this connection, the surface of the coil 71, which is formed by winding the wire 76, may be curved corresponding to the circumferential surface of the drum 30. In this case, the magnetic flux density of the magnetic field that is radiated to the drum 30 may be further increased.

Further, when the induction module 70 is operated, the drum 30 may be rotated so that the circumferential surface of the drum 30 can be evenly heated.

The tub 20 vibrates during the operation of the laundry treatment apparatus. Thus, in the case in which the coil 71 is mounted on the tub 20, the coil 71 must be stably fixed. To this end, as described above, the induction module 70 includes the base housing 74 in which the coil 71 is mounted and fixed. Hereinafter, an embodiment of the induction module 70 including the base housing 74 will be described in more detail.

Figure 12A:
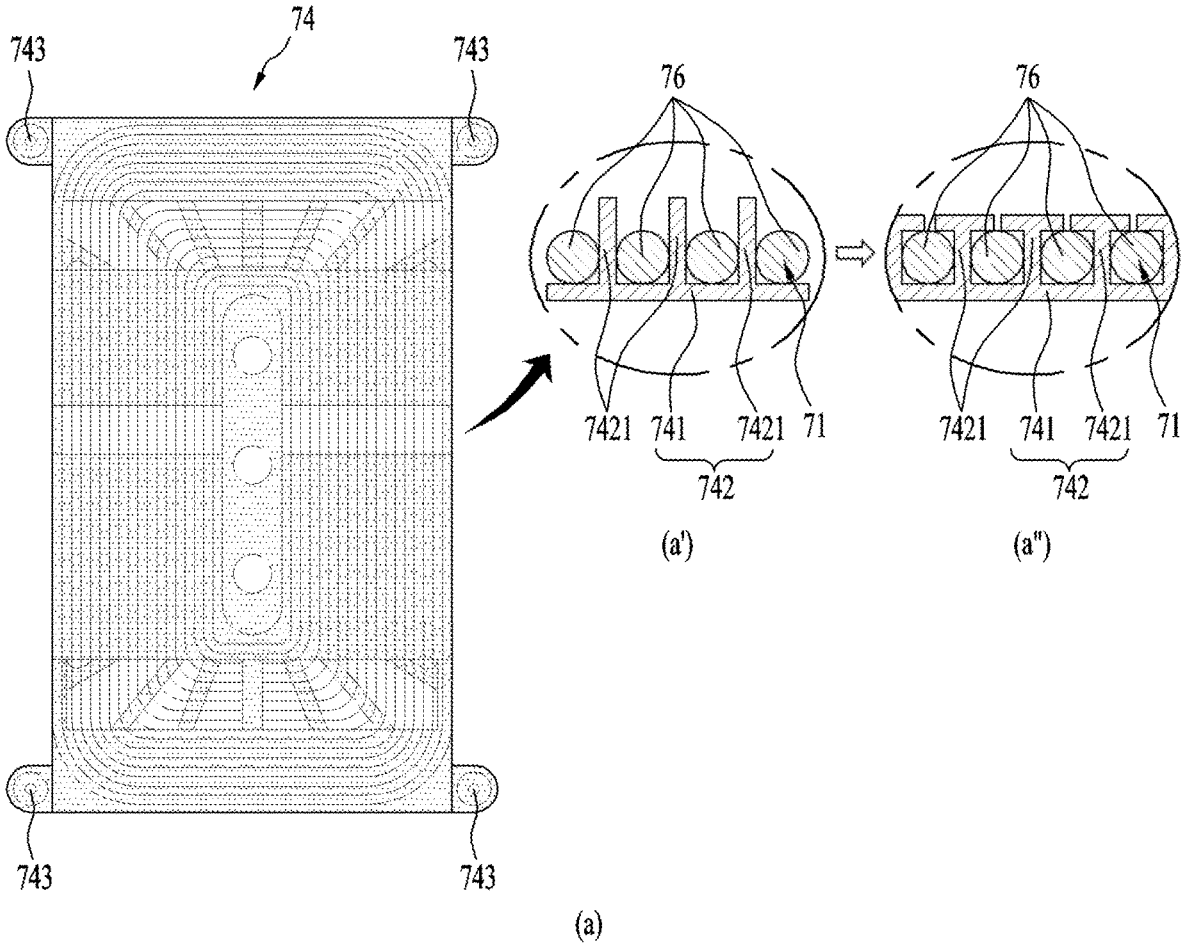
FIG. 12A is a plan view of a base housing according to one embodiment of the present disclosure.
Figure 12B:
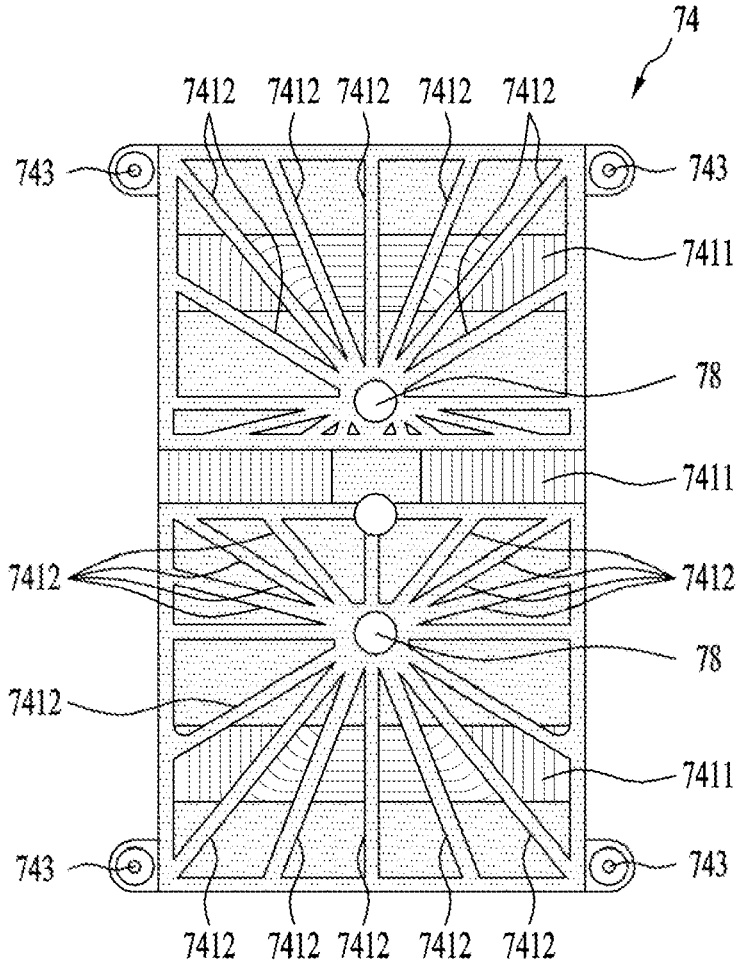
FIG. 12B is a bottom view of the base housing shown in FIG. 12A.

FIG. 12A shows the top surface of the base housing 74, and FIG. 12B shows the bottom surface of the base housing 74. FIG. 12 shows an example of the coil shown in FIG. 7.

Figure 13:
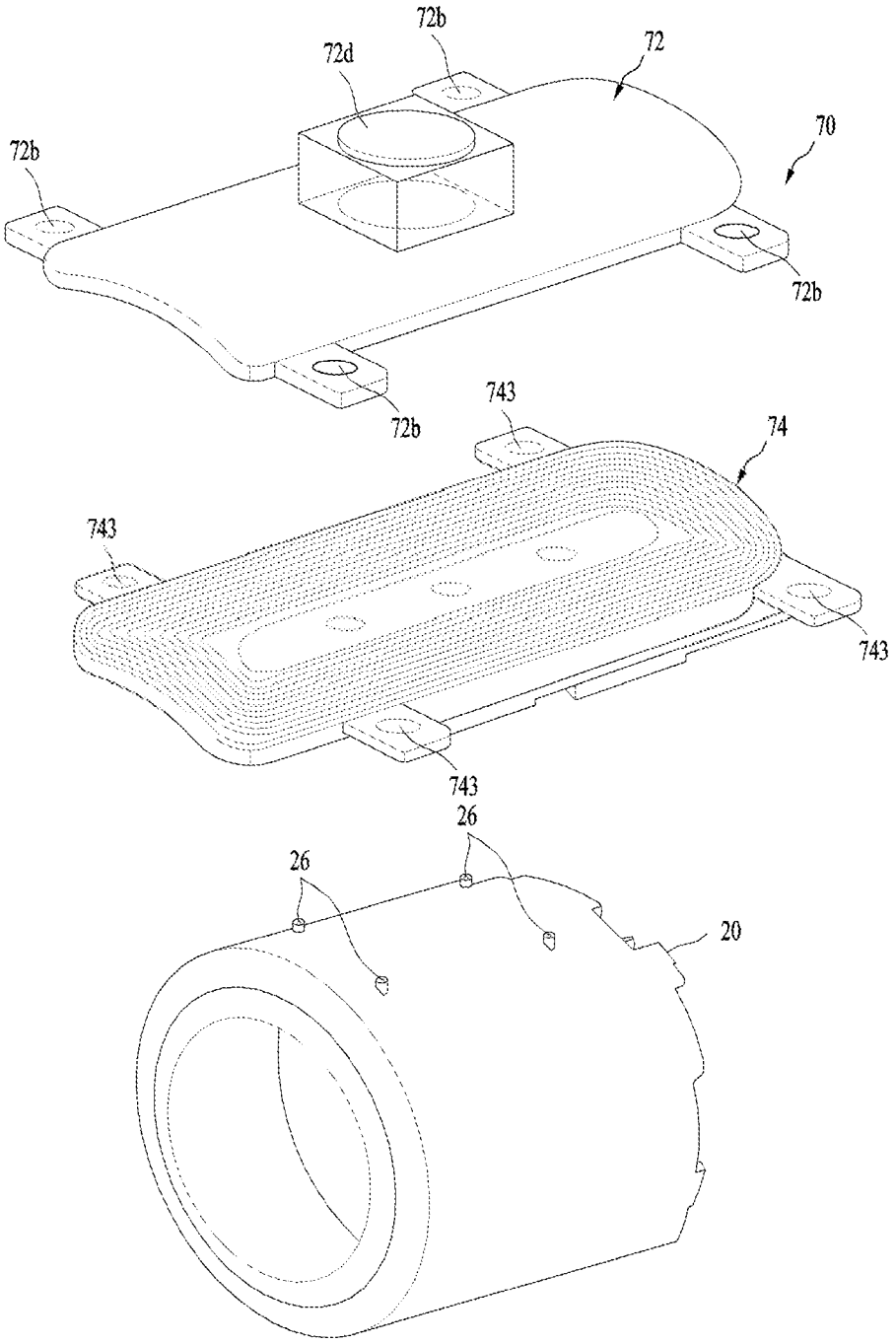
FIG. 13 is a perspective view of a state in which the tub and the induction module are separated from each other according to an embodiment of the present disclosure.

FIG. 13 shows the coupling of the base housing 74 and the module cover 72 and the mounting of the induction module 70 on the tub 20.

As shown in FIG. 12A, the base housing 74 is configured to accommodate the coil by defining a coil slot 742 in which the wire of the coil is received. The coil slot 742, may has a width that is less than the diameter of the wire 76, so that the wire 76 of the coil 71 is interference-fitted into the coil slot. The width of the coil slot 742 may be set to 93% to 97% of the diameter of the wire 76.

In the state in which the wire 76 is interference-fitted into the coil slot 742, even when the tub 20 vibrates, the wire 76 is fixed in the coil slot 742, and the coil 71 is therefore prevented from undesirably moving.

In this manner, the coil 71 is not separated from the coil slot 742, and undesirable movement thereof is suppressed. Therefore, it is possible to prevent the occurrence of noise attributable to a gap. Further, contact between adjacent portions of the wire is prevented, thereby preventing a short circuit and an increase in resistance attributable to deformation of the wire.

Further, the coil slot 742 may be formed by a plurality of fixing ribs 7421, which protrude upwards from the base housing 74. The height of the fixing ribs 7421 may be greater than the diameter of the coil 71. The base housing may comprise the fixing rib 7421 that protrudes upwards from the base housing and that defines the coil slot. The fixing rib is formed such that an upper end thereof is close contact with the cover. The fixing rib may has a height that is greater than a height of the wire. In a state in which the coil is accommodated in the base housing so that the wire of the coil is received in the coil slot of the base housing, an upper end of the fixing rib is configured to protrude inwards towards the wire and at least partially cover an upper portion of the wire.

The reason for this is to allow both sides of the coil 71 to be brought into close contact with the inner walls of the fixing ribs 7421 and to be securely supported by the same. This configuration is related to a process of melting or bending the upper ends of the fixing ribs 7421, which will be described later.

Through the above-described configuration, since adjacent portions of the wire 76 are spaced apart from each other by the fixing ribs 7421, a short circuit can be prevented, and the wire 76 does not need to be coated with a separate insulation film. Even if the wire 76 is coated with an insulation film, the thickness of the insulation film can be minimized. Accordingly, manufacturing costs can be reduced.

After the wire 76 is inserted into the coil slot, the upper ends of the fixing ribs 7421 may be melted in order to cover the upper portion of the coil 71. That is, the upper ends of the fixing ribs 7421 may be subjected to a melting process.

In this connection, the height of the fixing ribs 7421 may be set to 1 to 1.5 times the diameter of the wire 76 so as to cover the upper portion of the coil 71.

Specifically, after the wire is interference-fitted into the coil slot 742 as shown in FIG. 12A (a'), the upper surfaces of the fixing ribs 7421 may be pressed and melted. Subsequently, as shown in FIG. 12A (a"), the melted upper surfaces of the fixing ribs 7421 may be expanded to both sides so as to cover the upper portions of the wire 76 that are located at both sides of each of the fixing ribs 7421. In this connection, the fixing ribs 7421, which are adjacent to each other with the wire 76 interposed therebetween, may be melted so that the upper portion of the wire 76 is completely shielded in the coil slot 742, or may be melted so that a gap, which is less than the diameter of the wire 76, is formed above the wire 76.

In another embodiment, the fixing ribs 7421 may be melted to cover the upper portion of the wire 76 that is located at one side of each of the fixing ribs 7421, rather than the upper portions of the wire 76 that are located at both sides of each of the fixing ribs 7421. In this case, each of the fixing ribs 7421 may be melted so that, of the two adjacent portions of the wire 76, only a portion located at the inward position is covered, or only a portion located at the outward position is covered.

The reason why the upper ends of the fixing ribs 7421 are melted in addition to the interference-fitting of the coil 71 into the coil slot 742 is to physically block a path through which the wire 76 may escape and to prevent undesirable movement of the wire 76, thereby preventing the occurrence of noise attributable to vibration of the tub 20, eliminating gaps between parts, and consequently improving the durability of the parts.

The coil slot 742 may include a base 741, which is formed at the lower ends of the fixing ribs 7421 so that the coil 71 fitted between the adjacent fixing ribs 7421 can be seated thereon.

As shown in FIG. 12A (a"), the base 741 shields the bottom of the coil slot, and functions to press and fix the coil 71 together with the upper ends of the fixing ribs 7421 to which the melting process has been applied.

However, a portion of the base 741 may be open. This opening in the base 741 may be referred to as a penetration portion or a through-hole 7411, and will be described later.

Although the coil 71 has been described above as being provided on the top surface of the base housing 74, the fixing ribs 76 may be formed so as to protrude downwards from the base housing 74 so that the coil 71 is provided on the bottom surface of the base housing 74. In this case, even if an additional penetration portion is not formed in the base 741, the space formed by melting the fixing ribs 7421 may serve as the penetration portion.

FIG. 12B is a bottom view of the base housing 74. As shown in the drawing, the base housing 74 may have therein a penetration portion 7411, which is formed so as to penetrate the bottom surface and the top surface of the base housing 74. The penetration portion 7411 may be open so that the coil 71 can face the outer circumferential surface of the tub 20 therethrough, and may be formed according to the winding shape of the wire 76.

In the case in which the penetration portion 7411 is formed according to the winding shape of the wire 76, the magnetic field is smoothly radiated from the wire 76 in the direction toward the drum 30, so that heating efficiency can be increased. In addition, since air can flow through the open surface, the overheated coil 71 can be rapidly cooled.

As shown in FIG. 12B, a reinforcing rib or base support bar 7412 is formed on the bottom surface of the base housing 74 so as to extend across the penetration portion or the opening. The base housing 74 of the present disclosure may further include the reinforcing ribs or base support bars 7412. As least one base support bar is formed at a bottom surface of the base housing so as cross the at least one opening formed in the lower portion of the coil slot.

The reinforcing ribs 7412 may extend radially around fixing points 78, which are formed on both sides of a center point A of the base housing 74, so as to enhance the contact force between the outer circumferential surface of the tub 20 and the base housing 74.

In the case in which base-coupling portions 743, which are provided on both sides of the base housing 74, are fixed to tub-coupling portions 26 provided on the outer circumferential surface of the tub, the outer circumferential surface of the tub 20 is pressed by the reinforcing ribs 7412. Therefore, the base housing 74 can be more securely supported than when the entire bottom surface of the base housing 74 contacts the outer circumferential surface of the tub 20.

Accordingly, even when the tub 20 vibrates, the base housing 74 is not easily moved or separated from the outer circumferential surface of the tub 20.

Further, the base housing 74 may be formed so as to be curved corresponding to the outer circumferential surface of the tub 20 in order to enhance the coupling force between the base housing 74 and the outer circumferential surface of the tub 20.

In order to correspond to the above-described characteristics of the curved portion 71*c* of the coil 71 in which the inner coil portion and the outer coil portion have the same radius of curvature as each other, the top surface of the base housing 74, around which the wire 76 is wound, may be formed such that the curved portions of the fixing ribs 7421 have the same radius of curvature as each other.

The induction module 70 of the present disclosure may further include a module cover 72, which is coupled to the base housing 74 to cover the coil slot 742.

The cover 72, as shown in FIG. 13, is coupled to the top surface of the base housing 74, and serves to prevent separation of the coil 71 and magnets 80. The magnets 80 may be permanent magnets.

Specifically, the bottom surface of the cover 72 may be formed so as to come into close contact with the upper end of the coil slot 742 or the upper end of the fixing ribs formed in the base housing 74. Accordingly, the cover 72 is directly coupled to the base housing 74, and thus it can prevent undesirable movement, deformation and separation of the coil 71.

Figure 14A:
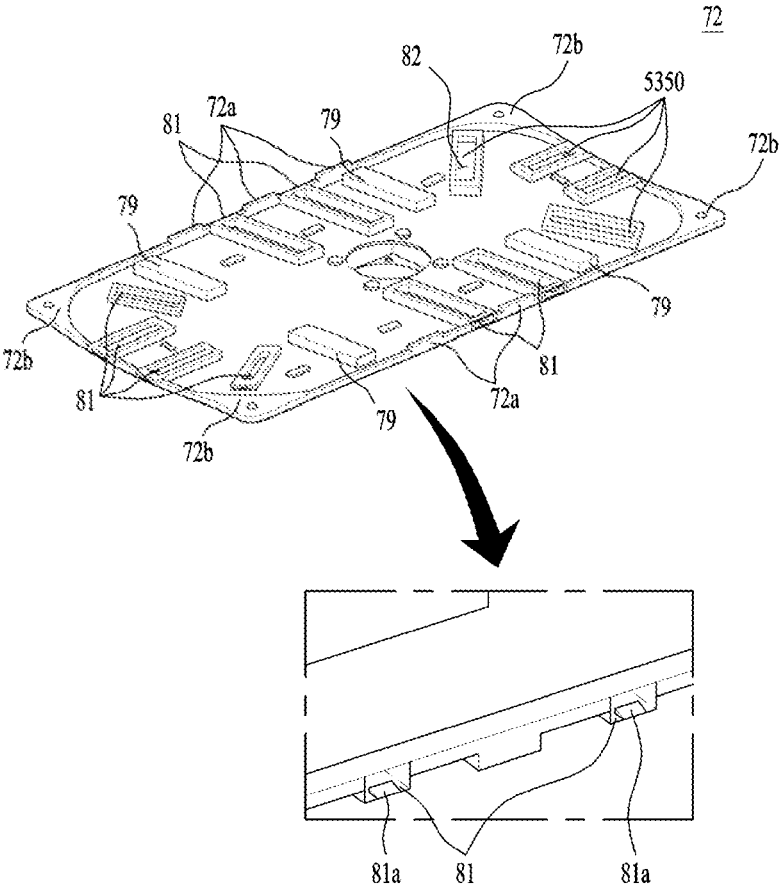
FIG. 14A is a perspective view showing a state in which a module cover is upside down according to an embodiment of the present disclosure.
Figure 14B:
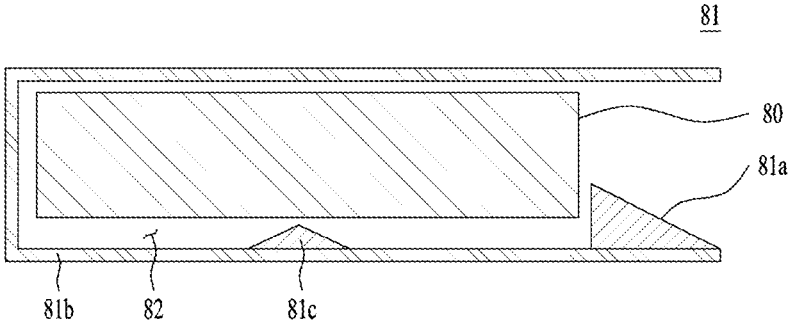
FIG. 14B is a cross-sectional view of a permanent magnet mount in FIG. 14A.

Further, as shown in FIG. 14A, the cover 72 may be provided with a plurality of press-contacting ribs 79, which protrude downwards from the bottom surface of the cover 72 so as to come into close contact with the upper end of the coil slot 742.

When the bottom surfaces of the press-contacting ribs 79 closely contact the coil slot 742, a larger amount of pressure can be applied to a small area than when the entire bottom surface of the cover 72 closely contacts the upper end of the coil slot 742. The press-contacting ribs 79 in this embodiment may be considered the same components as the coil-fixing portions 73 in the above-described embodiment.

Accordingly, the cover 72 can be more securely fixed on the outer surface of the tub 20, and thus it is possible to prevent noise or unexpected disengagement of parts attributable to gaps between the parts even when the tub 20 vibrates.

The press-contacting ribs 79 may be formed in the longitudinal direction of the coil 71. Alternatively, the press-contacting ribs 79 may be formed perpendicular to the longitudinal direction of the coil 71. Therefore, it is possible to securely fix the entire coil without pressing the entire coil.

In this connection, a spacing interval is required between the cover 72 and the coil 71. The reason for this is that it is desirable for air to flow for heat dissipation. The press-contacting ribs 79 block a portion of the spacing interval. Therefore, the press-contacting ribs form an air flow path as well as fix the coil.

In one example, it is desirable that the press-contacting ribs 79 be integrally formed with the cover 72. Therefore, the cover 72 is coupled to the base housing 74, and the press-contacting ribs 79 press the coil 71 simultaneously therewith. Therefore, a separate member or process of pressing the coil 71 is not necessary.

The permanent magnets 80 for focusing the magnetic field in the direction toward the drum may be interposed between the base housing 74 and the cover 72. The cover 72 may be provided with permanent-magnet-mounted portions 81, into which the permanent magnets 80 can be inserted and mounted. Therefore, when the cover 72 is coupled to the base housing 74 in the state in which the permanent magnets 80 are fixed to the cover 72, the permanent magnets can be fixed to the upper portion of the coil 71.

In order to efficiently focus the magnetic field in the direction toward the drum 30, the permanent magnets 80 may be disposed at specific positions on the top surface of the coil 71. If the permanent magnets 80 are moved by vibration of the tub 20, not only may noise occur, but heating efficiency may also be lowered.

The permanent magnets 80 can be fixed to the positions where the permanent magnets 80 are initially disposed between the base housing 74 and the cover 72 by the permanent-magnet-mounted portions 81, and thus deterioration in heating efficiency can be prevented.

More specifically, each of the permanent-magnet-mounted portions 81 includes both side walls, which protrude downwards from the bottom surface of the cover 72 so as to face each other, and a lower opening 82, through which the bottom surface of the permanent magnet 80 mounted in the corresponding permanent-magnet-mounted portion 81 can face one surface of the coil 71.

In this case, the lateral movement of the permanent magnet 80 may be suppressed by both side walls of the permanent-magnet-mounted portion 81, and the lower opening 82 may allow the permanent magnet 80 to more closely approach to the top surface of the coil 71.

The closer the permanent magnet 80 is to the coil 71, the more intensively the magnetic field is guided toward the drum 30, and as a result, stable and uniform heating of the drum 30 is achieved.

The permanent-magnet-mounted portion 80 may further include an inner wall 81*b*, which protrudes downwards from the bottom surface of the cover 72 so as to be connected with the ends of the both side walls, an open surface, which is formed opposite the inner wall, and a latching portion 81*a*, which is formed near the open surface in order to prevent the permanent magnet 80 from being separated from the cover 72.

The movement in the forward-and-backward direction of the permanent magnet 80 can be suppressed by the inner wall 81*b* and the latching portion 81*a*. Therefore, as described above, stable and uniform heating of the drum 30 can be achieved. In addition, in the case in which the temperature of the permanent magnet 80 is increased by the overheated coil 71, it is also possible to dissipate heat through the open surface.

The base housing 74 may further include a permanent magnet pressing portion 81*c*, which protrudes upwards into the space defined by the lower opening 82 in order to press the bottom surface of the permanent magnet 80. The permanent magnet pressing portion 81*c* may be implemented by a plate spring or a projection made of a rubber material.

When the vibration of the tub 20 is transferred to the permanent magnet 80, noise may be generated from the permanent magnet 80 due to a gap, which may be formed between the coil slot 742 and the permanent-magnet-mounted portion 81.

The permanent magnet pressing portion 81*c* prevents the occurrence of noise by alleviating vibration, and prevents the formation of a gap, thereby preventing damage to the permanent magnet 80 and the permanent-magnet-mounted portion 81 attributable to vibration.

In order to enhance the coupling force and to stably heat the drum 30, the lower end of the permanent-magnet-mounted portion 81 may be formed so as to closely contact the upper end of the coil slot 742.

In this case, since the bottom surface of the permanent magnet 80 is located relatively close to the coil 71 as described above, the drum 30 can be more evenly heated. Further, the bottom surface of the permanent magnet 80 also functions as the press-contacting rib 79, and thus enhances the coupling force between the cover 72 and the base housing 74.

In addition, in the case in which the base housing 74 is formed so as to be curved corresponding to the outer circumferential surface of the tub 20, the cover 72 may also be formed so as to be curved with the same curvature as the base housing 74.

In another embodiment of the present disclosure, the permanent-magnet-mounted portion 81 may be provided at the base housing 74.

The base housing 74 may be formed such that the permanent-magnet-mounted portion 81 is provided on the fixing ribs 7421. In this connection, the permanent magnet pressing portion 81*c* may be provided at the bottom surface of the cover 72.

FIG. 13 shows the coupling structure of the tub 20, the base housing 74 and the cover 72. As shown in the drawing, the tub 20 includes the tub-coupling portions 26, the base housing 74 includes the base-coupling portions 743, and the cover 72 includes the cover-coupling portions 72*b*.

The tub-coupling portions 26 have therein tub-coupling holes, the base-coupling portions 743 have therein base-coupling holes, and the cover-coupling portions 72*b* have therein cover-coupling holes. The above coupling holes may be formed to have the same diameter as each other. Accordingly, the tub 20, the base housing 74 and the cover 72 may be coupled to each other using one type of screw.

As a result, the assembly process may be simplified, and manufacturing costs may be reduced.

In addition, in the case in which the both end portions B1 and B2 of the coil are disposed near the front and rear portions of the tub 20, the tub-coupling portion 26, the base-coupling portion 743 and the cover-coupling portion 72*b* may be formed such that the above coupling holes are located at both sides of the coil 71 in order to secure the mounting space.

In addition, the cover 72 may further include cover-mounting ribs 72*a*, which protrude downwards from both side edges thereof, so that the cover 72 can be easily mounted in place in the base housing 74 and so that the lateral movement of the cover 72 can be prevented.

In one example, the cover 72 may be provided with a fan-mounted portion 72*d*. The fan-mounted portion 72*d* may be formed at the center of the cover 72.

Air may be introduced into the cover 72, i.e. into the induction module, through the fan-mounted portion. Since a space is formed between the cover 72 and the base housing 74 inside the induction module, an air flow path is formed. The base housing has therein the penetration portion or the opening. Thus, the air may cool the coil 71 in the inner space, and may be discharged outside the induction module through the penetration portion or the opening in the base housing.

In the embodiment of the present disclosure, although the induction module 70 has been described above as being provided on the outer circumferential surface of the tub 20, the induction module 70 may alternatively be provided on the inner circumferential surface of the tub 20, or may form the same circumferential surface together with the outer wall of the tub 20.

In this connection, it is desirable that the induction module 70 be located as close to the outer circumferential surface of the drum 30 as possible. That is, the magnetic field generated by the induction module 70 is significantly reduced as the distance from the coil increases.

Hereinafter, embodiments of the structure for reducing the distance between the induction module 70 and the drum will be described. The features of these embodiments may be realized in combination with the above-described embodiments.

A module-mounted portion 210, which is located on the outer circumferential surface of the tub 20 and on which the induction module 70 is mounted, may be formed further radially inwards than the outer circumferential surface of the tub 20 having a reference radius. In an embodiment, the module-mounted portion 210 may form a surface that is depressed from the outer circumferential surface of the tub.

As described above, if the distance between the module-mounted portion 210 and the drum 30 is reduced, the heating efficiency of the induction module 70 can be increased. In the case in which a constant alternating current flows through the induction module 70, the change in intensity of the alternating current magnetic field generated by the coil 71 is constant. However, the change in intensity of the alternating current magnetic field is significantly reduced as the distance increases. Accordingly, if the distance between the module-mounted portion 210 and the drum 30 is reduced, the intensity of the induced magnetic field generated by the alternating current magnetic field is increased, and a strong induced current may flow through the drum 30, thereby increasing induction heating efficiency.

In the case in which the laundry treatment apparatus is a drum washing machine, it is desirable that the module-mounted portion 210 be located at the upper portion of the tub 20. The module-mounted portion 210 may be in close contact with and fixed to the tub 20 in consideration of the weight of the induction module 70. Further, because the drum 30 is inclined downwards by the weight thereof according to the rotation structure thereof, when the module-mounted portion is located at the upper portion of the tub 20, collision with the drum 30 may be minimized. However, in the case in which the laundry treatment apparatus is a top-loading-type washing machine, the position of the module-mounted portion does not need to be limited to the upper or lower portion.

The portion of the inner circumferential surface of the tub 20 that faces the module-mounted portion 210 may be formed further radially inwards than the inner circumferential surface of the tub having the reference radius. That is, in the case in which a portion of the outer circumferential surface of the tub 20 is depressed in the inward direction, the thickness between the inner circumferential surface and the outer circumferential surface of the tub 20 at the depressed portion may be decreased. In other words, at least part of the at least one mounted portion is arranged radially closer to a rotation axis of the drum than a remaining portion of the outer surface of the tub. The at least one mounted portion is located at an upper portion of the tub.

In this case, since the strength of the depressed portion may be decreased, the portion of the inner circumferential surface of the tub 20 that faces the module-mounted portion 210 is formed further radially inwards than the inner circumferential surface of the tub having the reference radius so that the thickness between the inner circumferential surface and the outer circumferential surface of the tub can be maintained constant. However, it is desirable that a portion of the inner circumferential surface of the tub 20, which faces the module-mounted portion 210, be provided radially outside the outer circumferential surface of the rotating drum 30.

In other words, the thickness of the circumferential surface of the tub corresponding to the module-mounted portion 210 may be made smaller than the thickness of other portions of the tub. However, it is desirable to maintain a substantially constant thickness. Therefore, the inner circumferential surface and the outer circumferential surface of the tub at the portion corresponding to the module-mounted portion 210 are located further radially inwards than the inner circumferential surface and the outer circumferential surface of the tub at other portions. That is, the portion of the tub that corresponds to the module-mounted portion 210 may be formed in a depressed shape. In one example, the module-mounted portion 210 may have an entirely depressed shape or a partially depressed shape. More specifically, only a portion of the module-mounted portion 210 that faces the coil may be formed in a depressed shape. Similarly, a portion of an inner surface of the tub that corresponds to a location of the at least one mounted portion is arranged radially closer to the rotational axis of the drum than a remaining portion of the inner surface of the tub.

The module-mounted portion 210 may be formed so as to extend from the front side to the rear side of the tub. However, in the case in which the module-mounted portion has a length shorter than the length in the forward-and-backward direction of the tub, it may be located at the center of the length in the forward-and-backward direction of the tub. When the induction module is located at the center portion, heat can be evenly generated in the drum.

Figure 15:
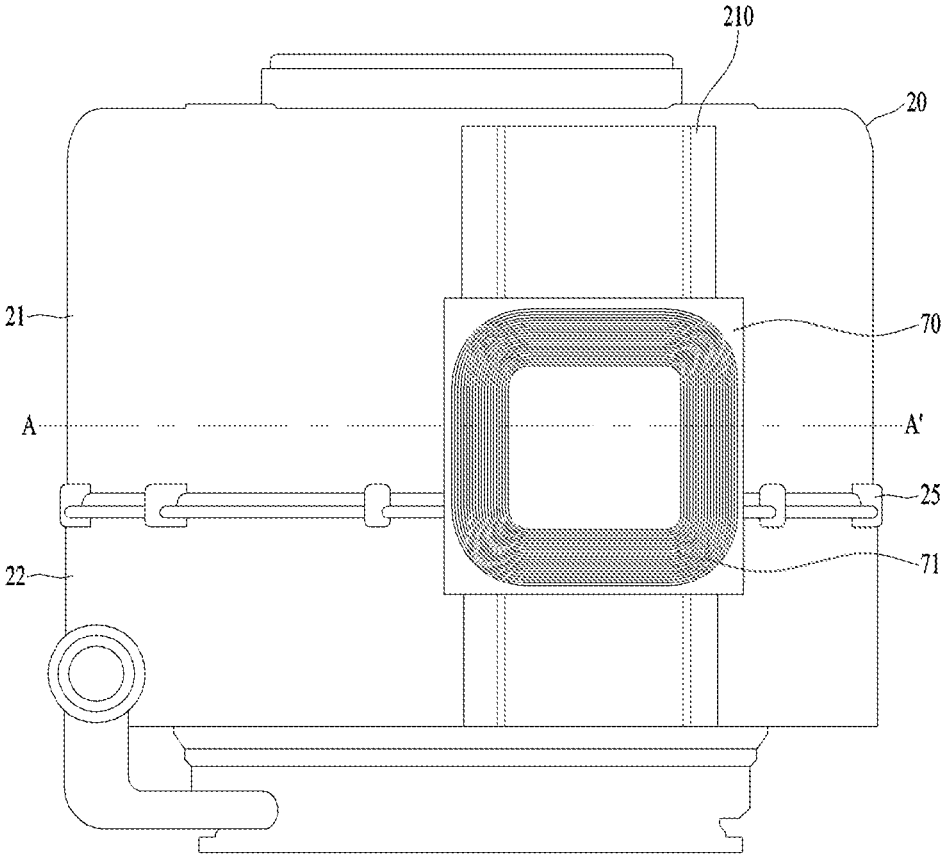
FIG. 15 is a plan view showing an induction module and an induction module mount according to an embodiment of the present disclosure.
Figure 16:
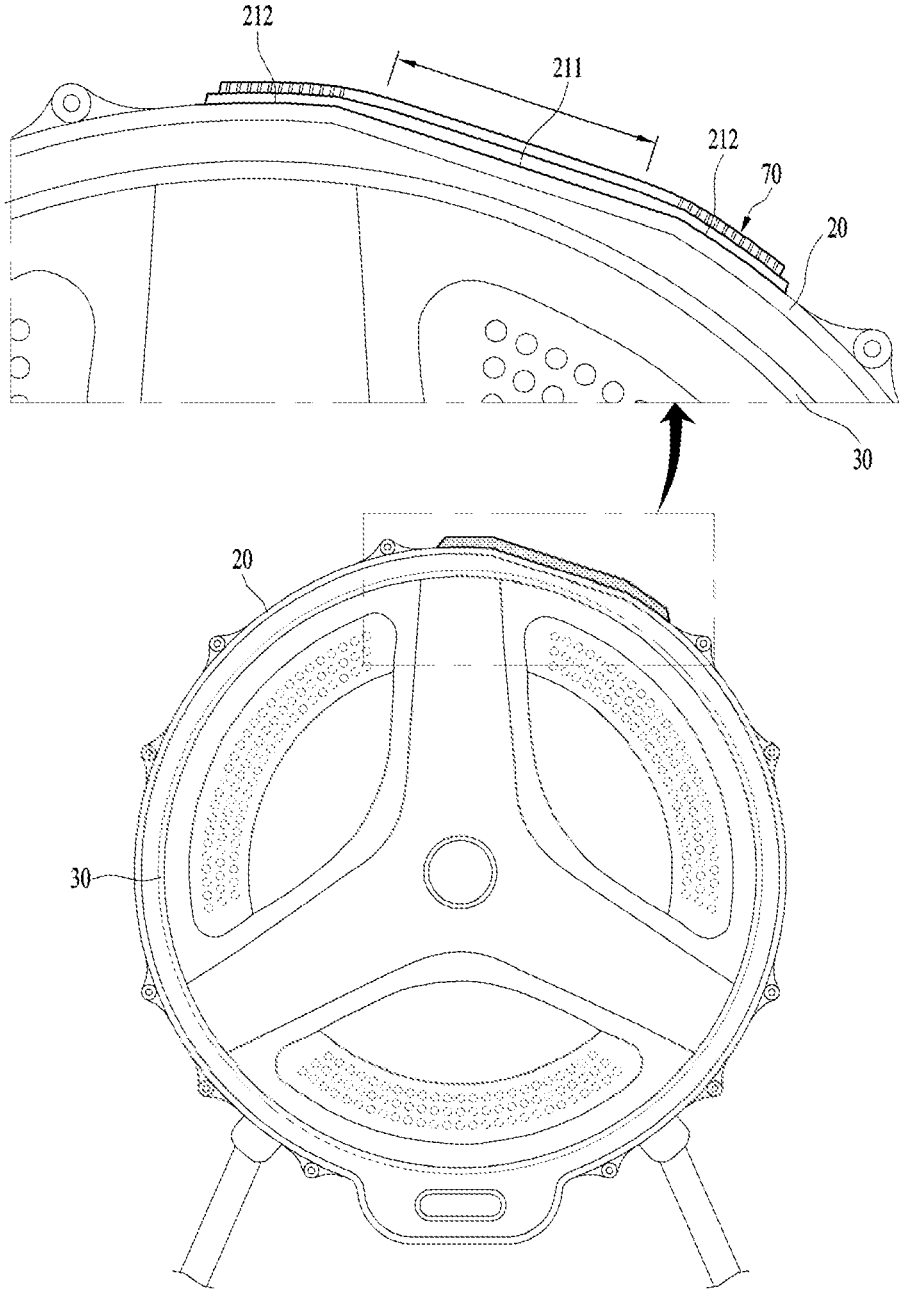
FIG. 16 is a sectional view taken along a line A-A' in FIG. 15.

Hereinafter, an embodiment of the module-mounted portion 210, on which the induction module 70 is mounted, will be described with reference to FIGS. 15 and 16. In addition, the structure for mounting the induction module 70 to the module-mounted portion 210 will be described.

In order to be formed further radially inwards than the outer circumferential surface of the tub 20 having the reference radius, the module-mounted portion 210 may include a straight region 211 in the cross-section thereof that is perpendicular to the rotational axis of the drum 30. For example, each of the cylindrical-shaped tub 20 and the cylindrical-shaped drum 30 has a circular-shaped cross-section (the section A-A' in FIG. 15). The circular-shaped cross-section of the tub has substantially the same radius throughout the circumference thereof. The circular-shaped cross-section of the drum also has substantially the same radius throughout the circumference thereof. Therefore, the straight region 211 may be formed in a portion of the circular-shaped cross-section of the tub. Thus, the straight region may be regarded as a portion corresponding to a zero gradient in the mold for forming the tub. This straight region or zero gradient may be formed in order to further reduce the distance between the coil and the drum. In other words, an outer surface of at least one region of the at least one mounted portion is flat. At least one region of the at least one mounted portion has a rectangular-shape.

Generally, the drum 30 may be formed in a cylindrical shape in order to secure the maximum accommodation space while requiring the minimum volume when rotating. In this connection, in the case in which the tub 20 also has a cylindrical shape, the interval between the outer circumferential surface of the tub 20 and the drum 30 is constant.

However, the module-mounted portion 210 includes the straight region 211, and the distance between the straight region 211 and the center of the tub may be set to be less than the radius of the tub. In one example, the distance between the straight region and the center of the tub may vary within a range smaller than the interval between the outer circumferential surface of the tub 20 having the reference radius and the drum 30. The straight region may be said as a flat region.

The module-mounting region 210 may include a rectangular-shaped surface, and the straight region 211 may form a width in the circumferential direction of the rectangular-shaped surface. However, the shape of the module-mounted portion 210 is not limited to a rectangular shape. Depending on the circumstances, the shape of the module-mounted portion 210 may include a circular shape, a diamond shape, an oblique rectangular shape, and the like.

In the case in which the module-mounted portion 210 forms a rectangular-shaped surface, the manufacture of the induction module 70 and the installation thereof on the module-mounted portion may be facilitated.

In this connection, the rectangular-shaped surface may be formed such that the width in the axial direction thereof is greater than the width in the circumferential direction thereof. The width in the circumferential direction of the rectangular-shaped surface is inevitably limited in consideration of the distance from the drum 30. Therefore, it is desirable to increase the area on which the induction module 70 can be mounted by increasing the width in the axial direction.

The straight region of the module-mounted portion 210, i.e. the straight region formed in the circumferential direction of the tub, may include connection regions 212 for connecting both ends of the straight region to the circumferential surface of the tub 20. In this connection, the connection regions 212 may be formed in a curved or straight shape. In this case, the connection regions 212 may also be formed further radially inwards than the outer circumferential surface of the tub 20 having the reference radius in order to reduce the distance from the outer circumferential surface of the drum 30.

The length of the straight region 211 may be limited in consideration of the distance from the drum 30, and the width in the circumferential direction of the induction module 70 may exceed the straight region 211.

Due to the connection regions 212 formed at the both ends of the straight region 211 so as to be connected with the circumferential surface of the tub 20, the area of the module-mounted portion 210 can be increased, and the distance from the drum 30 can be reduced.

The coil 71 of the induction module 70 may be mounted parallel to the module-mounted portion 210 in order to minimize the distance from the drum 30. Specifically, the induction module 70 may include a coil 71, which receives electric energy to form a magnetic field, and the coil 71 may be arranged so as to be wound at least once while being spaced apart from the module-mounted portion 210. Thus, the distance between the coil 71, which forms the magnetic field, and the drum 30, through which induced current flows, may be reduced.

The induction module 70 may be located at the center of the straight region 211. Specifically, the center portion of the coil 71 of the induction module 70 may be located in a virtual plane, which includes the rotational axis of the drum 30 and is perpendicular to the straight region 211.

That is, the coil 71 of the induction module 70 is provided on the module-mounted portion 210 such that the center portion thereof is the closest to the drum 30 and such that the distance from the drum 30 is gradually increased from the center portion to both ends thereof.

Specifically, the distance from the center of the straight region 211 to the drum 30 is minimized, and the distance from the drums 30 is gradually increased from the center of the straight region 211 to both sides thereof. In this case, the magnetic field generated by the coil 71 wound in the circumferential direction of the tub 20 generates a strong induced current in the drum 30.

When the entire module-mounted portion 210 has the same curved shape as the tub, the distance between the coil and the drum is constant, e.g. about 30 mm, in the circumferential direction. For example, the connection regions 212 shown in FIG. 16 are curved regions that have the same curved shape as the tub. Therefore, the distance between the coil and the outer circumferential surface of the drum in the curved regions is constant, e.g. about 30 mm.

However, in the straight region 211, the distance between the coil and the outer circumferential surface of the drum may vary in the range from about 24 to 30 mm. For example, the distance between the coil and the outer circumferential surface of the drum at the center of the straight region may be about 24 mm, and the distance at both ends of the straight region may be about 28 mm. Therefore, the distance from the outer circumferential surface of the drum is substantially reduced in a large portion of the entire area of the coil.

The straight region 211 in the above embodiment may be formed at the center of the module-mounted portion 210. Therefore, it is possible to further concentrate the coil at the portion corresponding to the straight region 211.

Figure 17:
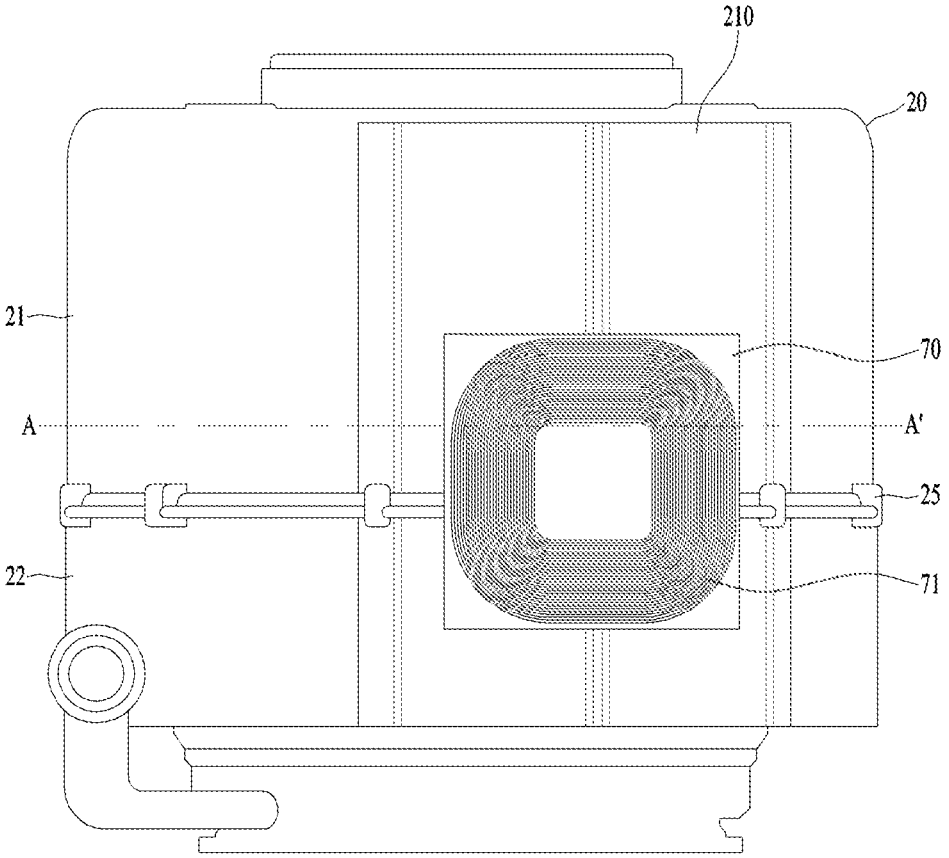
FIG. 17 is a plan view showing an induction module and an induction module mount according to an embodiment of the present disclosure.

Hereinafter, an embodiment of the module-mounted portion 210, on which the induction module 70 is mounted, will be described with reference to FIGS. 17 and 18. In addition, the structure of mounting the induction module 70 to the module-mounted portion 210 will be described.

In order to be formed further radially inwards than the outer circumferential surface of the tub 20 having the reference radius, the module-mounted portion 210 may include a first straight region 211*a* and a second straight region 211*b* in the cross-section thereof that is perpendicular to the rotational axis of the drum 30. In this connection, the first straight region and the second straight region may be located at positions further radially inward than the reference radius of the tub. In this connection, the first straight region and the second straight region may be considered zero gradients.

In this connection, the first straight region 211*a* and the second straight region 211*b* may be connected to each other via a connection region 212. The connection region 212 may be formed in a curved or straight shape.

Each of the first straight region 211*a* and the second straight region 211*b* may form a width in the circumferential direction of a rectangular-shaped surface included in the module-mounted portion 210. In this connection, the rectangular-shaped surface is formed to facilitate the formation and the installation of the induction module 70, and is not limited to the rectangular shape.

That is, the module-mounted portion 210 may be formed such that at least two rectangular-shaped surfaces are connected to each other. In other words, two straight regions located at both sides may be connected to each other via a curved region located at a center portion. The module-mounted portion 210 may be formed by combining the straight regions and the curved region.

The straight region 211 cannot be formed over a predetermined length in consideration of the interval between the drum 30 and the tub 20. Therefore, the module-mounted portion 210, which includes the first straight region 211*a* and the second straight region 211*b*, can form a large area in the circumferential direction without being in contact with the drum 30.

In one example, both ends of the straight region 211 or one end of the straight region 211 may be provided outside the reference radius of the tub. In this case, the region provided outside the reference radius of the tub may be considered a region extending in the radial direction of the tub. However, this extending region may be only a portion for mounting the induction module on the base housing 74. That is, the coil may not be located in the extending region. This is because the coil 71 is located inside the base housing 74 so that the edges of the base housing 74 surround the coil 71. In other words, a spacing interval is provided between the coil 71 and the outermost edge of the base housing 74, and the spacing interval may be opposite the extending region.

The length of the first straight region 211*a* and the length of the second straight region 211*b* may be equal to each other. The length of the straight region 211 means the distance from the drum 30. When the length is short, the distance from the drum 30 is long. Thus, it is desirable that the first straight region and the second straight region be formed symmetrical to each other. Through this configuration, it is possible to easily from the induction module and to securely fix the induction module to the module-mounted portion.

The induction module 70 may be provided over the first straight region 211*a* and the second straight region 211*b* of the module-mounted portion 210. Specifically, both ends in the circumferential direction of the induction module 70 are located at the centers of the first straight region 211*a* and the second straight region 211*b*, and the center of the induction module 70 is located in the region to which the first straight region 211*a* and the second straight region 211*b* are connected.

In this connection, the coil 71 of the induction module 70 may be formed so as to be wound at least once between the front side of the tub 20 and the rear side thereof around the connection region 212. In this connection, in the case in which the coil 71 is wound parallel to the module-mounted portion 71, the induction module may be located closest to the drum 30 at both ends in the circumferential direction of the tub, and the distance from the drum 30 may be gradually increased from the both ends in the circumferential direction of the tub to the center portion thereof.

In this case, the magnetic field generated by the coil 71 wound in the axial direction of the tub 20 generates a strong induced current in the drum 30.

When the entire module-mounted portion 210 has the same curved shape as the tub, the distance between the coil and the drum is constant, e.g. about 30 mm, in the circumferential direction. For example, the connection region 212 shown in FIG. 18 is a curved region that has the same curved shape as the tub. Therefore, the distance between the coil and the outer circumferential surface of the drum in the curved region is constant, e.g. about 30 mm.

However, in the first straight region 211*a*, the distance between the coil and the outer circumferential surface of the drum may vary in the range from about 24 to 30 mm. For example, the distance between the coil and the outer circumferential surface of the drum at the center of the straight region may be about 24 mm, and the distance at both ends of the straight region may be about 26 mm. Therefore, the distance from the outer circumferential surface of the drum is substantially reduced in a large portion of the entire area of the coil.

Therefore, in the above-described embodiments, efficiency can be increased by reducing the distance between the coil and the outer circumferential surface of the drum by forming the module-mounted portion 210 to have a straight region in the circumferential direction of the tub. In particular, the straight region may be matched with the shape of the base housing forming the coil. The module-mounted portion and the tub may be more securely coupled to each other through the combination of the straight region and the curved region.

In the above-described embodiments, it has been described that it is desirable for the coil to have a hollow center portion. In particular, referring to FIG. 12, the center portion of the coil is hollow in a track shape. Such a hollow portion may correspond to the curved region, i.e. the connection region 212, in FIG. 18. Therefore, the portion where the coil is formed may substantially correspond to the straight region. Therefore, it is more desirable to form straight regions at the left and right portions of the module-mounted portion 210 and to form a curved region between the straight regions, i.e. at the lateral center of the module-mounted portion.

Figure 19:
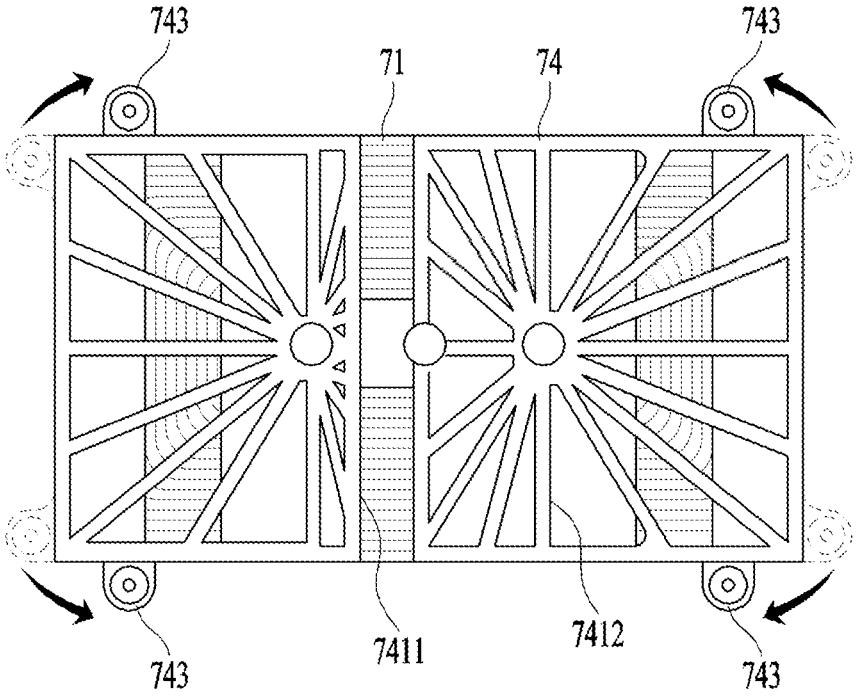
FIG. 19 is a bottom view of a base housing according to one embodiment of the present disclosure.

Hereinafter, the structure of the induction module 70, particularly the structure and position of the coupling portions 743 of the base housing 74 will be described in detail with reference to FIG. 19.

As described above, the induction module 70 may be formed long in the axial direction of the drum 30. The length of the straight region 211 of the module-mounted portion 210, on which the induction module 70 is mounted, is limited, and thus it is desirable for the induction module to evenly heat the drum 30 with a minimum area in consideration of the rotating direction of the drum 30.

In this connection, the length in the axial direction of the coil 71 may be shorter than the length of the drum 30, which can be heated, by about 20 to 40 mm. Specifically, the coil 71 may be formed so as to be spaced apart from the front and rear sides of the drum, which can be heated, by about 10 to 20 mm.

The base housing 74 may be coupled to the outer circumferential surface of the tub 20 or the module-mounted portion 210 through the coupling portions 743, which protrude from both ends in the circumferential direction thereof and extend in the circumferential direction. In this connection, the coupling portions 743 may be provided at both ends in the circumferential direction of the front and rear sides of the base housing 74.

In the above-described embodiment, the coupling portions 743 are located at the front portion and the rear portion of the base housing 74. This arrangement position of the coupling portions 743 may effectively prevent the base housing 74 from moving in the forward-and-backward direction of the tub. However, in this case, it is not possible to effectively prevent the base housing 74 from moving in the circumferential direction of the tub.

For this reason, this embodiment proposes an example in which the coupling portions 743 protrude from both lateral sides of the base housing in the circumferential direction. That is, according to this example, the length of the base housing 74 surrounding the outer circumferential surface of the tub is further increased by the coupling portions 743. As described above, the base housing 74 and the module-mounted portion 210 may be formed through the combination of the straight region and the curved region on the outer circumferential surface of the tub in the circumferential direction. Therefore, the base housing 74 may be more securely coupled and fixed to the tub merely by extending the coupling portions 743 without extending the base of the base housing 74 in the circumferential direction. In other words, it is possible to more securely couple and fix the base housing by forming the coupling portions at the front end and the rear end of both sides of the base housing, rather than forming the coupling portions at both ends of the front and rear portions of the housing.

Further, due to this arrangement position of the coupling portions, the base housing 74 may be formed as long as possible in the axial direction while securing a space in the base housing 74 for accommodating the coil 71 therein. In addition, the distance between the base housing 74 and the drum 30 may be minimized by bringing the base housing 74 into close contact with the cylindrical-shaped tub 20.

Further, the coupling portions 743 may correspond to the straight region of the module-mounted portion 210. That is, the coupling portions and the module-mounted portion may be formed such that the horizontal surfaces thereof are in contact with each other. That is, the module-mounted portion may further include straight regions corresponding to the coupling portions 743 of the base housing, or the existing straight region of the module-mounted portion may be further extended. Through this configuration, the base housing may be more stably mounted on the module-mounted portion, which is a part of the outer circumferential surface of the tub.

Hereinafter, the structures of a tub connector 25 of the tub 20 and the base housing 74 will be described with reference to FIG. 20A.

In accordance with manufacturing convenience and respective functions, the tub 20 includes a front tub 22, which surrounds the front portion of the drum 30, a rear tub 21, which surrounds the rear portion of the drum 30, and a tub connector 25, which connects the front tub 22 and the rear tub 21 to each other and is formed in the circumferential direction of the tub 20. The induction module 70 may be provided over the front tub 22 and the rear tub 21. The tub connector 25 may be located at the approximate center in the forward-and-backward direction of the tub 20.

The tub connector 25 may be a portion that protrudes from the outer circumferential surfaces of the front tub 22 and the rear tub 21 to the greatest extent in the radial direction. In other words, since the tub connector 25 is a portion to which the front tub 22 and the rear tub 21 are coupled, it may be extended radially outwards to increase the coupling area. The tub connector 25 may be formed over the entire outer circumferential surface of the tub in the circumferential direction thereof.

Thus, when the induction module is mounted on the outer circumferential surface of the tub, interference between the induction module and the connecting portion may occur. In order to avoid this interference, the induction module must be provided radially outside the connecting portion. Therefore, the interval between the induction module and the drum is inevitably increased.

Therefore, it is necessary to reduce the distance by which the induction module 70 is separated by the tub connector 25 in order to increase the induction heating efficiency.

The induction module 70 includes reinforcing ribs 7412, which protrude downwards from the bottom surface of the base housing 74 and compensate for the gap between the outer circumferential surface of the tub 20 and the bottom surface of the base housing 74. The reinforcing ribs may be formed in front of and behind the tub connector 25 protruding from the outer circumferential surface of the tub. The protruding length of the tub connector 25 and the protruding length of the reinforcing ribs are set to be equal to each other. Accordingly, the reinforcing ribs compensate for the gap between a portion of the base housing 74, which is not in contact with the tub connector 25, and the outer circumferential surface of the tub 20. In this connection, the reinforcing ribs may be formed in a portion of the base housing 74, which is not in contact with the tub connector 25, in the radial direction, thereby increasing the strength of the base housing 74.

In other words, the tub connector 25 may be formed so as to come into contact with the bottom surface of the base 741 of the base housing 74. That is, the tub connector 25 may perform the same function as the reinforcing ribs 7412. Therefore, the base housing 74 may also be more securely coupled to the tub 20 through the tub connector 25.

The tub connector 25 may include a first coupling rib 211 and a second coupling rib 221. That is, the first coupling rib 211 and the second coupling rib 221 may be joined to each other to form the tub connector 25. The first coupling rib 211 may be formed at the front tub 22, and the second coupling rib 221 may be formed at the rear tub 21. In one example, the opposite is also possible. The tub connector 25 will be described based on an example in which the first coupling rib 211 is formed at the rear tub 21 and the second coupling rib 221 is formed at the front tub 22 for convenience of explanation.

A portion of the tub connector 25 is located under the induction module 70. That is, a portion of the connecting portion formed in the circumferential direction of the tub, which corresponds to a certain angle, is located under the induction module. This portion is also referred to as the module-mounted portion.

The first coupling rib 211 may protrude radially outwards from a portion near the distal end (the front end) of the rear tub 21, and may then be bent to form an insertion groove. The second coupling rib 221 may be formed so as to protrude radially outwards from a portion near the distal end (the rear end) of the front tub.

The first coupling rib 211 forms an insertion groove together with the distal end of the rear tub 21. The distal end of the front tub 22 may be inserted into the insertion groove. A sealing member such as a rubber packing may be inserted into the insertion groove. Therefore, when the distal end of the front tub 22 is inserted into the insertion groove, the sealing member may be compressed, and may perform a sealing function.

Figure 20A:
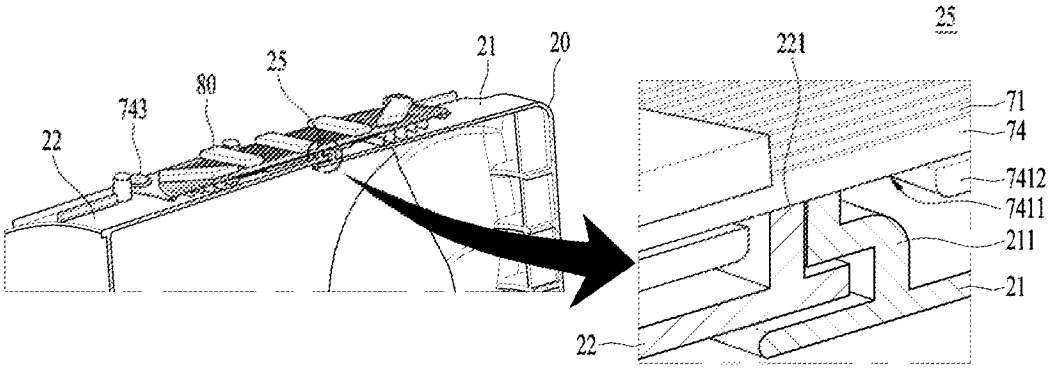
FIG. 20A shows an embodiment of a connector between the front tub and rear tub and a coupling of the tub with the base housing via the connector.

As shown in FIG. 20A, the distal end of the first coupling rib 211 may be bent radially outwards. The second coupling rib 221 may protrude radially outwards so as to come into contact with the first coupling rib 211. The coupling area in the tub connector 25 may be increased due to the shapes of the first coupling rib 211 and the second coupling rib 221. That is, the coupling area may be increased by the radially-extending portion. However, in this case, the protruding length of the connecting portion is inevitably increased. Thus, the distance between the coil 71 and the drum 20 is also increased.

Therefore, the base housing 74 may be provided therein with a penetration portion 7411, into which the tub connector 25 is inserted. The base housing 74 is fixed by inserting the tub connector 25 into the penetration portion 7411. Thus, the coil may become closer to the outer circumferential surface of the tub. That is, the coil is substantially brought into contact with the radially outer surface of the connecting portion, with the result that the gap between the coil and the outer circumferential surface of the tub may be minimized.

In this case, the base of the base housing may be omitted from the penetration portion, and only the coil slot may be formed therein. Therefore, the coil may also be provided in the penetration portion, and may be brought into contact with the radially outer surface of the connecting portion. To this end, the radially outer surface of the first coupling rib 211 and the radially outer surface of the second coupling rib 221 may be formed to have the same radius as each other.

Figure 20B:
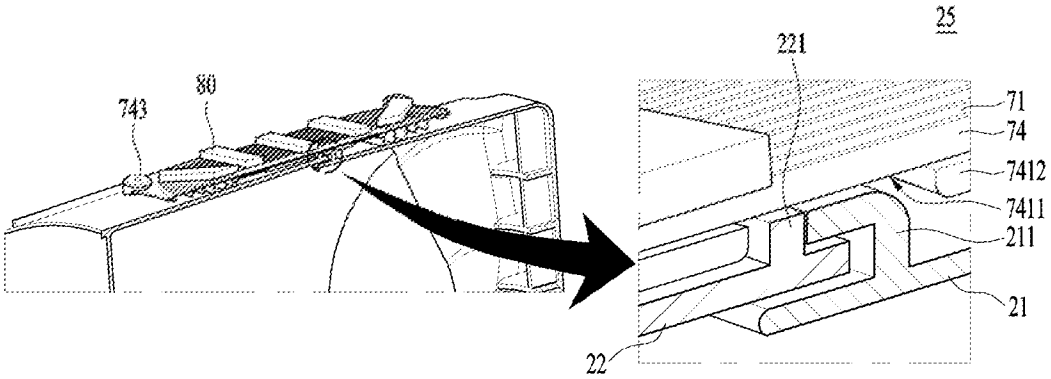
FIG. 20B shows an embodiment of a connector between the front tub and rear tub and a coupling of the tub with the base housing via the connector.

The radially outer surface of the first coupling rib 211 and the radially outer surface of the second coupling rib 221 may have the same radius as each other. The radially-extending portion of the connecting portion in the above-described embodiment may be omitted. FIG. 20B shows an embodiment in which the protruding height of the tub connector 25 is reduced. In this embodiment, the coupling area in the radial direction in the tub connector 25 is reduced. This configuration may not be formed in the entire circumferential direction of the tub, but may be formed only in a portion of the connecting portion that corresponds to the module-mounted portion. The other portions of the connecting portion may be the same as those of the connecting portion in FIG. 20A.

As described above, it is desirable that the induction module be formed only in a portion of the outer circumferential surface of the tub. That is, the length of the circumference on which the induction module is mounted is relatively short as compared with the whole length of the circumference of the tub. Accordingly, the radially-extending portion may be omitted from the tub connector 25 that is located in the module-mounted portion on which the induction module is mounted. Therefore, the radially-extending portion may be omitted from the tub connector 25 corresponding to this portion, and only a portion in which the rubber packing can be inserted may be provided therein.

The coupling force between the front tub 22 and the rear tub 21 may be formed by a bolt or a screw. That is, when the bolt or the screw is fastened in the tub connector 25 in the forward-and-backward direction of the tub, the front tub 22 and the rear tub 21 may be tightly coupled to each other. The fastening position of the bolt or the screw may be provided in a plural number in the circumferential direction of the tub. As the fastening structure for the bolt or the screw, an extended tub connector 25*a* may be provided. FIG. 18 shows an example in which a plurality of extended connecting portions 25*a* is formed in the circumferential direction of the tub.

The fastening of the bolt or the screw may be omitted from the tub connector 25 located at the module-mounted portion, and the structure for such fastening may also be omitted. This is because the tub connector 25 is further extended in the radial direction by the structure for the fastening. Therefore, it is desirable that the configuration for generating the coupling force between the front tub and the rear tub be omitted from the tub connector 25 corresponding to the module-mounted portion.

Figure 18:
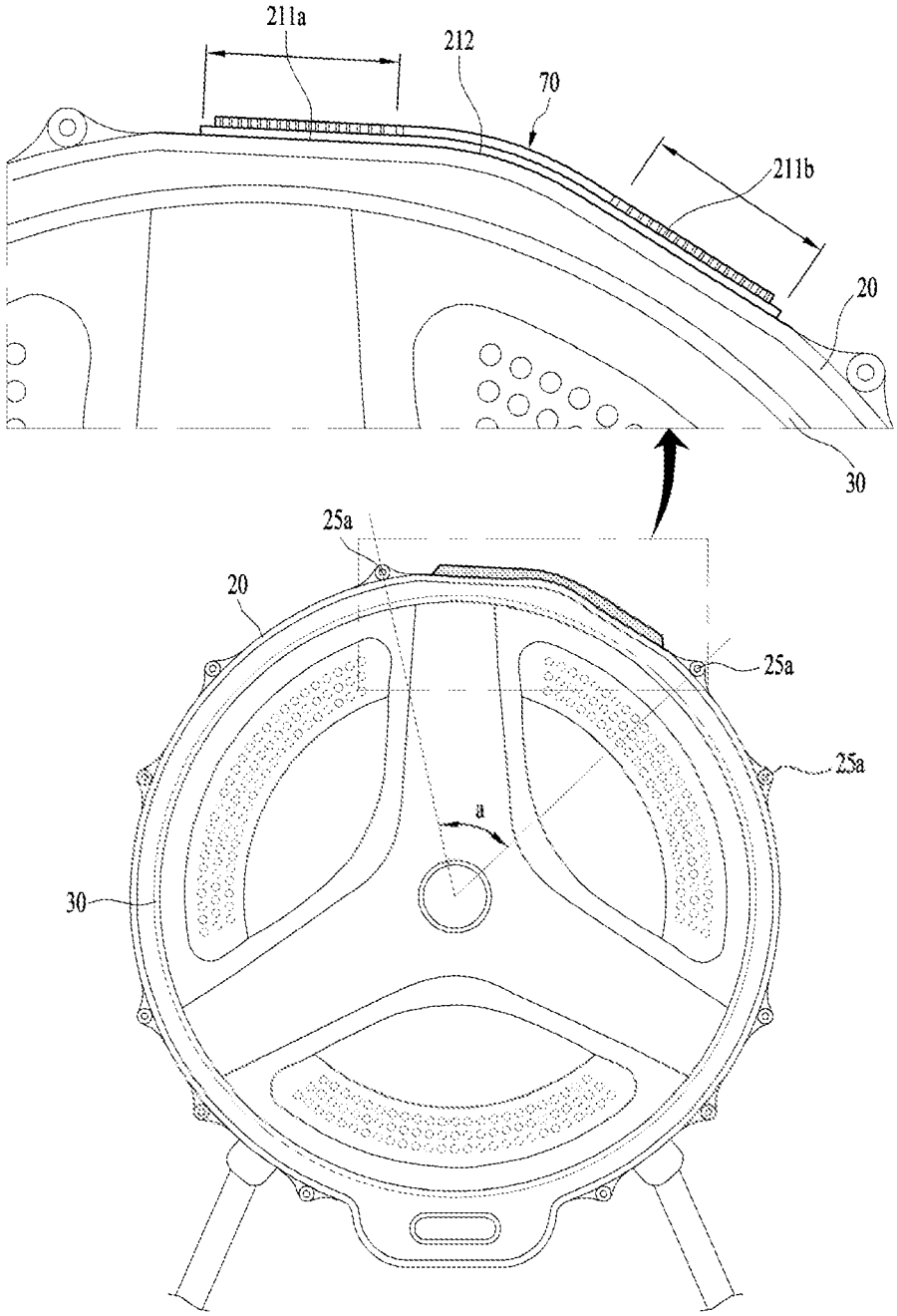
FIG. 18 is a cross-sectional view taken along a line A-A' in FIG. 17.

As shown in FIG. 18, the extended tub connector 25*a* is omitted from the module-mounted portion, and the angle $\alpha$ between the extended connecting portions 25*a*, which are located on both sides of the module-mounted portion, is about 50 degrees. This is for avoiding interference between the module-mounted portion and the extended connecting portions 25*a*. Further, as described above, this is for securing the straight region for the installation of the module-mounted portion. Alternatively, the angle between the extended connecting portions, which are located on both sides of the module-mounted portion, may be about 40 degrees, rather than 50 degrees.

However, it is not desirable to further increase the angle between the extended connecting portions in terms of coupling strength. Further, there is a limitation in further extending the lateral width of the induction module by the angle between the extended connecting portions. Furthermore, the extension of the lateral width of the induction module needs to be limited in terms of mounting convenience and mounting stability of the induction module and avoidance of interference with the extended connecting portions.

In one example, in terms of the characteristics of the tub containing wash water therein and the load applied thereto, the coupling safety factor of the upper portion of the tub is lower than that of the lower portion of the tub. Therefore, considering the circumferential width of the induction module and the circumferential length of the tub and considering that the induction module is located at the upper portion of the tub, the configuration of the tub connector 25 can sufficiently ensure reliability.

In the same manner, in this embodiment, it is also possible to form a penetration portion in the base housing 74 and to insert the connecting portion into the penetration portion. The distance between the induction module and the drum in this embodiment may be shorter than that in the above-described embodiment.

In the above-described embodiments, the distance between the coil and the outer circumferential surface of the drum is significantly reduced due to the shape of the module-mounted portion, the structure of the connecting portion located in the module-mounted portion, and the connection structure between the base housing and the module-mounted portion, thereby greatly enhancing efficiency.

In a laundry treatment apparatus according to one embodiment of the present disclosure, the drum may be heated to 120 degrees Celsius or higher within a very short period of time by driving the induction module 70. When the induction module 70 is driven while the drum is stopped or is at a very slow rotational speed, a certain portion of the drum may overheat very quickly. This is because the heat transfer from the heated drum to the laundry is not sufficient.

Therefore, it may be said that the correlation between the rotational speed of the drum and the driving of the induction module 70 is very important. Moreover, rather than driving the induction module and then rotating the drum, it may be more desirable to rotate the drum and then drive the induction module.

A detailed embodiment for the control of the rotational speed of the drum and the driving of the induction module will be described later.

As illustrated in FIG. 1, the lifter 50 is mounted on the longitudinal central portion of the drum 30 so as to extend in the longitudinal direction. In addition, a plurality of lifters 50 may be provided in the circumferential direction of the drum 30. As illustrated, the position of the lifter 50 is similar to the position at which the induction module 70 is mounted. That is, a large portion of the lifter 50 may be positioned to face the induction module 70. Thus, the outer peripheral surface of a portion the drum 30, in which the lifter 50 is provided, may be heated by the induction module 70. The outer peripheral surface of the portion of the drum 30, in which the lifter 50 is provided, is not in direct contact with the laundry inside the drum 30. The heat generated in the outer peripheral surface of the drum 30 is transferred to the lifter 50, rather than being transferred to the laundry, because the lifter 50 comes into contact with the laundry. Therefore, overheating of the lifter 50 may occur, which is problematic. Concretely, overheating of the drum circumferential surface that is in contact with the lifter 50 may be problematic.

Figure 21:
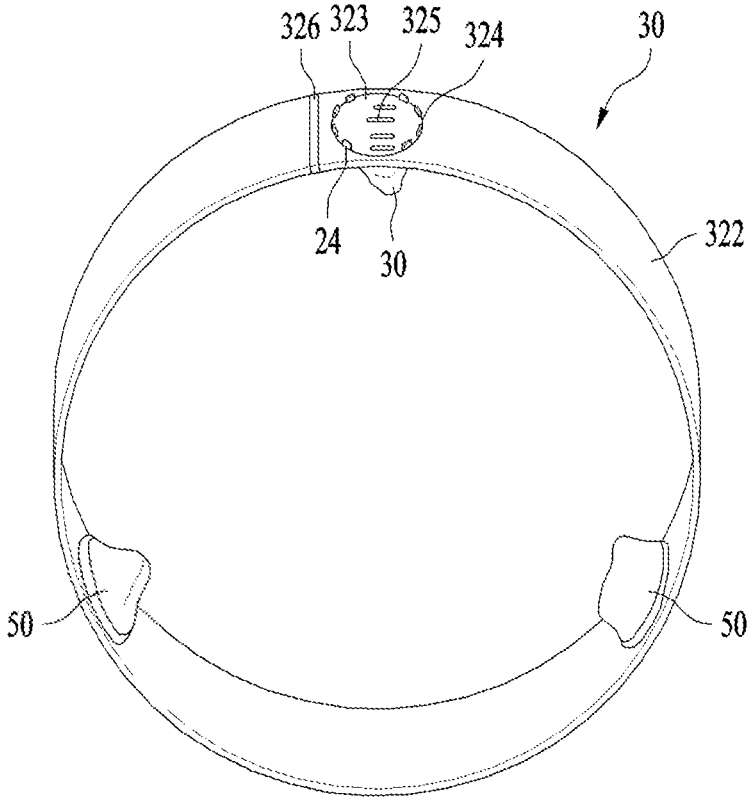
FIG. 21 shows a typical drum with a lifter attached thereto.

FIG. 21 illustrates a lifter 50 mounted on a general drum 30. Only the drum center portion is illustrated, and front and rear portions of the drum 30 are omitted. This is because the lifter 50 may generally be mounted only on the drum center.

A plurality of lifters 50 are mounted in the circumferential direction of the drum 30. In this connection, three lifters 50 are mounted by way of example.

The circumferential surface of the drum 30 may be composed of a lifter mounted portion 323 in which the lifter 50 is mounted and a lifter exclusion portion 322 in which no lifter is mounted. The cylindrical drum 30 may be formed to have a seam portion 326 by rolling a metal plate. The seam portion 326 may be a portion at which both ends of the metal plate are connected to each other through welding or the like.

Various embossing patterns may be formed on the circumferential surface of the drum 30, and a plurality of through-holes 324 and lifter communication holes 325 may be formed for the mounting of the lifters 50. That is, various embossing patterns may be formed in the lifter exclusion portion 22, and the plurality of through-holes 24 and lifter communication holes 25 may be formed in the lifter mounted portion 23.

The lifter mounted portion 23 is a portion of the circumferential surface of the drum 30. Thus, in general, the lifter mounted portion 23 is formed with only a minimum number of holes for the mounting of the lifters and the passage of wash water. This is because, when a greater number of holes are formed through penetration or the like, manufacturing costs may unnecessarily increase.

Accordingly, the plurality of through-holes 24 may be formed in the lifter mounted portion 23 along the outer shape of the lifter 50 to be mounted, so that the lifter 50 may be coupled to the inner peripheral surface of the drum 30 via the through-holes 324. In addition, the plurality of lifter communication holes 325 may be formed in the central portion of the lifter mounted portion 323 so as to allow wash water to move from the outside of the drum 30 to the inside of the lifter 50.

However, it is general that only the necessary holes 324 and 325 are formed in the lifter mounted portion 323, and a large portion of the outer peripheral surface of the drum 30 is maintained as it is. That is, the total area of the holes 324 and 325 is smaller than the total area of the lifter mounted portion 323. Thus, a large area of the lifter mounted portion 323 excluding the area of the holes may directly face the induction module 70, and the lifter mounted portion 323 may be heated by the induction module 70.

The lifter 50 is mounted in the lifter mounted portion 23 so as to protrude inwards in the radial direction of the drum 30. As such, the lifter mounted portion 23 does not contact with the laundry inside the drum 30, and the lifter 50 comes into contact with the drum 30.

The lifter 50 may be generally formed of a plastic material. Since the plastic lifter 50 comes into direct contact with the lifter mounted portion 323, the heat generated in the lifter mounted portion 323 may be transferred to the lifter 50. However, the lifter 50 formed of a plastic material may transfer a very small amount of heat to the laundry that comes into contact with the lifter 50. This is because the plastic material of the lifter 50 has a very low heat transfer characteristic. Therefore, only a portion of the lifter 50 that is in contact with the lifter mounted portion 323 is exposed to a high temperature, and the heat is not transmitted to the entire lifter 50.

According to the results of experimentation performed by the inventors of the present disclosure, it could be found that the temperature at the lifter mounted portion may rise to 160 degrees Celsius, while the temperature at the portion in which no lifter is mounted may rise to 140 degrees Celsius. It may be considered that this is because the heat generated in the lifter mounted portion may not be transferred to the laundry.

Therefore, the lifter 50 may overheat, which may cause damage to the lifter 50. In addition, since the heat generated in the lifter mounted portion 323 may not be transferred to the laundry, energy may be wasted and heating efficiency may be lowered. The embodiments of the present disclosure are devised to overcome these problems.

Figure 22:
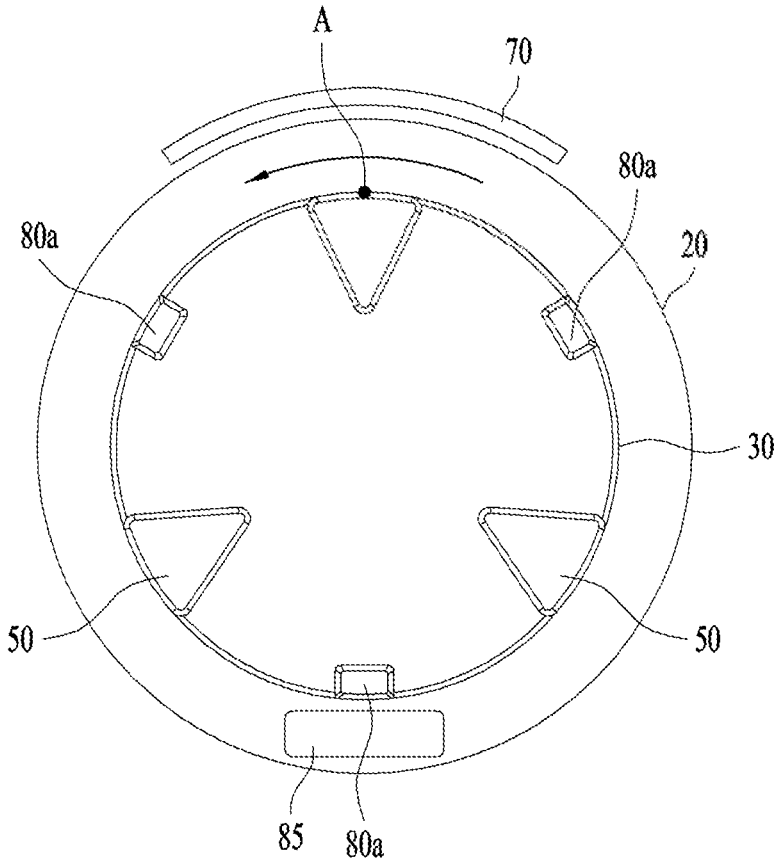
FIG. 22 briefly illustrates a configuration of a laundry treatment apparatus according to one embodiment of the present disclosure.

FIG. 22 illustrates a drum and a lifter according to an embodiment of the present disclosure. The manufacturing method or shape of the drum may be the same as or similar to that of the general drum illustrated in FIG. 21. However, it is to be noted that a lifter mounted portion 323 may be different and that the material and shape of the lifter may be changed.

As illustrated, a lifter exclusion portion 322 may be the same as that of the general drum described above. In the lifter mounted portion 323, unlike the lifter exclusion portion 322, the circumferential surface of the drum may be omitted or removed. That is, an area equivalent to the area of the lifter may be omitted or removed from the circumferential surface of the drum. An area larger than the omission area due to the holes for the mounting of the lifter or the passage of wash water described above may be omitted.

Concretely, a recessed region 325 may be formed in the central portion of the lifter mounted portion 323. The recessed region 325 may take the form of an incision formed by cutting away a portion of the circumferential surface of the drum, or may take the form of a recess that is centrally recessed in a portion of the circumferential surface of the drum.

A plurality of through-holes 324 and 326 may be formed in the lifter mounted portion 323 to correspond to the shape of the lifter 50 to be mounted. The plurality of through-holes 324 and 326 may be formed along the outer rim (frame) of the lifter 50 so as to correspond to the outer contour of the lifter 50. For example, when the lifter is in the form of a track, the through-holes may be formed along the outer rim of the track. In one example, these through-holes may be formed in the form of drilled holes in a portion of the circumferential surface of the drum.

A portion of the circumferential surface of the drum that corresponds to the central portion of the lifter mounted portion 323 may be omitted. That is, the area that faces the induction module 70 may be omitted. That is, the portion surrounded by the through-holes 324 and 326 may be wholly cut away to form the recessed region 325 in the form of an incision.

The recessed region 325 is formed to correspond to the inside of the lifter 50 and is surrounded by the lifter 50. Thus, the recessed region in the form of an incision is not visible inside the drum. The central portion of the lifter 50 mounted in the lifter mounted portion 323 is visible from outside the drum.

With the lifter mounted portion 323, the circumferential surface of the drum may substantially not face the induction module 70 in a portion thereof in which the lifter 50 is mounted. Thus, the amount of heat generated in the lifter mounted portion 323 is very small. This means that a common plastic lifter may be used. This is because the amount of heat generated in the entire lifter mounted portion 323 is very small, so that the lifter 50 may not be overheated by heat transferred to the lifter 50.

However, when a general plastic lifter is used, local heating may occur at a portion in which the lifter 50 and the lifter mounted portion 323 are coupled to each other, which may cause damage to a local portion of the lifter 50. In addition, although the amount of heat, generated when the lifter mounted portion 323 faces the induction module, is minimal, the induction module is being driven, and therefore, energy loss may occur because most of the energy used is not converted into thermal energy.

Therefore, it is necessary to seek a method to satisfy both the prevention of overheating of the lifter and the minimization of energy loss occurring in the lifter mounted portion.

A provider who provides the laundry treatment apparatus may provide various types of laundry treatment apparatus as well as a specific type of laundry treatment apparatus. For example, the provider may provide both a washing machine having no drying function and a washing machine having a drying function. Therefore, in the case of models having the same capacity, it is economical to produce the same devices using common components.

For example, in the case of a washing machine and a washing and drying machine having the same capacity (washing capacity), it may be more economical for a manufacturer to use the same drum and the same lifter in common for various models. Using the existing drum and lifter in a new model without modification may be advantageous in terms of product competitiveness. This is because, assuming mass production, changes in existing components may increase initial investment costs, maintenance costs, and production costs.

Thus, it may be desirable to prevent overheating of the lifter in a controlled manner, without altering the structure or material of the drum or the lifter.

FIG. 22 is a simplified conceptual diagram of components according to an embodiment of the present disclosure.

As illustrated in FIG. 22, in the present embodiment, similarly, the drum 30 is heated via the induction module 70. In addition, similarly, the lifter 50 is mounted inside the drum 30. In addition, the induction module 70 may be mounted radially outside the drum 30, more specifically, on the outer peripheral surface of the tub 20, in the same manner as or similarly to the above-described embodiments.

The present embodiment has a feature in that current applied to the induction module 70 or the output of the induction module 70 may be varied when the rotation angle of the drum 30 is known. Specifically, since the drum 30 may be formed in a cylindrical shape, the rotation angle of the drum 30 may be defined as ranging from 0 degrees to 360 degrees about a specific point.

For example, the rotation angle of the drum at point A at which a specific lifter is at the uppermost portion may be defined as 0 degrees. Assuming that the drum rotates in the counterclockwise direction and that three lifters are equidistantly spaced apart from one another in the circumferential direction of the drum, it may be said that the lifters are located respectively at positions at which the rotation angle of the drum is 0 degree, at which the rotation angle of the drum is 120 degrees, and at which the rotation angle of the drum is 240 degrees. Considering the transverse width of the lifter, it may be said that the lifter is located in an angular range of approximately 2-10 degrees.

According to the present embodiment, it is possible to vary the amount of heating of the drum (hereinafter referred to as "drum heating amount") by the induction module 70 by grasping the position of the lifter 50 when the drum 30 rotates. That is, when the lifter 50 is located so as to face the induction module 70, the drum heating amount by the induction module may be reduced or eliminated, and when the lifter 50 is moved so as not to face the induction module 70, the drum heating amount may be normal. Changing the drum heating amount in this way may be realized by changing the output of the induction module 70.

Therefore, energy efficiency may be improved because the energy consumed in the induction module 70 is not consistent regardless of the rotation angle of the drum 30. In addition, since the energy consumed in the portion of the drum that corresponds to the lifter 50 may be significantly reduced, overheating in the lifter 50 may be remarkably reduced.

FIG. 22 illustrates magnets 80 that are equidistantly provided in the circumferential direction of the drum 30, in the same manner as the lifters 50. The magnets 80*a* may be provided to effectively grasp the rotation angle of the drum 30. Similarly to the lifters 50, the magnets 80*a* may be equidistantly disposed in the circumferential direction. In addition, the magnets 80 may be provided in the same number as the lifters 50. In one example, the angle between the lifter 50 and the magnet 80*a* may be consistent between the plurality of lifters 50 and the plurality of magnets 80*a*.

Accordingly, when the position of a specific magnet 80*a* is sensed, the position of the lifter 50 associated with the specific magnet 80 may be sensed. Specifically, the positions of three lifters 50 may be sensed when the positions of three magnets 80*a* are sensed. When the magnet 80*a* is sensed at a specific position while the drum 30 rotates as illustrated in FIG. 22, it may be seen that the lifter 50 is located at a position at which the drum 30 rotates further by about 60 degrees in the counterclockwise direction.

Specifically, in the present embodiment, a sensor 85 may be further provided to sense the position of the lifter 50 by sensing the position of the magnet 80*a* when the drum 30 rotates. The sensor 85 may sense the position of the magnet 80*a* that corresponds to the rotation angle of the drum 30, and may sense the position of the lifter 50 based on the position of the magnet 80*a*.

In one example, the sensor 85 may merely detect whether or not the magnet 80*a* is present. The rotational speed of the drum 30 may be constant at a specific point in time, and thus, it may be seen that the lifter 50 reaches a position at which it faces the induction module 70 when a specific time has passed from the point in time at which the magnet 80 is sensed.

To put it easily, assuming that the drum rotates at 1 RPM, it may be said that the drum rotates 360 degrees in 60 seconds. Assuming that three magnets 80*a* and three lifters 50 are disposed at the same angular distance, it may be seen that the lifter 50 reaches the position at which it faces the sensor 85 after the drum further rotates by 60 degrees, i.e. 10 seconds after the point in time at which the sensor 85 senses a specific magnet 80.

As illustrated in FIG. 22, it may be seen that any one lifter 50 is located to face the induction module 70 when the sensor 85 senses the magnet 80*a* located at the lowermost portion of the drum 30. Therefore, the drum heating amount by the induction module 70 may be reduced at the position at which the lifter 50 faces the induction module 70, and may be increased when the lifter 50 deviates from the position. For example, the output of the induction module 70 may be interrupted, or the output of the induction module 70 may be maintained at a normal level.

The magnet 80*a* may be disposed at the same position as the lifter 50, regardless of what is illustrated in FIG. 22. In this case, sensing the position of the magnet 80*a* may be the same as sensing the position of the lifter 50. However, in this case, it may be difficult to drive the induction module 70, which is of chief importance. Although it is possible to vary the output of the induction module 70 within a very short time, it is not easy to vary the output of the induction module 70 simultaneously with sensing of the magnet 80*a*. This is because the angular area occupied by the lifter 50 may be greater than the angular area occupied by the magnet 80*a*. The position of the magnet 80 may be defined by a specific angle, but the angle of the lifter 50 may be defined by a specific angular range, rather than a specific angle.

Therefore, in consideration of a time required to change the output and the angular area occupied by the lifter 50, the position of the magnet 80 may be circumferentially spaced apart from the lifter 50 by a predetermined angle in order to more accurately vary the output of the induction module 70. In addition, the acceptable delay time may change based on the drum RPM.

It is necessary for the magnet 80*a* to rotate together with the drum 30. Therefore, the magnet 80*a* may be provided on the drum 30. In addition, the sensor 85 for sensing the magnet 80*a* may be provided on the tub 20. That is, in the same manner as the manner in which the drum 30 rotates relative to the fixed tub 20, the magnet 80*a* may rotate relative to the fixed sensor 85.

Figure 23:
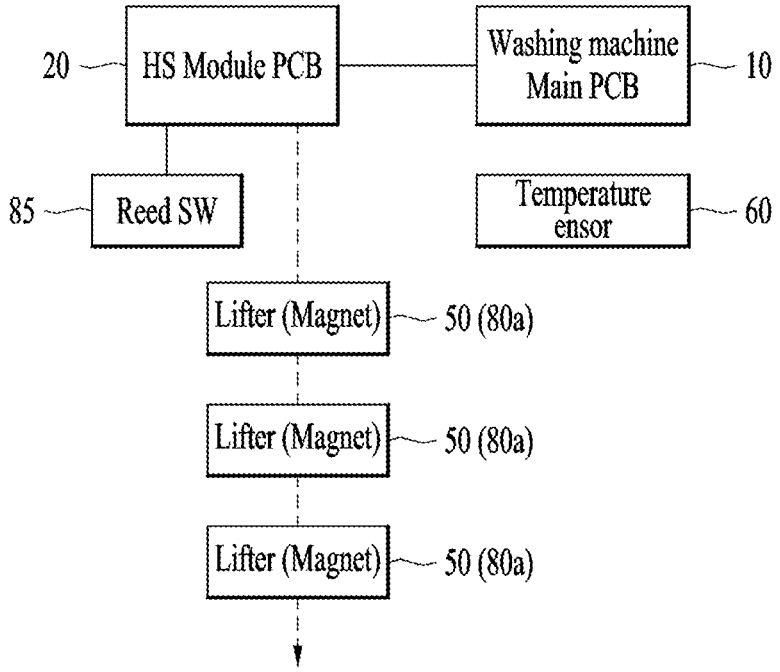
FIG. 23 shows a block diagram of control components that may be applied to the apparatus in FIG. 22.

FIG. 23 illustrates control elements for grasping the position of the lifter 50 by sensing the position of the magnet 80.

A main controller 100 or a main processor of the laundry treatment apparatus controls various operations of the laundry treatment apparatus. For example, the main controller 100 controls whether or not to drive the drum 30 and the rotational speed of the drum. In addition, a module controller 200 may be provided to control the output of the induction module under the control of the main controller 100. The module controller may also be referred to as an induction heater (IH) controller or an induction system (IS) controller.

The module controller 200 may control the current applied to an induction drive unit, or may control the output of the induction module. For example, when the controller 10 issues a command to operate the induction module to the module controller 200, the module controller 200 may perform control so that the induction module operates. When the induction module is configured to be simply repeatedly turned on and off, a separate module controller 200 may not be required. For example, the induction module may be controlled so as to be turned on when the drum is driven and to be turned off when the drum stops.

However, in the present embodiment, the induction module may be controlled so as to be repeatedly turned on and off while the drum is being driven. That is, a point in time for control switching may very quickly change. Therefore, the module controller 200 may be provided to control the driving of the induction module, separately from the main controller 100. This also serves to reduce the burden of the processing capacity of the main controller 100.

The sensor 85 may be provided in various forms as long as it is capable of sensing the magnet 80*a* and transmitting the sensing result to the module controller 200.

The sensor 85 may be a reed switch. The reed switch is turned on when a magnetic force is applied by a magnet and is turned off when the magnetic force disappears. Thus, when the magnet is positioned as close as possible to the reed switch, the reed switch may be turned on due to the magnetic force of the magnet. Then, when the magnet becomes far away from the reed switch, the reed switch may be turned off. The reed switch outputs different signals or flags when turned on and off. For example, the reed switch may output a signal of 5V when turned on, and may output a signal of 0V when turned off. The module controller 200 may estimate the position of the lifter 50 by receiving these signals. Conversely, the reed switch may output a signal of 0V when turned on, and may output a signal of 0V when turned off. Since the period during which magnetic force is sensed is longer than the period during which no magnetic force is sensed, the reed switch may be configured to output a signal of 0V when detecting the magnetic force.

The module controller 200 may acquire information on the drum RPM via the main controller 100. Then, the module controller 200 may grasp the angle between the lifter 50 and the magnet 80*a*. Thus, the module controller 200 may estimate the position of the lifter 50 based on the signal of the reed switch 85. In one example, the module controller 200 may vary the output of the induction module based on the estimated position of the lifter 50. The module controller 200 may cause the output of the induction module to become zero or to be reduced at a position at which the lifter 50 faces the induction module. This may remarkably reduce unnecessary energy consumption in the portion in which the lifter 50 is mounted. Thereby, overheating in the portion in which the lifter 50 is mounted may be prevented.

The sensor 85 may be a hall sensor. The hall sensor may output different flags when sensing the magnet 80*a*. For example, the sensor 85 may output Flag "0" when sensing the magnet 80*a*, and may output Flag "1" when sensing no magnet.

In either case, the module controller 200 may estimate the position of the lifter 50 based on the magnet sensing signal. Then, the module controller 200 may variably control the output of the induction module based on the estimated position of the lifter 50.

On the other hand, the magnets may not be used in the same manner as the lifters. This is because the lifters may be disposed at the same interval from each other, and therefore, when the position of a specific lifter is detected, the positions of the other lifters may be estimated with high accuracy. That is, regardless of what is illustrated in FIG. 8, two of the three magnets may be omitted.

Generally, the main controller 100 of the washing machine is aware of the rotation angle of the drum and/or the rotation angle of the motor 41. Assuming that the motor 41 and the drum rotate integrally and that the rotation angle of the motor 41 is the same as the rotation angle of the drum, the positions of the three lifters may be grasped by grasping the position of one magnet.

For example, the drum may rotate at 1 RPM and the lifter may be located at a position at which the drum rotates by 60 degrees relative to one magnet. It may be seen that, when the sensor 85 senses the magnet 80, the lifter is located at the position to which the drum further rotates by 60 degrees (i.e., the position to which the drum further rotates in 10 seconds). Similarly, it may be seen that a second lifter is located at a position corresponding to a point in time at which 10 seconds have passed, and that a third lifter is located at a position corresponding to a point in time at which 10 seconds have passed.

That is, the main controller 100 may grasp the positions of the three lifters based on information on one magnet sensed by the sensor 85. Thus, the main controller 100 may control the module controller 200 to variably control the output of the induction module based on the positions of the lifters 50.

In this way, according to the embodiments described above, the output of the induction module may be reduced or set to zero at a point in time at which the lifter faces the induction module or for a time period during which the drum rotates, and the normal state output of the induction module may be maintained when the lifter deviates from the position or the range at which it faces the induction module.

Therefore, unnecessary energy waste and overheating in the portion in which the lifter 50 is mounted may be prevented. In one example, since a conventional drum and lifter may be used without modification, it may be said that the present disclosure is very economically advantageous.

It is to be noted that, in the embodiments described above with reference to FIGS. 22 to 24, a separate sensor and a separate magnet are necessary in order to grasp the positions of the lifters. Although the positions of the lifters may be grasped using any other type of sensor, the provision of a separate sensor for grasping the position of the lifter may be necessary in any case.

The separate sensor for grasping the position of the lifter may complicate the manufacture of the laundry treatment apparatus and may increase manufacturing costs. This is because a sensor or a magnet, which is unnecessary in a conventional laundry treatment apparatus, needs to be additionally provided. Moreover, the shape or structure of the tub or the drum also needs to be modified in order to accommodate such an additional component.

Hereinafter, embodiments that may achieve the above-described objects without requiring a separate sensor and a magnet will be described in detail.

Figure 25:
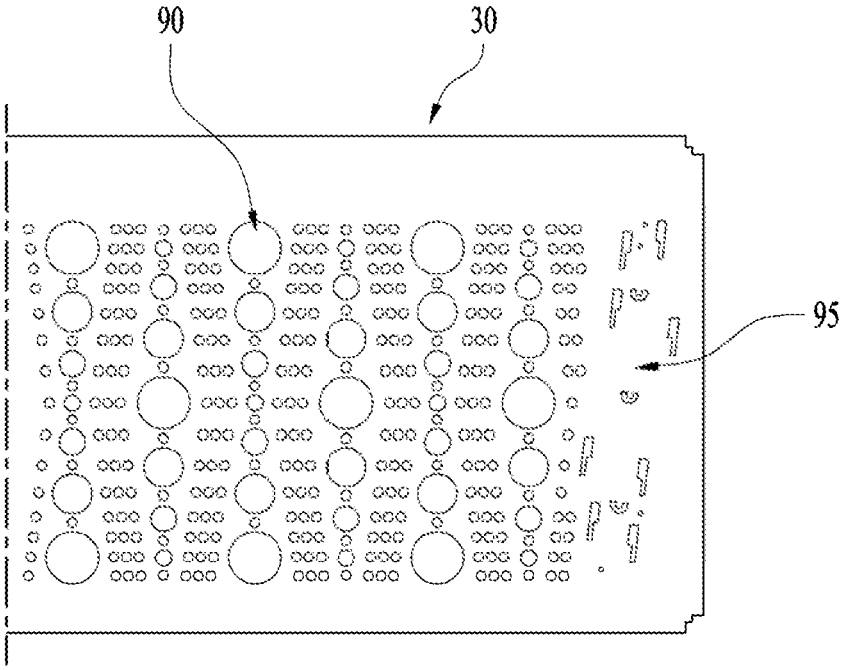
FIG. 25 shows an embodiment of an inner circumferential surface shape of the drum.

FIG. 25 illustrates a partial development view of the inner peripheral surface of the drum. As illustrated, various embossing patterns 90 may be formed on the inner peripheral surface of the drum. These embossments may be formed in various forms, such as convex embossments that protrude in the inward direction of the drum and convex embossments that protrude in the outward direction of the drum. The shape of the embossments may be selected from any of various shapes. It is to be noted that the embossing patterns are generally equally and repeatedly repeated in the circumferential direction of the drum.

As with the embossments, through-holes are generally formed in the drum and serve to allow wash water to move between the inside and the outside of the drum.

The embossing patterns may be omitted in the portion of the circumferential surface of the drum in which the lifter is mounted. This is because the lifter may be easily mounted when the inner peripheral surface of the drum maintains a constant radius from the center of the drum. In other words, in the portion in which no lifter is mounted, the inner peripheral surface of the drum exhibits a great change in the radius thereof.

The embossments are formed such that a large portion thereof protrudes into the drum. That is, the area of the protruding portion is relatively large. This is because the area of the inner peripheral surface of the drum may increase due to the embossments that protrude into the drum, which may increase the frictional area between the laundry and the inner peripheral surface of the drum.

Assuming a drum having no embossments and having the same radius of the inner peripheral surface thereof, it may be said that the drum always faces the induction module with the same area and the same distance regardless of the rotation angle thereof.

However, the area and the distance by which the drum faces the induction module necessarily vary according to the rotation angle of the drum. The reason that the area and the distance by which the drum faces the induction module necessarily vary according to the rotation angle of the drum is due to the presence or absence of the embossing patterns or variation in the embossing patterns described above. That is, the shape of the drum that faces the induction module may inevitably vary.

Figure 26:
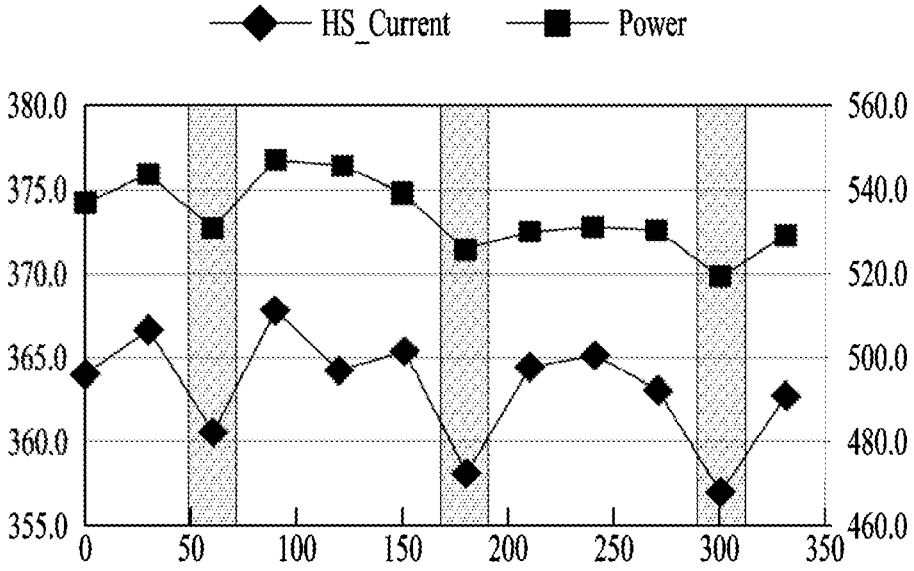
FIG. 26 shows changes in current and output (power) of the induction module based on a drum rotation angle relative to an inner circumference of the drum in FIG. 25.

FIG. 26 illustrates changes in the current and output of the induction module 70 depending on the rotational angle of the drum.

It may be seen that the current and the output of the induction module vary according to the rotation angle of the drum. In other words, it may be seen that the current and the output are greatly reduced at a specific point in time or at a specific angle.

The position of the lifter may be estimated without a separate sensor based on a change in the current sensed in the induction module or a change in the output of the induction module. For example, the current or output of the induction module may vary when the drum rotates while the induction module maintains a constant output.

In the state in which the induction module is controlled to have the same current or output via feedback control, the current or the output is reduced when the portion of the drum in which the lifter is mounted faces the induction module. This is because the area and the distance by which the drum faces the induction module may become the shortest at the corresponding portion. Therefore, the position of the lifter mounted portion may be estimated based on a change in the current or the output (power) of the induction module depending on a change in the rotation angle of the drum.

By estimating the position of the lifter mounted portion, the output (power) of the induction module at the lifter mounting position may be controlled to be 0, or may be significantly reduced.

Referring to FIG. 26, it can be estimated that the lifters are positioned respectively in the section of approximately 50-70 degrees, in the section of approximately 170-190 degrees, and in the section of approximately 290-310 degrees based on 360 degrees. For example, it can be estimated that the lifters are positioned in three angular sections while the induction module starts to drive and the drum rotates one revolution. In one example, in order to more accurately grasp the positions of the lifters, the positions of the lifters may be corrected by repeating the same process multiple times.

Then, when the estimation of the positions of the lifters is complete, the output of the induction module may be variably controlled based on the positions of the lifters during a subsequent drum rotation.

Through the embodiments described with reference to FIGS. 22 to 26, the heating efficiency may be enhanced and overheating of the lifter may be prevented without special modifications of the drum or the lifter.

Hereinafter, a control method according to an embodiment of the present disclosure will be described.

First, driving of the induction module 70 starts (S50) in order to heat the drum as needed. This drum heating may be performed in order to dry the laundry inside the drum or to heat the wash water inside the tub. Thus, the induction module 70 may be driven when a drying operation or a washing operation is performed. The induction module 70 may also be driven during a dehydration operation. In this case, since the drum rotates at a very high speed, the drum heating amount may be relatively small, but the dehydration effect may be further enhanced since the removal of water by centrifugal force and the evaporation of water by heating are performed in a complex manner.

Once driving of the induction module 70 has started, it is determined whether or not an end condition is satisfied (S51). When the end condition is satisfied, the driving of the induction module 70 ends (S56). The end condition may be the end of the washing operation, or may be the end of the drying operation. However, the end of the driving S30 may be a temporary end, rather than a final end in one washing course or drying course. Thus, the induction module may be repeatedly turned on and off.

Once driving of the induction module 70 has started, the induction module 70 may be controlled to perform normal state output until the driving of the induction module 70 ends (S56). That is, the induction module 70 may be controlled to have a predetermined output, and may be controlled via feedback for more accurate output control. Thus, the driving of the induction module 70 may include controlling the induction module to the normal state output in by module controller.

In order to solve the overheating problem in the portion in which the lifter is mounted, the control method may include sensing the position of the lifter when the drum rotates (S53). Specifically, it may be determined whether or not the lifter is positioned so as to face the induction module (i.e. whether or not the lifter faces the induction module at the closest position). The sensing of the position of the lifter may be continuously performed while the drum is being driven. In one example, the induction module may not be continuously driven while the drum is being driven. For example, in a rinsing operation, the drum may be driven, but the induction module may not be driven. In addition, although the driving of the drum is continued in a washing operation, which is subsequently performed after the heating of wash water ends, the induction module may not be driven.

Therefore, the position of the lifter may be detected after the induction module is driven. That is, the detection of the position of the lifter may be performed under the assumption that driving of the induction module starts.

Once the position of the lifter has been detected, it may be determined whether or not the lifter is at a specific position. That is, it is determined whether the output is to be reduced or to be set to 0 (S54). When it is detected that the lifter is positioned to face the induction module, a condition under which the output is reduced or becomes zero is satisfied. Thus, the output of the induction is reduced or is set to 0 (S55). On the other hand, when it is detected that the lifter is not positioned to face the induction module, the induction module is maintained at the normal state output (S57).

By repeating the phases described above, the output of the induction module may be controlled so as to be reduced when the lifter is positioned to face the induction module, and may be controlled to perform normal state output when the lifter is not positioned to face the induction module. Thus, it is possible to prevent overheating of the lifter mounted portion and increase energy efficiency by a controllable method.

The control of the output of the induction module depending on the position of the lifter may not always be performed. That is, while the drum is driven and the induction module is driven, the output may be continuously maintained at a constant value regardless of the position of the lifter. That is, the control described above may be omitted when the risk of overheating of the lifter may be ignored.

To this end, it may be determined whether or not the sensing of the position of the lifter and the control of the output of the induction module are required in order to avoid overheating of the lifter (S52). This determination may be performed before sensing the position of the lifter.

For example, when the drum rotates at a high rotation speed, for example, 200 RPM or more, the drum heating amount generated in the lifter mounted portion is relatively small because of the high rotational speed of the drum. In one example, the drum rotation speed is so high that the area and time of contact between the drum and laundry are relatively large. This is because, in this case, the laundry is not moved by the lifter, but is in close contact with the inner peripheral surface of the drum.

That is, the control of the drum heating amount depending on the position of the lifter may be meaningless at a specific RPM or more at which the drum is spin-driven, rather than driven to perform tumbling.

Accordingly, the determination of whether or not to apply a lifter heating avoidance logic may be very effective. In one example, the conditions applied at this phase may include various other conditions as well as the RPM. For example, when the drum is heated in a drying operation, a great amount of heat is transferred to the laundry. Thus, overheating may occur in a portion of the lifter that is not in contact with the laundry. On the other hand, when the drum is heated in the state in which wash water is accommodated in the tub and a portion of the outer peripheral surface of the drum is immersed in the wash water, heat is mostly transferred to the wash water. This may be true of the lifter exclusion portion as well as the lifter mounted portion.

Therefore, the condition for determining whether or not to apply the lifter heating avoidance logic may be a process of determining the type of an operation. The lifter heating avoidance logic may not be applied when a washing operation is determined. Thus, the conditions for applying the lifter heating avoidance logic may be variously modified.

In one example, the sensing of the position of the lifter S50 may be performed in various ways. For example, the sensor and magnet described above may be used, or a change in the current or the output of the induction module may be used without a sensor.

Due to the positional relationship between the induction module and the drum and the shapes of the induction module and the drum, the induction module substantially heats only a specific portion of the drum. Thus, when the induction module heats the drum that is in a stopped state, only a specific portion of the drum may be heated to a very high temperature. For example, when the induction module is located on the upper portion of the tub and the drum does not rotate, only the outer peripheral surface of the upper portion of the drum may be heated when the induction module is driven.

In the state in which the drum is in the stopped state, the outer peripheral surface of the upper portion of the drum is not in contact with the laundry. Thus, the outer peripheral surface of the upper portion of the drum may be extremely overheated. Therefore, in order to prevent the drum from overheating, it is necessary to rotate the drum. That is, it is necessary to change the portion to be heated via rotation of the drum, and to transfer the heat to the wash water or to the laundry.

Therefore, in order to operate the induction module, the drum may need to rotate.

Hereinafter, an embodiment of the control logic between the operation of the induction module and the driving of the drum will be described.

A drum heating mode for heating the drum 30 may be performed during a washing operation or a drying operation, as described above. Substantially, the drum heating mode may be continuously performed during the washing operation and the drying operation.

When the drum heating mode S10 is performed, it may be determined whether or not a heating end condition is satisfied (S20). The heating end condition may be any one of a heating duration, a target drum temperature, a target drying degree, and a target wash water temperature. The heating mode ends when any one condition is satisfied (S70).

For example, the drum heating mode S10 may be continued so as to heat the wash water to 90 degrees in the washing operation. The drum heating mode S10 may end when the wash water reaches 90 degrees. The drum heating mode S10 may be continued until the degree of drying is satisfied in the drying operation.

In a washing machine or a drying machine, the drum is generally driven at a rotational speed at which tumbling driving is possible. The drum is directly accelerated to a speed at which the drum undergoes tumbling driving immediately from the stopped state of the drum. Then, the tumbling driving may be realized by forward and reverse rotation. That is, after continuing tumbling driving in the clockwise direction, the drum may stop and then again perform tumbling driving in the counterclockwise direction.

When the rotational speed of the drum is very low, a specific portion of the drum may likewise be overheated. For example, when the tumbling driving speed is 40 RPM, it takes a predetermined time until the drum is accelerated from the stopped state to 40 RPM. Thus, a point in time at which the drum starts tumbling driving differs from a point in time at which the drum performs normal tumbling driving. That is, when the drum starts tumbling driving, the drum is gradually accelerated from the stopped state to reach the tumbling RPM and is then driven at the tumbling RPM. The drum may perform tumbling driving in a predetermined direction, and then may stop and again perform tumbling driving in the other direction.

In this connection, there is a need to prevent overheating of the drum and to increase heating energy efficiency and time efficiency.

Avoiding heating for a period during which the RPM of the drum is very low may be good in terms of drum overheating prevention. Conversely, heating the drum only after the drum reaches a normal RPM may waste time.

Therefore, the point in time at which the induction module starts to operate may be after the drum starts to rotate and before the drum reaches the normal tumbling RPM. In one example, when avoiding the overheating of the drum is more important than the heating efficiency, the induction module may be operated after the drum reaches the tumbling RPM. Therefore, there is a requirement to strike a balance between heating efficiency and prevention of overheating.

For example, when the drum RPM is greater than 30 RPM, the induction module may be operated. That is, the drum RPM condition may be determined (S40), and when the condition is satisfied, the induction module may be turned on (S50). When the drum RPM is less than 30 RPM, the induction module may not be operated. That is, the induction module may be turned off (S60). That is, the induction module may be turned on based on a specific RPM, which is smaller than the tumbling RPM and greater than 0 RPM.

That is, the induction module may be operated only when the drum RPM is greater than a specific RPM, and may not be operated when the drum RPM is less than the specific RPM.

Therefore, for a normal tumbling driving period, the induction module may be driven after the drum starts to rotate and the driving of the induction module stops before the rotation of the drum stops. That is, the induction module may be turned on and off based on a threshold RPM, which is less than the normal tumbling RPM. Therefore, when the tumbling driving period is repeated a plurality of times, the induction module is repeatedly turned on and off.

Figure 28:
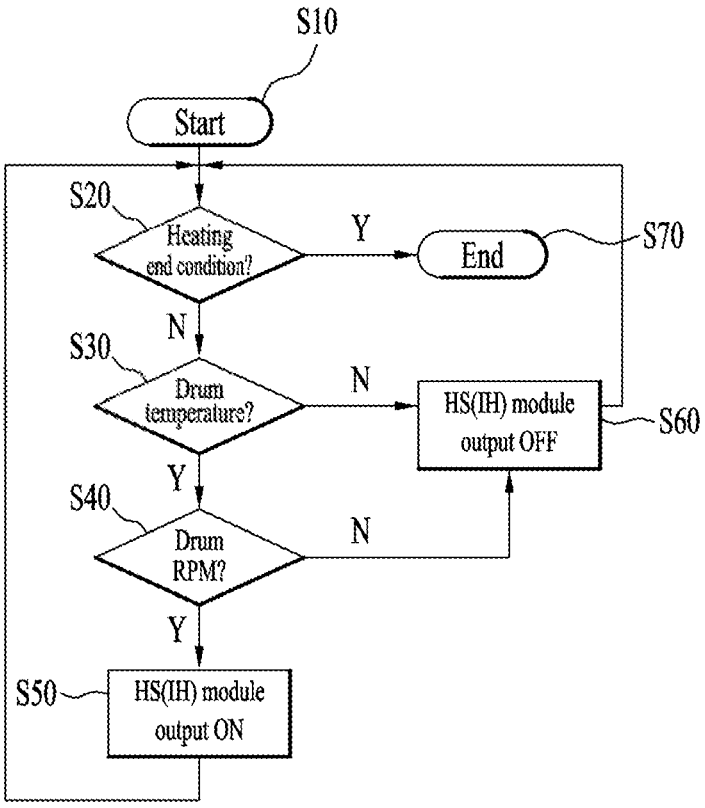
FIG. 28 illustrates a control flow according to one embodiment of the present disclosure.

In the present embodiment, a drum temperature condition may be determined in order to prevent overheating of the drum (S30). In one example, the drum temperature condition may be applied alone or in combination with the above-mentioned drum RPM condition. When the two conditions are applied together, the order of determination of these conditions may change. In FIG. 28, the case in which the determination of the drum temperature condition is performed first is illustrated.

As described above, the central portion of the drum is heated to a relatively higher temperature than the front and rear portions of the drum. For example, the central portion of the drum may be heated to around 140 degrees Celsius. In this connection, when the central portion of the drum is heated to 160 degrees Celsius or more, it may be determined that the drum is overheated. In one example, the drum temperature condition for the determination of overheating may change.

The temperature of 160 degrees Celsius may be a threshold temperature for preventing thermal deformation of elements around the drum and damage to laundry. Thus, when the drum temperature is equal to or greater than the threshold temperature, the induction module may be turned off (S60).

Accordingly, in the embodiment illustrated in FIG. 28, for example, assuming that the drum temperature is less than 160 degrees, the rotational speed of the drum is 40 RPM, and the target wash water temperature is 90 degrees Celsius, but that the current temperature of the wash water is 40 degrees Celsius, the induction module may be in the ON state. Therefore, reliability may be guaranteed and safe drum heating may be realized through various conditions.

Figure 27:
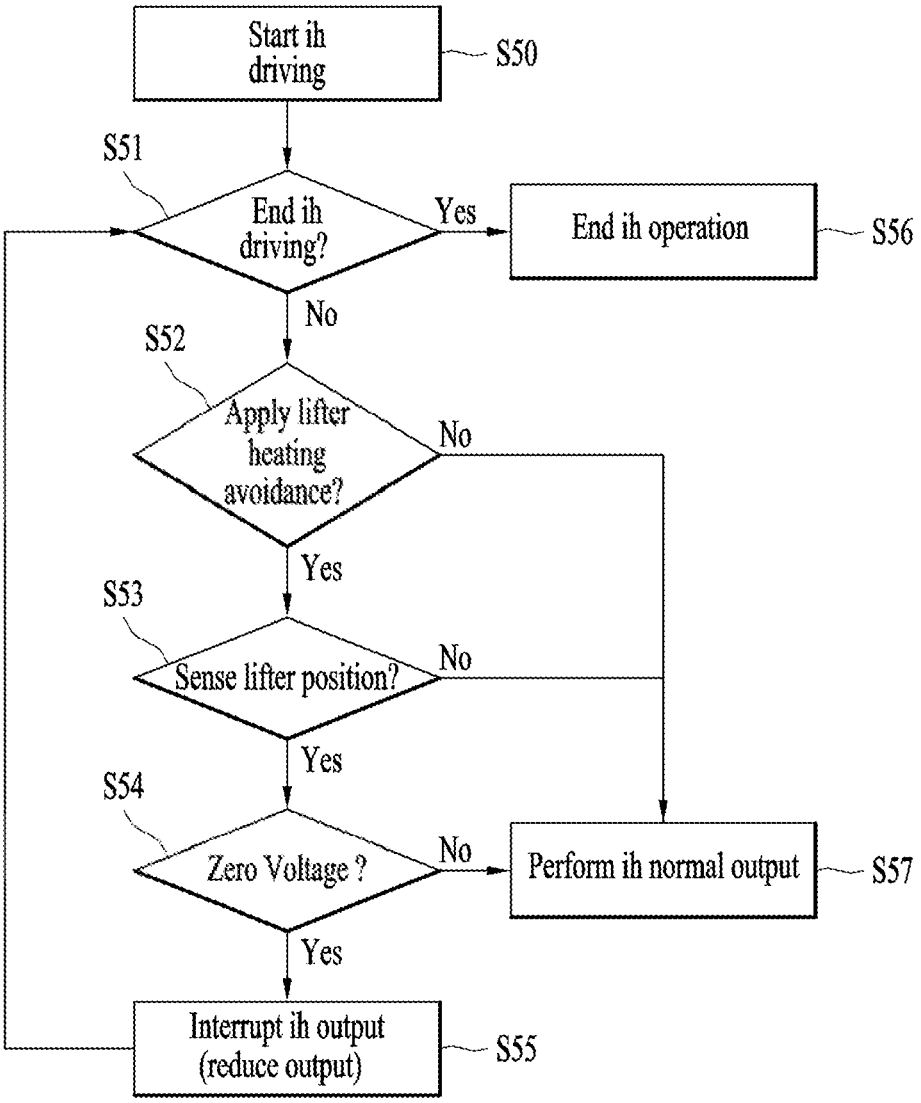
FIG. 27 illustrates a control flow according to one embodiment of the present disclosure.

In one example, variable control of the induction module may be performed when the induction module is in the ON state. Thus, the variable control of the output of the induction module may be performed in the induction module ON phase S50. An embodiment of the variable control of the output has been described above with reference to FIG. 27. In this way, when the tumbling driving is continued, the induction module may repeatedly undergo a normal state output period and a reduced output period.

Accordingly, the control logic for the drum heating mode and the control logic for the prevention of overheating of the lifter may be implemented in a complex manner. Therefore, it is possible to prevent the drum from overheating, to quickly stop the heating of the drum in case of unexpected drum overheating, and to prevent overheating of the lifter.

Hereinafter, an embodiment of a temperature sensor 60 for sensing the temperature of the drum will be described in detail.

The object to be heated by the induction module 70 is the drum 30. Therefore, the drum 30 may be an element in which overheating may directly occur. When the drum 30 is heated to heat wash water, the temperature of the drum 30 is much higher than the boiling temperature of the wash water. This may be attributed to the characteristics of the induction heater. However, the drum 30 is configured to rotate. In addition, as described above, the drum may be heated only while the drum is rotating.

Therefore, it is not easy to sense the temperature of the drum due to the specific characteristics of the drum, and furthermore, it is not easy to sense the temperature of the drum at the time of rotation. In particular, it is not easy to sense the temperature of the drum at the central portion of the drum (i.e., a portion of the outer peripheral surface at the middle between the front and rear ends of the drum) having the highest temperature.

The temperature of the drum may be measured in a direct manner. For example, it is possible to directly measure the temperature of the drum using a non-contact type temperature sensor. For example, the temperature of the outer peripheral surface of the drum may be sensed through an infrared temperature sensor.

However, since the drum is configured to rotate as described above and is provided inside the tub, the environment inside and outside the drum may be a high temperature and high humidity environment. Therefore, it is very difficult to detect the temperature of the drum by irradiating the outer peripheral surface of the drum with infrared rays. This is because the infrared rays may be scattered by water vapor.

Due to this difficulty, the inventors of the present disclosure have attempted to indirectly measure the temperature of the drum rather than directly measuring the temperature of the drum. That is, the inventors have attempted to indirectly measure the temperature of the drum using an air temperature value depending on the generation of heat in the drum.

The gap between the outer peripheral surface of the drum and the inner peripheral surface of the tub may be approximately 20 mm. Therefore, it may be possible to indirectly measure the temperature of the drum by measuring the temperature of air between the outer peripheral surface of the drum and the inner peripheral surface of the tub.

The temperature sensor 60 mounted on the inner peripheral surface of the tub 20 may be provided to sense the temperature of air between the inner peripheral surface of the tub and the outer peripheral surface of the drum. Thus, the difference between the actual temperature of the outer peripheral surface of the drum and the air temperature (the temperature sensed by the temperature sensor) may be obtained by multiplying the amount of heat transferred by the air (between the outer peripheral surface of the drum and the temperature sensor) by the heat resistance of the air.

When constant air flow is generated on the outer peripheral surface of the drum by the rotation of the drum, the difference between the temperature of the outer peripheral surface of the drum and the air temperature measured inside the tub may be constant. Therefore, the temperature of the outer peripheral surface of the drum may be estimated as the sum of a constant and the measured temperature value.

Therefore, it is possible to control the driving of the induction module based on the estimated temperature of the outer peripheral surface of the drum.

In this connection, in order to more accurately estimate the temperature of the outer peripheral surface of the drum, it may be necessary to exclude, as much as possible, external environmental factors that cause an increase/decrease in the temperature between the outer peripheral surface of the drum and the temperature sensor.

In one example, most of these external environmental factors act to lower the temperature of the drum.

For example, accurate temperature estimation may be difficult when airflow due to rotation of the drum and airflow due to other elements increase. For example, in a portion into which cooling water is introduced, accurate temperature estimation may be difficult because heat in the drum is mainly transferred to the cooling water. For example, in a portion that is in direct communication with a relatively low temperature environment outside the tub, heat in the drum may be mainly transferred to the outside of the tub. For example, when the temperature sensor is provided at a portion affected by the magnetic field of the induction module, accurate temperature measurement may be difficult.

Therefore, the position at which the temperature sensor is mounted may be very limited. This is because various factors, such as precise temperature measurement, temperature measurement for the highest temperature portion of the drum, and avoidance of interference with a tub connection portion (a portion in which the front portion and the rear portion of the tub are connected to each other) due to the structure of the tub, need to be considered.

Figure 29:
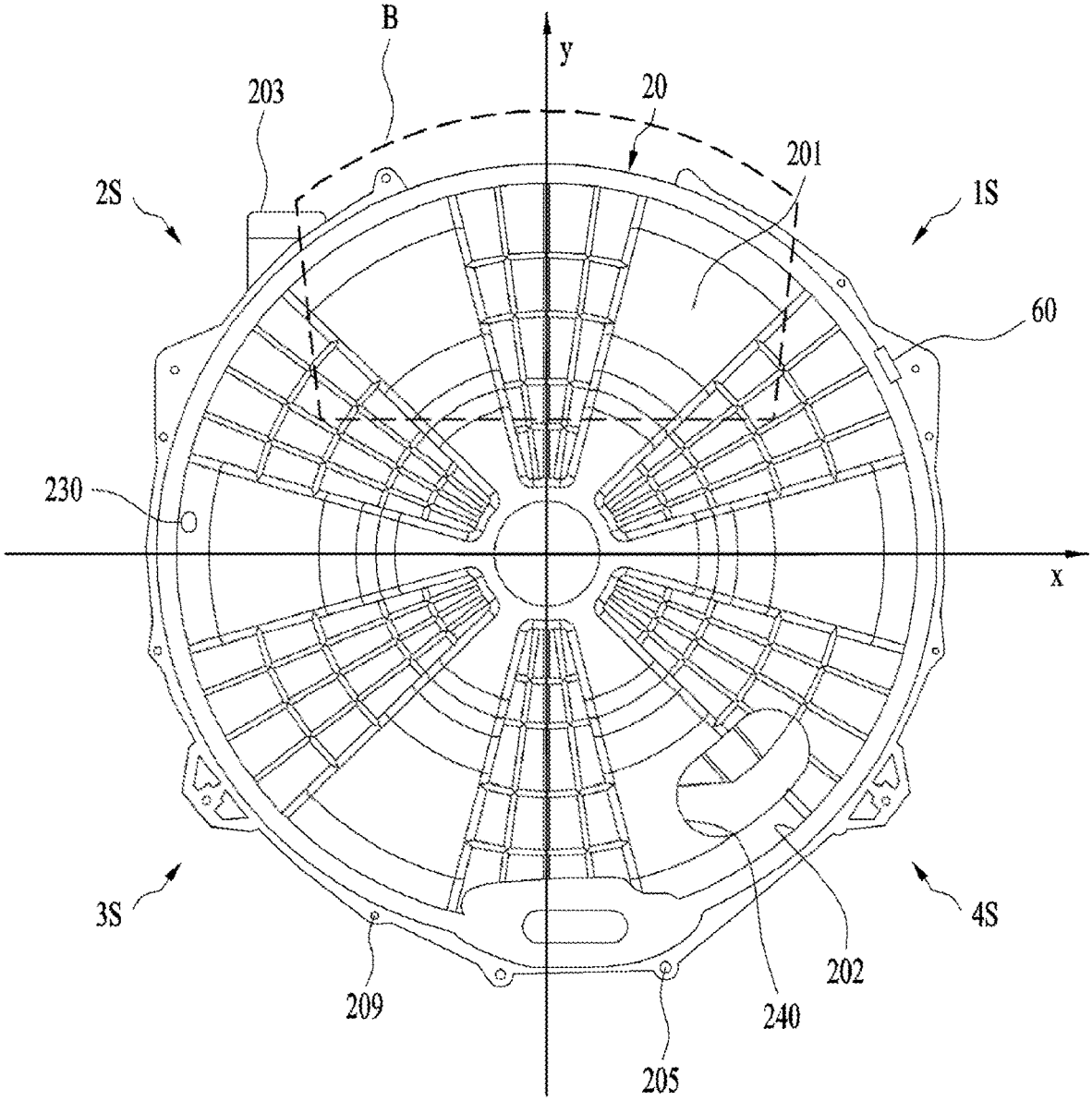
FIG. 29 shows a magnetic field area of the induction module and a location of a temperature sensor in a cross section view of the tub.

FIG. 29 illustrates a cross section illustrating the mounting position of the temperature sensor 60 according to an embodiment of the present disclosure. FIG. 29 illustrates an inner rear wall 201 and an inner sidewall 202 of the tub in the transverse cross section of the tub 20.

First, as described above, the induction module 70 may be located on the upper portion of the tub 20. When the cross section of the tub is divided into four quadrants, the induction module 70 may be located on a first quadrant 1S or a second quadrant 2S. In one example, the induction module 70 may be located on both the first and second quadrants 1S and 2S. In either case, the induction module 70 may be located above the vertical center axis of the tub.

The second quadrant S2 of the tub 20 may be generally provided with an airflow hole 203. That is, the inside of the tub may be in communication with the outside of the tub through the airflow hole 203, rather than being completely sealed with respect to the outside of the tub. Therefore, the second quadrant 2S of the tub 20 corresponding to the airflow hole 203 is affected by the outside air having a relatively low temperature. In one example, the airflow hole 203 may be provided in the first quadrant S1 of the tub 20 as occasion demands.

A condensing port 230 may be provided in or near the third quadrant 3S of the tub 20 to cool the heated wet air so as to condense water. That is, the condensing port 230 may be provided to supply the cooling water from the outside of the tub to the inside of the tub so as to cool the heated wet air inside the tub. The inside of the tub corresponding to the third quadrant 3S, to which the cooling water is supplied, is influenced by low-temperature condensate water.

A fourth quadrant 4S of the tub 20 may be provided with a duct hole 202, through which the air inside the tub is discharged to the outside. The air, from which the water is removed by the cooling water, is discharged from the inside of the tub to the outside of the tub 20 through the duct hole 202. In one example, the discharged air may again be introduced into the tub 20.

Accordingly, the temperature of the inside of the tub corresponding to the duct hole 202, i.e., the fourth quadrant 4S is lower than that of the other portions, and the flow of air is accelerated. In one example, the positions of the condensing port 230 and the duct hole 202 may be opposite each other.

In one example, air has a tendency to be lowered in density when heated. Therefore, the temperature sensor may be provided in the first quadrant 1S and the second quadrant 2S, but not in the fourth quadrant 4S and the third quadrant 3S of the tub. This is because the temperature of the air in the first and second quadrants of the tub is expected to be higher than the air temperature in the fourth and third quadrants of the tub. In addition, due to the condensed water from the condensing port 230 and the outside air from the duct hole 202, the air in the third and fourth quadrants is relatively low in temperature, which makes it impossible to accurately estimate the temperature of the drum.

In particular, considering the configuration of the airflow hole 203, the condensing port 230, and the duct hole 202, it may be seen that the optimum temperature sensor position is the first quadrant 1S. In one example, when the airflow hole 203 is provided in the second quadrant, the optimal temperature sensor position may be the second quadrant. When the temperature sensor 60 is provided in the first quadrant 1S, the temperature sensor 60 may be mounted at a position offset from the center of the tub in the circumferential direction by a greater predetermined angle than that in the induction module 70. This is because it may be necessary to prevent the magnetic field generated in the induction module 70 from affecting on the temperature sensor 60. In FIG. 11, the area of influence of the magnetic field is indicated by "B". Thus, the temperature sensor 60 may be mounted on the inner peripheral surface of the tub in the first quadrant 1S of the tub outside the area "B". The area "B" may be substantially the area to which the coil of the induction module 70 is projected. The size of the induction module 70 may be greater than the size of the coil. Thus, the temperature sensor may be mounted in the vicinity of the induction module 70 or in the end portion of the induction module 70 in the circumferential direction. That is, the temperature sensor may be provided outside the projection area of the coil in the circumferential direction. In addition, the temperature sensor 60 may be positioned so as to be farther away from the airflow hole in the clockwise direction. Conversely, when the airflow hole is provided in the second quadrant, the temperature sensor 60 may be mounted at a position that is spaced apart from the airflow hole in the counterclockwise direction.

FIG. 29 illustrates a connection portion 209 in which the front portion and the rear portion of the tub are coupled to each other via bolts or screws. The connection portion 209 is formed so as to protrude radially outward from the outer peripheral surface of the tub. Thus, the temperature sensor may be located in front of or behind the connection portion 209 in order to avoid interference with the connection portion 209.

As a result, it may be seen that the position of the temperature sensor is located in the first quadrant 1S of the transverse cross section of the tub and has a positive value with respect to the x and y axes. In one example, when the airflow hole is provided in the first quadrant, the position of the temperature sensor may be the second quadrant. In addition, it may be seen that the temperature sensor may be located in front of or behind the connection portion 209 near the center of the tub in the longitudinal direction of the tub. Therefore, the temperature sensor may be mounted at substantially the center position of the induction module in the longitudinal direction, so that the portion of the drum having the highest temperature may be accurately sensed.

Figure 24:
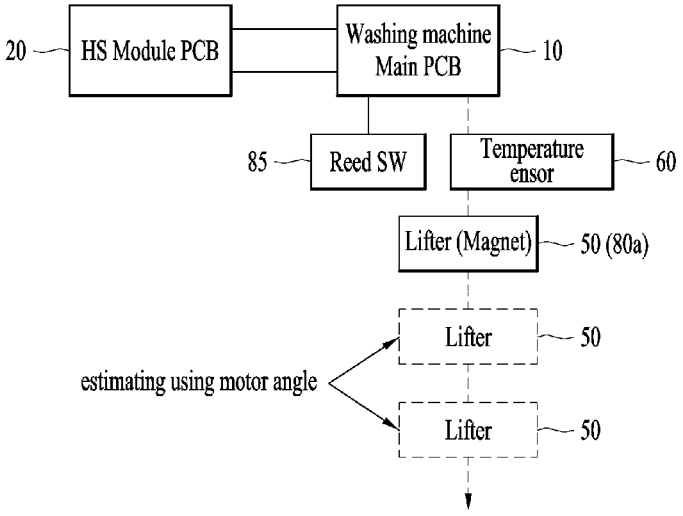
FIG. 24 shows a block diagram of another embodiment of control components.

FIGS. 23 and 24 illustrate an example in which the temperature sensor 60 is connected to the main controller 100. That is, the main controller 100 performs a process of estimating the temperature of the drum based on the temperature sensed by the temperature sensor 60. Thus, when the temperature of the drum is estimated, phase S30 illustrated in FIG. 28 may be performed based thereon.

Alternatively, the temperature sensor 60 may separately perform a process of estimating the temperature of the drum. That is, the temperature sensor 60 may be formed in the form of an assembly or module having a separate processor. In this case, the drum temperature estimated by the temperature sensor 60 may be transmitted to the main controller 100.

In one example, phase S30 may be performed by the module controller 200, rather than by the main controller 100. In either case, when the temperature of the drum exceeds a threshold temperature, overheating of the drum may be recognized and the output of the induction module may be interrupted.

Through the above-described embodiments, it may be seen that control logic for preventing overheating of the drum, control logic for preventing overheating of the lifter, the temperature sensor for preventing the drum from overheating, and control logic using the temperature sensor may provide a laundry treatment apparatus having enhanced safety and reliability. In addition, it may be seen that the temperature sensor capable of more accurately sensing the temperature of the drum in an indirect manner and the mounting position of the temperature sensor may be provided.

Features in each of the above-described embodiments may be implemented in a combined manner in other embodiments as long as they are not contradictory or exclusive of each other.

Industrial applicability may be included in the Detailed Description section.

What is claimed is:

1. A laundry treatment apparatus comprising:

a tub having a module-mounting portion that is disposed at an outer circumferential surface of the tub;

a drum rotatably disposed inside the tub and configured to receive laundry therein, the drum being made of a metal material; and an induction module disposed at the module-mounting portion of the tub and configured to generate an electromagnetic field to heat the drum, wherein the module-mounting portion comprises a flat portion disposed radially inward relative to the outer circumferential surface of the tub.

2. The laundry treatment apparatus of claim 1, wherein the module-mounting portion is disposed at an upper portion of the outer circumferential surface of the tub, the module-mounting portion further comprising a connection portion that extends from at least one end of the flat portion in a circumferential direction of the tub and that is connected to the outer circumferential surface of the tub.

3. The laundry treatment apparatus of claim 2, wherein the flat portion comprises a first flat portion and a second flat portion that are connected to each other by the connection portion.

4. The laundry treatment apparatus of claim 1, wherein the induction module comprises:

a base housing disposed at the tub; and a coil disposed at the base housing and configured to generate a magnetic field based on an electric current being applied to the coil.

5. The laundry treatment apparatus of claim 4, wherein the induction module comprises a module cover that is coupled to the base housing and that covers the coil.

6. The laundry treatment apparatus of claim 4, wherein the coil comprises windings of wires, and wherein the base housing comprises fixing ribs that protrude upward from a bottom surface of the base housing and that define coil slots receiving the wires.

7. The laundry treatment apparatus of claim 6, wherein the coil comprises:

a pair of front-rear straight portions that extend in a circumferential direction of the tub with a curvature;

a pair of left-right straight portions that extend in an axial direction of the drum; and curved portions that are each disposed between one of the pair of front-rear straight portions and one of the pair of left-right straight portions, and wherein a radius of curvature of a radially innermost wire located at each of the curved portions is equal to a radius of curvature of a radially outermost wire located at each of the curved portions.

8. The laundry treatment apparatus of claim 1, wherein the flat portion has a surface that is depressed inward relative to an extended circumferential line of the outer circumferential surface of the tub.

9. The laundry treatment apparatus of claim 1, wherein a distance between the drum and the module-mounting portion of the tub is less than a distance between the drum and a portion of the outer circumferential surface positioned adjacent to the module-mounting portion.

10. The laundry treatment apparatus of claim 1, wherein an inner circumferential surface of the tub has (i) a first portion corresponding to the module-mounting portion and (ii) a second portion that is disposed adjacent to the first portion in a circumferential direction of the tub, and wherein the first portion of the inner circumferential surface is disposed radially inward relative to the second portion of the inner circumferential surface of the tub.

11. The laundry treatment apparatus of claim 1, wherein the flat portion extends from a front portion of the tub to a rear portion of the tub.

12. The laundry treatment apparatus of claim 11, wherein the flat portion is located at a center portion of the tub between the front portion of the tub and the rear portion of the tub, and wherein a length of the module-mounting portion in a front-rear direction of the tub is less than a length of the tub in the front-rear direction of the tub.

13. The laundry treatment apparatus of claim 2, wherein the connection portion has a curved shape or a straight shape.

14. The laundry treatment apparatus of claim 13, wherein a width of the induction module in the circumferential direction of the tub is greater than a width of the flat portion in the circumferential direction of the tub.

15. The laundry treatment apparatus of claim 7, wherein the pair of front-rear straight portions of the coil are arranged parallel to the flat portion in the circumferential direction of the tub.

16. The laundry treatment apparatus of claim 7, wherein a distance between the coil and the drum is constant.

17. The laundry treatment apparatus of claim 16, wherein the distance between the coil and the drum is greater than or equal to 24 mm and less than or equal to 30 mm.

18. The laundry treatment apparatus of claim 13, wherein the connection portion comprises a plurality of connection portions that are connected to ends of the flat portion, and wherein the module-mounting portion comprises the flat portion and the plurality of connection portions.

19. The laundry treatment apparatus of claim 3, wherein the induction module comprises a coil of wires and is disposed between a front side of the tub and a rear side of the tub, the coil being wound around the connection portion and extending parallel to the flat portion of the module-mounting portion.

20. The laundry treatment apparatus of claim 19, wherein the coil comprises a hollow center portion defined at a position corresponding to the connection portion.

21. The laundry treatment apparatus of claim 4, wherein the tub comprises:

a front tub and a rear tub that are coupled each other; and a tub connector that couples the front tub and the rear tub to each other, the tub connector comprising a first coupling rib disposed at the front tub and a second coupling rib disposed at the rear tub, and wherein the first and second coupling ribs are coupled to each other and arranged along a circumferential direction of the tub, wherein a portion of the tub connector is located under the induction module, and wherein the base housing defines a penetration portion at a bottom surface of the base housing, the penetration portion accommodating the portion of the tub connector.

22. The laundry treatment apparatus of claim 21, wherein the induction module comprises reinforcing ribs that are respectively disposed forward relative to the tub connector and rearward relative to the tub connector, the reinforcing ribs protruding downward from the bottom surface of the base housing toward the outer circumferential surface of the tub.

23. The laundry treatment apparatus of claim 22, wherein the penetration portion is defined between the reinforcing ribs in a front-rear direction of the tub.

24. The laundry treatment apparatus of claim 21, wherein the tub connector comprises a plurality of extended connecting portions that are arranged in the circumferential direction of the tub, and wherein the flat portion is disposed between the plurality of extended connecting portions.

25. The laundry treatment apparatus of claim 24, wherein an angle defined between two extended connecting portions among the plurality of extended connecting portions is 50 degrees about a center of the drum.

26. The laundry treatment apparatus of claim 24, wherein the plurality of extended connecting portions comprise:

a first extended connecting portion that is disposed at an upper portion of the tub and that is disposed at a first side of the module-mounting portion with respect to a radial line passing through a center of the drum; and a second extended connecting portion that is disposed at the upper portion of the tub and that is disposed at a second side of the module-mounting portion with respect to the radial line.

* * * * *